United States Patent [19]

Bayliss

[11] 4,063,409

[45] Dec. 20, 1977

[54] CUSTOM WATCH

[75] Inventor: John A. Bayliss, Sunnyvale, Calif.

[73] Assignee: Intel Corporation, Santa Clara, Calif.

[21] Appl. No.: 646,591

[22] Filed: Jan. 5, 1976

[51] Int. Cl.[2] ..... G04C 3/00

[52] U.S. Cl. ..... 58/23 R; 58/39.5; 58/50 R; 58/4 A

[58] Field of Search ..... 58/23 R, 50 R, 39.5, 58/152 R; 340/336, 324 R; 235/92 T, 152

[56] References Cited

U.S. PATENT DOCUMENTS

| | | | |
|---|---|---|---|
| 3,803,587 | 4/1974 | Mead | 340/336 |
| 3,876,867 | 4/1975 | Schull et al. | 235/92 T |
| 3,879,723 | 4/1975 | Hornung | 340/336 |
| 3,912,914 | 10/1975 | Moylan | 235/152 |
| 3,925,777 | 12/1975 | Clark | 340/336 |
| 3,937,004 | 2/1976 | Natori et al. | 58/152 R |
| 3,946,549 | 3/1976 | Cake | 58/50 R |
| 3,955,355 | 5/1976 | Luce | 58/50 R |
| 3,961,472 | 6/1976 | Riehl | 58/4 A |
| 3,962,571 | 6/1976 | Brantingham | 235/152 |
| 3,962,858 | 6/1976 | Levine et al. | 58/4 A |
| 3,962,861 | 6/1976 | Protta et al. | 58/39.5 |
| 3,973,110 | 8/1976 | Rode et al. | 235/152 |

*Primary Examiner*—Robert K. Schaefer
*Assistant Examiner*—Vit W. Miska
*Attorney, Agent, or Firm*—Spensley, Horn and Lubitz

[57] ABSTRACT

A random access memory is combined with a programmable logic array to count time pulses within an integrated circuit watch. A master oscillator drives the internal timing clocks and serves as a time standard for a timing and control circuit means which manipulates data within the random access memory. The timing and control circuit may contain a programmable read-only memory so that words stored within the random access memory may be read, and manipulated, in a selected sequence. The programmable logic array increments the word selectively read from the random access memory, compares it to a limit value and generates one or more flags according to the desired data manipulation. Words stored within the random access memory may be selectively displayed by a liquid crystal display or light emitting diode display in a selected format determined by the programmable read-only memory. A driver circuit coupled to the display may also contain a read-only memory so that the data may be displayed in a selected one of plurality of display fonts. The operational and display modes may be customized by appropriately modifying the programmable logic array and read-only memories without altering the system architecture.

31 Claims, 32 Drawing Figures

Z START COUNT
Y STOP COUNT
X STOP
W DISPLAY
V RESET
U HOLD DISPLAY
T CONT. COUNT
S RESET HOLD

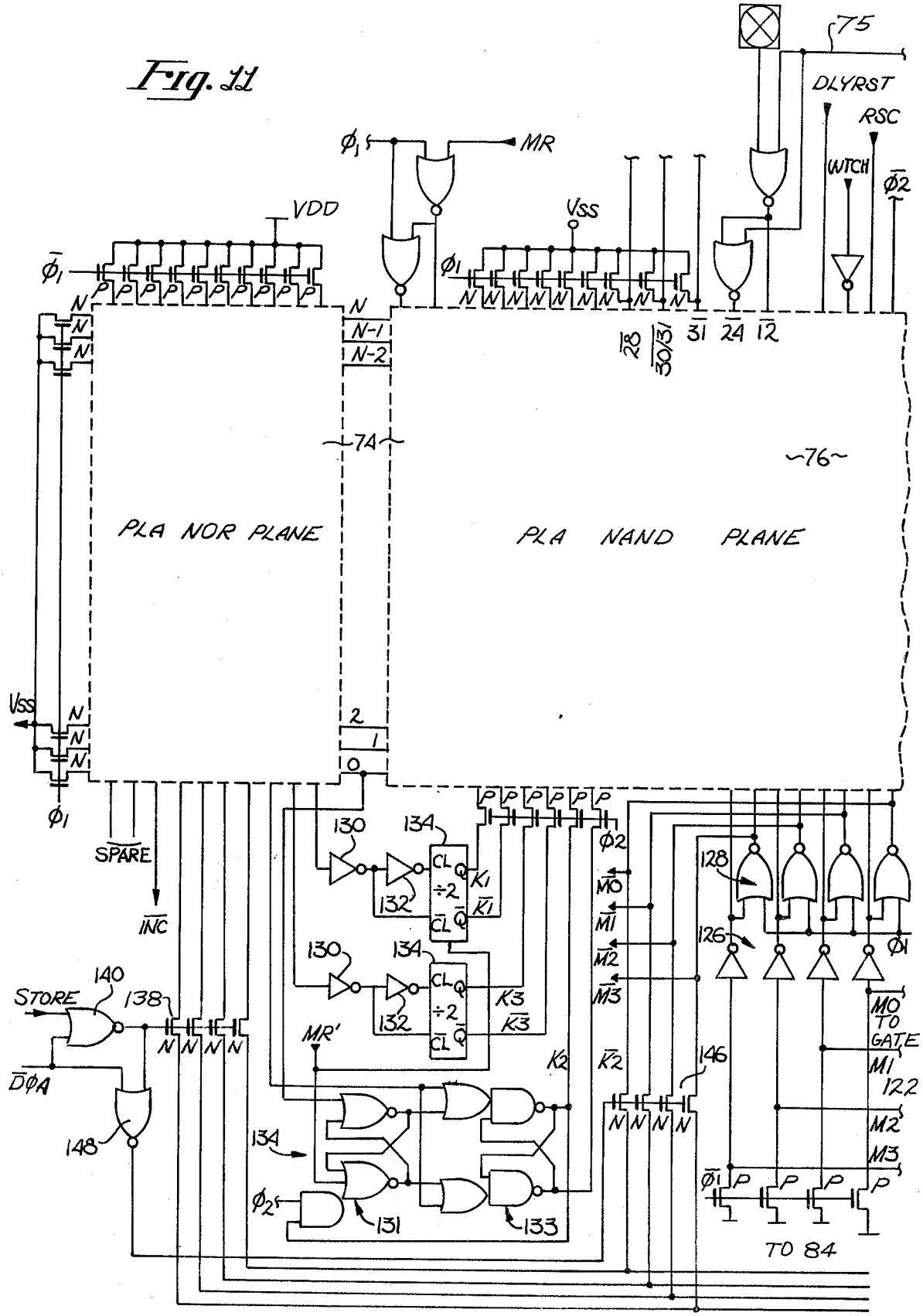
Fig. 11
75
DLYRST
RSC
WTCH
$\overline{\phi 2}$
$\phi_1$
MR
VDD
VSS
$\overline{\phi_1}$
$\phi_1$
N
N-1
N-2
$\overline{28}$
$\overline{30/31}$
$\overline{31}$
$\overline{24}$
$\overline{12}$
74
76
PLA NOR PLANE
PLA NAND PLANE
VSS
2
1
0
$\phi_1$
SPARE
INC
130
134
132
CL
Q
÷2
$\overline{CL}$
$\overline{Q}$
K1
$\overline{K1}$
K3
$\overline{K3}$
$\phi 2$
$\overline{M0}$
$\overline{M1}$
$\overline{M2}$
$\overline{M3}$
128
126
$\phi 1$
140
STORE
138
$\overline{D\phi A}$
148
MR'
K2
$\overline{K2}$
146
134
131
133
$\phi_2$
$\overline{\phi 1}$
M0 TO GATE
M1
122
M2
M3
TO 84

Fig. 12
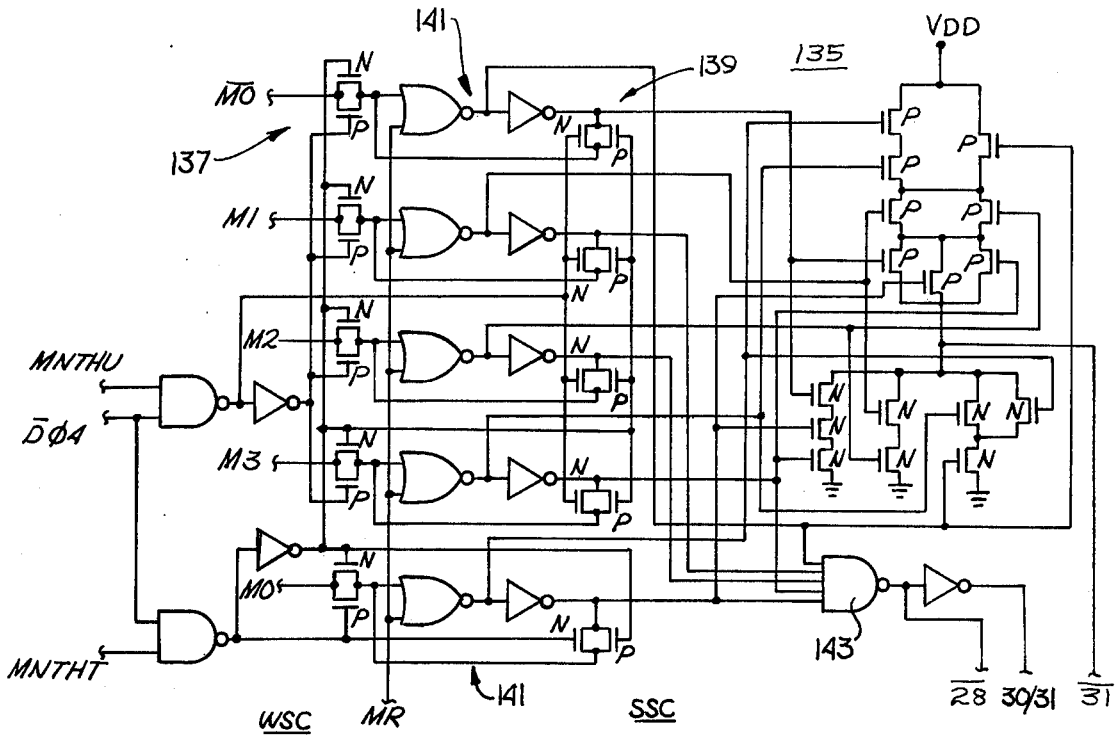
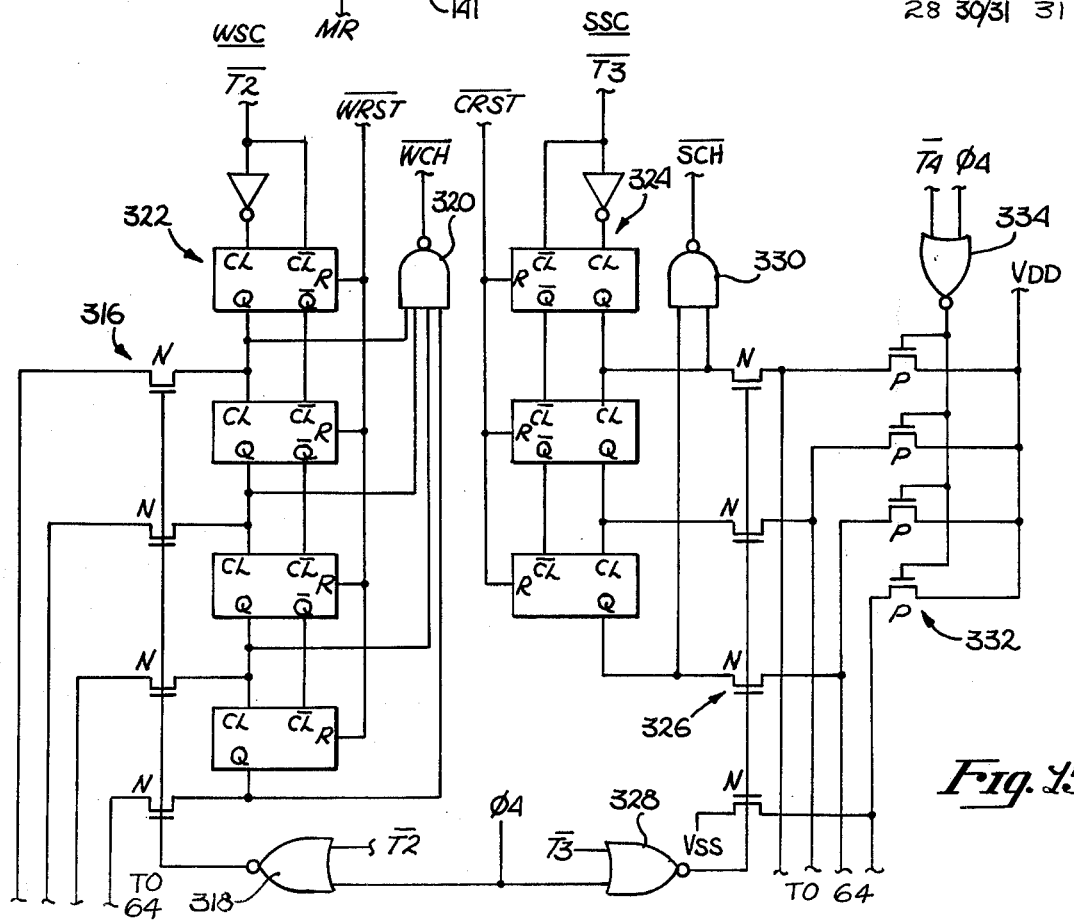
Fig. 15

CYCW
494
300
WTCH
434
TS
VDDO
VSS
436
RSC
WA
WB
WC
DATE
440
VDD
DLYRQ
WTCH
428
438
SW1
426
424
422
446
418
416
430
420
WTCH
φ4
442
SW1
SW3
444
SW1
MRST
SW2
T4
φ2
ZERO
ZERO

STOP WATCH CONTROL P.L.A.

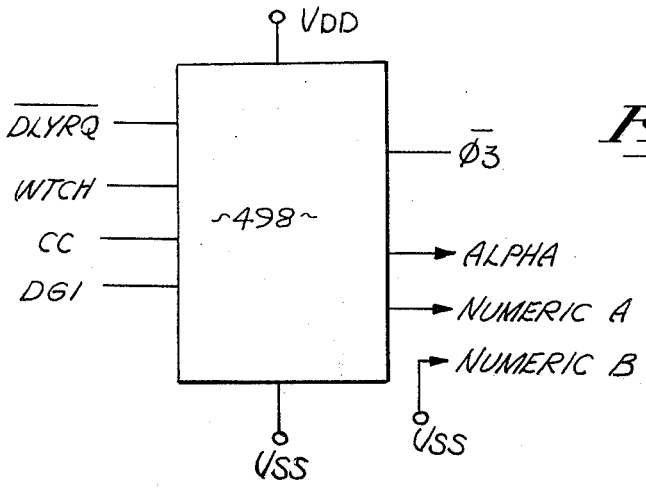
Fig. 20
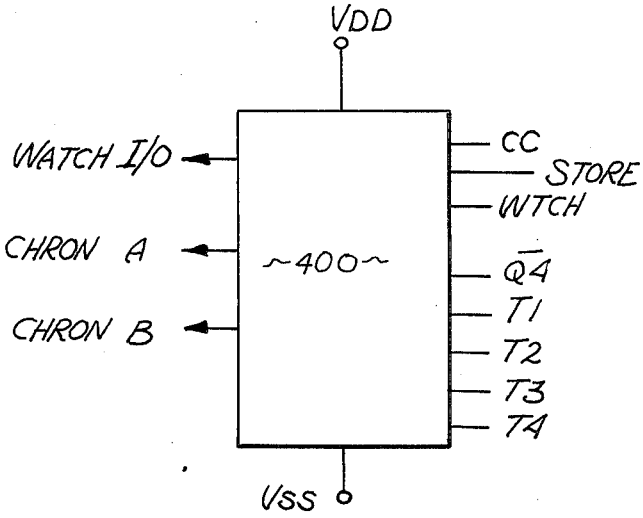
Fig. 21
Fig. 22
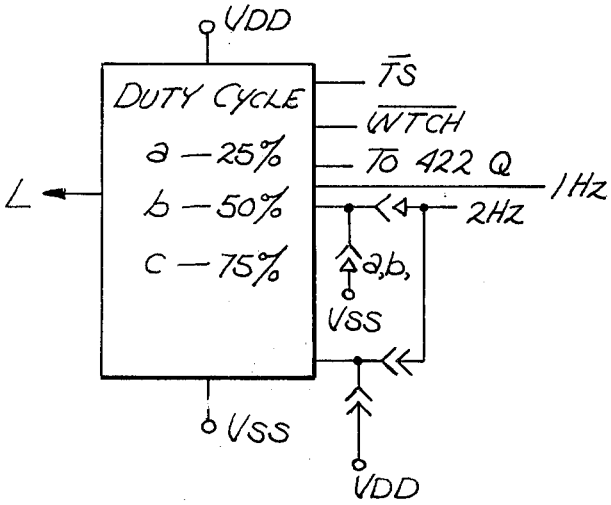
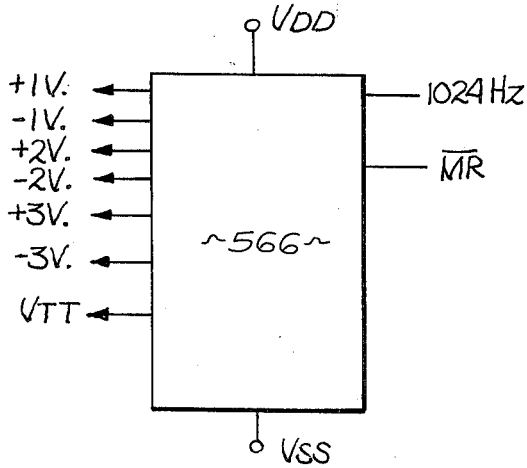
Fig. 25

586
VDD
NAND DECODER "P" TYPE ARRAY (1 OF 16)
90
582
584
92
NOR R.O.M. "N" TYPE ARRAY
SA
SB
SC
SD
SE
SF
SG
SH
SJ
VDD
VSS
NUMERIC A
NUMERIC B
ALPHA
580

SEGMENT DRIVER A
56
5A
L
DEC
610
DATE
COM.
618
VDD
VTT
616
4G
608
612
614
592
596
606
604
600
602
598
594
590
588
1A
1B
1C
2A
2B
4C
4D
4E
4F
DG1
DG2
DG3
DG4
DG5
DG6
SA
SB
SC
SD
SE
SF
SG
DP
DATE

CUSTOM WATCH

BACKGROUND OF THE INVENTION

1. Field of the Invention

The present invention relates to the field of electronic watch circuits, and more particularly integrated watch circuits having a plurality of operational modes.

2. Description of the Prior Art

In the conventional integrated circuit watch counters, which also function as frequency dividers, are used for both counting and storing the time for display. Proper carries and adjustments in regard to seconds, minutes, hours, days, months, and years is made by means of gated couplings among the various counters. For an integrated circuit watch having a single display, such as hours, minutes, seconds, and date, this type of circuit can be economically employed. If a stop watch or chronograph operational mode is added to such a watch, or if an additional watch display is desired, the states of each counter must be selectively gated to the display device by means of an appropriately hard-wired logic circuit. As the number of operational modes increases, the complexity and the number of logic gates necessary to selectively display the states of each counter increases nonlinearly. Moreover, whenever market demands for various operational modes chnges, the logic circuit must be redesigned. This increases the cost and time necessary to obtain production quantities of new watch circuits capable of satisfying new and diverse consumer demands.

What is needed is a low cost, low power integrated watch circuit capable of operating in a plurality of watch or chronograph modes and capable of being easily modified to operate in a plurality of selected modes.

BRIEF SUMMARY OF THE INVENTION

The present invention is a time keeping circuit in an integrated circuit watch. The watch has a control means for selectively generating an address and control signal, has a master oscillator coupled to the control means, and has an output means for generating an output signal. The timekeeping circuit comprises an address decoder means for the coding of at least part of the address and control signal. The address decoder means is coupled to the control means. A random access memory, referred to as RAM, is coupled to the addressed decoder means. The RAM is responsive to the address and control signal by providing a selected binary word from the RAM. A programmable logic array, referred to as PLA, is coupled to the address decoder means. Finally, memory control means selectively couples the selected binary word from the RAM to the PLA and to the output means. The memory control means is coupled to the RAM, PLA, and output means. The PLA generates an output binary word in response to the address and control signal and in response to the selected binary word. The memory control means is also for selectively coupling the output binary word to the RAM and to the output means from the PLA.

The method of operation of the present invention provides a means for keeping time in an integrated circuit. The method comprises the steps of decoding a first address and control signal by the address decoder means coupled to the control means. The address decoder means selectively accesses at least one cell within the RAM to which it is coupled. The selected binary word stored in the RAM is coupled to a memory control means in response to the output from the address decoder means and the control means. The selected binary word is then selectively coupled from the memory control means to the PLA, to the RAM or to the output means.

When the memory means couples the selected binary word to the PLA, the method may further comprise the steps of generating an output binary word from the PLA. The output binary word assumes a predetermined reset value if the selected binary word equals a selected predetermined limit value fixed within the PLA. However, the output binary word is equal to the selected binary word plus one, if the selected binary word is less than the selected predetermined limit value fixed within the PLA. Finally, a second address and control signal is generated if the output binary word generated by the PLA is the predetermined reset value.

BRIEF DESCRIPTION OF THE DRAWINGS

FIG. 11 is a simplified schematic of the main PLA, flag flip-flops and PLA output bus.

FIG. 12 is a schematic of the calendar correction circuit.

FIG. 15 is a schematic of the watch sequence counter and chronograph sequence counter.

FIG. 20 illustrates the inputs and outputs for the logic circuit for alpha, numeric A and numeric B.

FIG. 21 illustrates the inputs and outputs for the logic circuit of chron A, chron B, and watch I/O.

FIG. 21 illustrates the inputs and outputs for the logic circuit colon drive.

FIG. 25 illustrates the inputs and outputs to the voltage converter.

DETAILED DESCRIPTION OF THE PREFERRED EMBODIMENTS

The present invention is a digital watch circuit fabricated on one or more integrated circuit silicon chips. The logic circuit employs complex logic techniques in order to increase flexibility and reduce chip size over the prior art approach for a watch having the same number of operational modes. Time storage and time increment functions are separated to allow a random access memory (hereinafter referred to as RAM) to be used for time storage and a programmable logic array (hereinafter referred to as PLA) to control time counting. A static RAM is used for storing the states of the time digits. For the purposes of illustration only, the present RAM is organized into 16 words of four bits each for the watch storage. Sixteen four bit words may be used for chronograph A count and storage, and eight four bit words are used for chronograph B storage. The PLA employs a nand-nor logic configuration utilizing dynamic techniques to permit single device arrays. As will be discussed in greater detail below, in the present embodiment, the PLA has sixteen inputs, ten outputs and forty-eight minterms.

SYSTEM ARCHITECTURE

Figure 1:
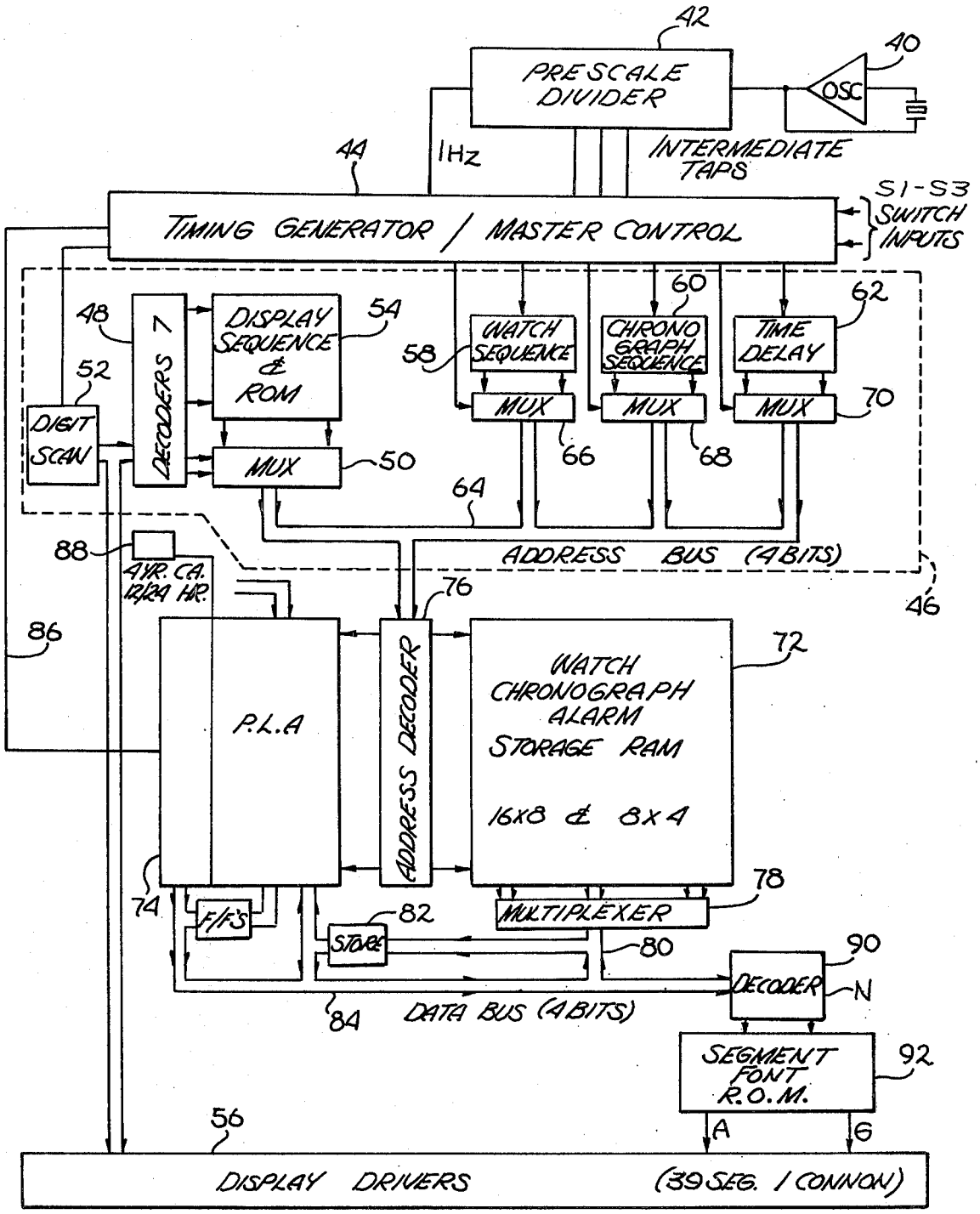
FIG. 1 is a simplified block schematic of one embodiment of the present invention illustrating the system architecture.

The overall operation and general organization of the present invention is illustrated by the block diagram of FIG. 1. The time standard of the clock circuit is a master oscillator 40 having a frequency of 32,768 Hz. Oscillator 40 is a crystal controlled oscillator well known to the art and may have an accuracy of 2ppm. Oscillator 40 is on the same chip as the remaining portion of the circuit with the possible exception of the crystal and certain external passive devices. Any time standard well known to the art may be employed.

Oscillator 40 couples its output into a prescale divider circuit 42. Prescale divider circuit 42 divides the time standard of 32.768 kHz down to 1 Hz, 10 Hz and several other intermediate frequencies. These frequencies provide the fundamental clocking signal for timekeeping and a plurality of internal clocking signals for internal control and sequencing. The frequencies will be described in greater detail in connection with the remaining circuitry. Again, any prescale divider circuitry well known to the art may be employed, and it is to be understood that the present invention is not limited by the particular embodiment of prescale divider circuit 42 illustrated.

Prescale divider 42 provides a series of frequencies required by timing generator and master control circuit 44 (sometimes referred to as timing and control circuit 44). Timing generator and master control circuit 44 is a central element of the clock circuit used to coordinate the operation of the various circuit elements. Timing and control circuit 44 has one or more mechanical switches, S1 - S3, as user inputs and has one or more internal inputs as feedbacks from other circuit elements. The particular operational function, whether display, timeset, counting or storage, is timed and controlled by timing and control circuit 44. The details of timing generator and master control circuit 44 will be described in relation to FIGS. 6, 8, and 16 - 26.

Timing and control circuit 44 is coupled to a RAM address generator 46. In one embodiment of the present invention RAM address generator 46 includes a display sequence, programmable read only memory (ROM) 54. Display sequence ROM 54 generates the binary addresses of various words retained within the storage RAM. The RAM addresses will be read from ROM 54 according to instructions received from timing and control circuit 44 through a decoder 48. Various RAM words, which are to be displayed according to a preselected display format, are read from ROM 54 by means of a digit scan circuit 52. Digit scan circuit 52 generates at least one control signal in response to timing signals received from timing and control circuit 44. The output of digit scan circuit 52 is coupled to ROM 54 through decoder 48 and is also coupled to display drivers 56. Thus, display of the output digits is synchronized with the generation of RAM addresses.

In other embodiments of the present invention, RAM address generator 46 may also include one or more sequencing circuits. For example, in FIG. 1 RAM address generator 46 includes a watch sequence circuit 58, a chronograph sequence circuit 60, and a time delay circuit 62. Watch sequence circuit 58, chronograph sequence circuit 60 and time delay circuit 62 are each coupled to and controlled by timing and control circuit 44. Each circuit appropriately generates an additional address or addresses which are required for selected operational modes of the watch. The operation and detail of each of these circuits will be described in reference to FIGS. 13 - 15. In the preferred embodiment, RAM address generator 46 includes multiple sequencing circuits. In order to conserve silicon chip space, the output of each sequencing circuit of RAM address generator 46 is read onto a single address bus through a corresponding plurality of multiplexing circuits, i.e., display sequencing ROM 54 is read onto address bus 64 by multiplexer 50, watch sequence counter 58 by multiplexer 66, chornograph sequence counter 60 by multiplexer 68 and time delay counter 62 by multiplexer 70.

The incrementing and storage functions of the present invention are performed by RAM 72 and PLA 74. Address bus 64 is coupled to an address decoder 76. Address decoder 76 is coupled both to PLA 74 and RAM 72. Table 1, below, maps the location of each word within RAM 72 in correspondence to FIGS. 10A and 10B. In the embodiment illustrated, RAM 72 has sixteen locations for four bit words which are associated with the watch storage and count. RAM 72 also has eight locations for four bit words associated with the count of chronographs A and B. Similarly, RAM 72 has eight locations for two four bit words associated with the storage of chronographs A and B. In the present embodiment only chronograph A count and chronograph B store portions are used. Additional storage locations, organization, and word sizes may be employed by the present invention without departing from its spirit or scope.

TABLE 1

| | LOCATION WATCH | CHRONOGRAPH COUNT | CHRONGRAPH STORE |
|---|---|---|---|
| 0 | ÷ 10 | 1/10 seconds | 1/10 seconds |
| 1 | seconds units | seconds units | seconds units |
| 2 | seconds tens | seconds tens | second tens |
| 3 | minutes units | minutes units | minutes units |
| 4 | minutes tens | minutes tens | minutes tens |
| 5 | hours units | | |
| 6 | hours tens | | |
| 7 | AM/PM | | |
| 8 | DOM UNITS | C | |
| 9 | DOM TENS | F | |
| 10 | MONTH UNITS | L | |
| 11 | MONTH TENS | P | |
| 12 | | | |
| 13 | | | |
| 14 | | | |
| 15 | time delay | | |
| ///// | | | |
| //// | | | |
| /// | | | |
| // | | | |
| / | | | |

Figure 10A:
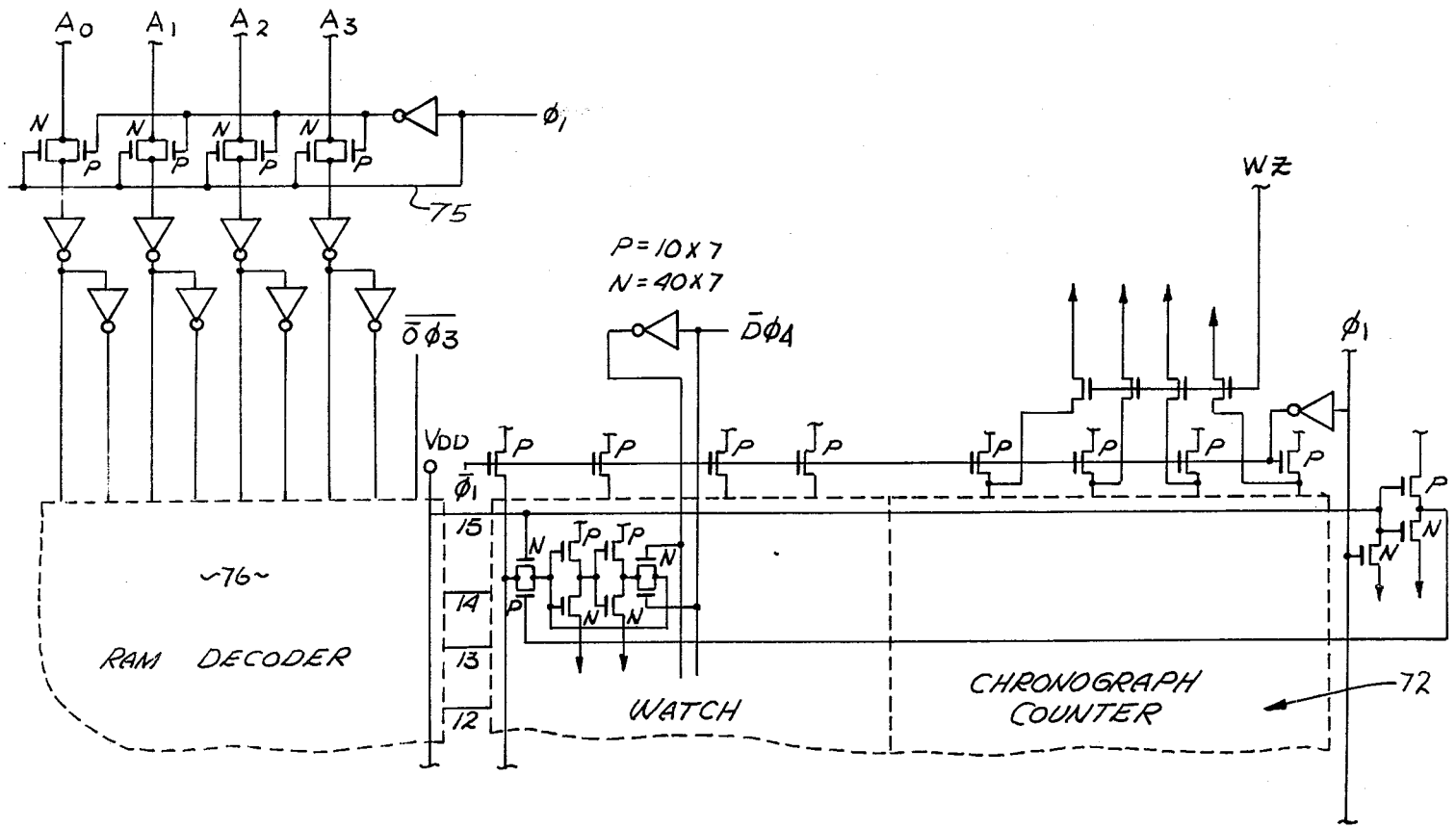
FIGS. 10A and 10B are a simplified schematic of the upper and lower portions respectively of the RAM, the RAM multiplexers, output bus and storage means.
Figure 10B:
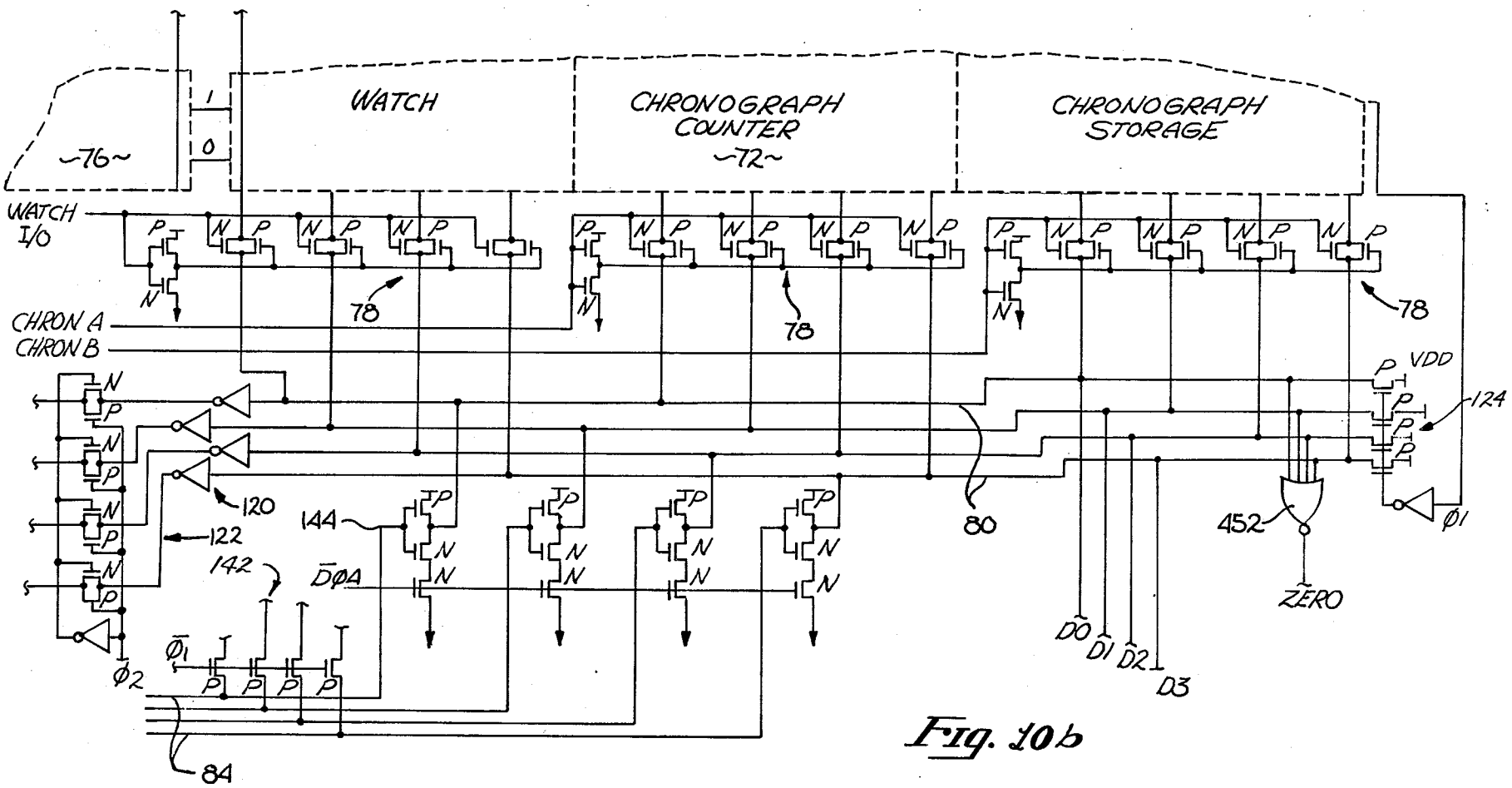

RAM 72, as illustrated in FIGS. 10A and 10B, has the capacity for a full watch count, counting from seconds to year and a chronograph count, counting and storing for, example, from one-hundredth of a second to 99 hours. In the present embodiment the watch storage is preceded with one divide-by-ten prescale. This location of the watch storage could be labeled, 1/10 seconds - tenths, as for chronographs A and B, and is provided only so that prescale divider circuit 42 is required to generate only a single 10 Hz signal to drive both the watch and chronographs. If desired the first RAM location for the chronographs and watch could have be chosen as 100 Hz, if such a frequency were provided by prescale divider circuit 42. The word labeled, "time delay" is provided so that fixed delays can be generated. In the present embodiment a single time delay of ten seconds is provided, although the present invention could provide multiple delays of nearly arbitrary length.

The general operation of the present invention may now be understood. One or more predetermined control signals will be generated by timing and control circuit 44, which may depend in part upon the switch inputs, S1 - S3. In response to the timing and control signals from timing and control circuit 44, RAM address generator 46 will produce the appropriate RAM address.

Consider, for example, the normal time incrementing operation of the watch. According to a preselected control signal, initiated by oscillator 40 and coded by timing and control circuit 44, the RAM address of location, "0", of the watch storage will be accessed. The contents of location "0" of the watch storage is coupled by multiplexer 78 onto a common data bus 80. The contents will be stored in a storage means 82. At the appropriate time, the contents of storage means 82 is read into PLA 74 and compared to a preselected limit value. The appropriate limit value is selected in PLA 74 in response to PLA inputs from by address decoder 76 and timing and control circuit 44. If the contents of the word read from storage means 82 is less than the corresponding selected limit value the data word will be incremented by one and fed back by a feedback data bus 84 at the appropriate time into location "0" of the watch storage. In the case of the location "0" of the watch storage, the predetermined limit value will be 9. When the contents reach 9, the PLA will generate an increment flag, INC, which is fed back into timing and control circuits 44 by feedback line 86. The contents of location "0" of the watch storage is reset to zero and the contents of location "1" of watch storage, incremented by one and stored in RAM 72 at location "1". In this manner, a cumulative count is maintained for seconds, minutes, hours, AM or PM, the day of the week, months, and year. The calendar correction provided by circuit means 68 is for generating additional PLA inputs for the varying number of days in each month.

According to which switch inputs, S1 - S3, are selected timing and control circuit 44 will generate various other control signals which will selectively activate display sequence ROM 54, chronograph sequence counter 60 and various timesetting circuitry. During the display mode, data from RAM 72 and PLA 74 will be selectively coupled to decoder 90. Again, according to the switch inputs and control signals generated by timing and control circuit 44, one of the plurality of segment fonts may be chosen from a segment font ROM 92 which will sequentially activate selected indicia members associated with display driver 56 which is also controlled by digit scan 52. In the present embodiment only two of three possible fonts are used, although the capability of generating more fonts than three is within the scope of the present invention.

It may now be appreciated that the control and cooperation of the various elements of the present embodiment is organized about the timing scheme generated by timing and control circuit 44. The function to be performed within each timing interval will be described below.

THE MAIN RAM AND PLA

Various timing schemes may be chosen according to the functions which the clock is to perform. Any logic value system, positive, negative, or inverted, well known to the art, may be used in the present invention. In the illustrated embodiment it will be assumed that logic values are true when high or one, and false when low or zero. However, each timing scheme must be based upon the operation and the specific functions to be performed by RAM 72 and PLA 74. The primary function of RAM 72 and PLA 74 is time storage and time incrementation. In the present embodiment, a static RAM, and a nand-nor dynamic PLA is used to control time counting to various bases. RAM 72 uses an eight transistor cell for each bit as illustrated and described in relation to FIGS. 10A and 10B. In the present embodiment, 160 such cells are organized into 24 words, each having a four bit length. Timing and control circuit includes a 100 generator and a T generator. The $\phi$ generator, as described in more detail in relation to FIG. 6, generates at least four distinguishable $\phi$ clock intervals, i.e., 100 1 -$\phi$04. Clock signals $\overline{D}\phi 3$ and $\overline{D}\phi 4$ are generally equivalent clock pulses $\phi 3$ and $\phi 4$, except that $\overline{D}\phi 3$ and $\overline{D}\phi 4$ are inhibited during a display-only mode while $\phi 3$ and $\phi 4$ remain active. Each $\phi$ interval is 30 microseconds long. Thus, the $\phi$ generator has a complete cycle of 120 microseconds. A complete cycle of $\phi$ pulses is provided each time an incremented data is stored in RAM 72 or a display of the data is required. At all other times the $\phi$ generator is inhibited by appropriate control signals within timing and control circuit 44.

The first $\phi$ clock signal, $\phi$1, is used to precharge all dynamic logic nodes within the watch circuit. Thus, as illustrated in the timing diagram of FIG. 5, clock $\phi$1 is high at all times other than during clock signals $\phi$2 – $\phi$4.

Figure 3:
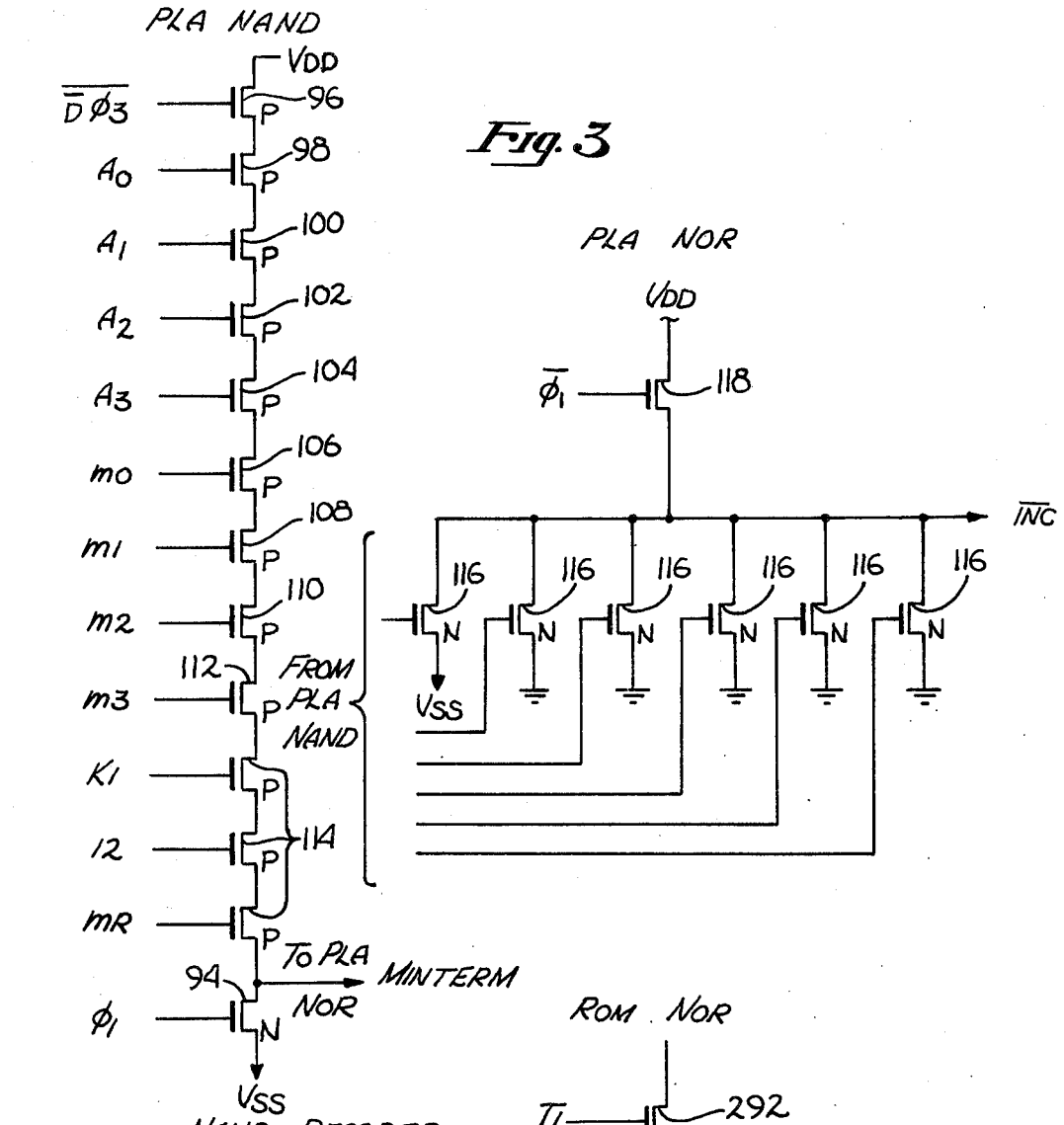
FIG. 3 is a schematic of a typical nand gate and nor gate in the main PLA.

A typical PLA nand and nor logic array is illustrated in FIG. 3. The PLA nand is comprised of a series circuit of P channel or enhancement MOS devices.

In the PLA nand illustrated as an example, twelve series P-type devices are employed. The number may be increased or decreased according to the minterm desired as the output of the PLA nand. Each PLA nand will have a series P-type device 96 controlled by a clock signal, which is usually $\overline{\overline{D}\phi 3}$, Thus, the PLA nand is active whenever clock signal, $\overline{D}\phi$3, is low or false. In the example, four additional series P-type devices 98 – 104 are controlled by the RAM address word. Similarly, an additional four P-type devices, 106 – 112, are controlled by the RAM data word stored at storage means 82. Additional P-type devices, denoted collectively by the reference numberal 114, may be coupled in series in the PLA nand and controlled by various control signals according to the minterm output desired. An N-type precharge device 94 is coupled between the output of the PLA nand and ground. Precharge device 94 is controlled by precharge clock signal, $\phi$1. Similarly, the PLA nor is a standard nor gate, well known to the art, comprised of parallel N-channel gates, and are collectively designated by the reference numeral 116. Each of the N-type devices 116 couples the output of the PLA nor to ground according to the output minterms coupled to their respective gates. Similarly, a precharged P-type device 118 couples the output of the PLA nor to the power supply and is controlled by the precharge clock signal, $\phi$1.

In order to avoid possible charge sharing problems in the PLA nand array, each input of the PLA nand, with the exception of the RAM addresses A0 – A3 and their complements, are forced low during clock interval $\phi$1. With the exception of P-type devices 98 – 104, this turns on all the P-type devices in the nand array and distributes the precharge or low potential throughout the entire array. During clock signal, $\phi$1, RAM addresses A0–A3 and their complements are changing and reach a valid state at or before the end of clock interval, $\phi$1. Typically, there is no charge sharing problem created by the RAM address inputs since they remain stable and are stored until the following pulse of clock, $\phi$1.

Figure 5A:
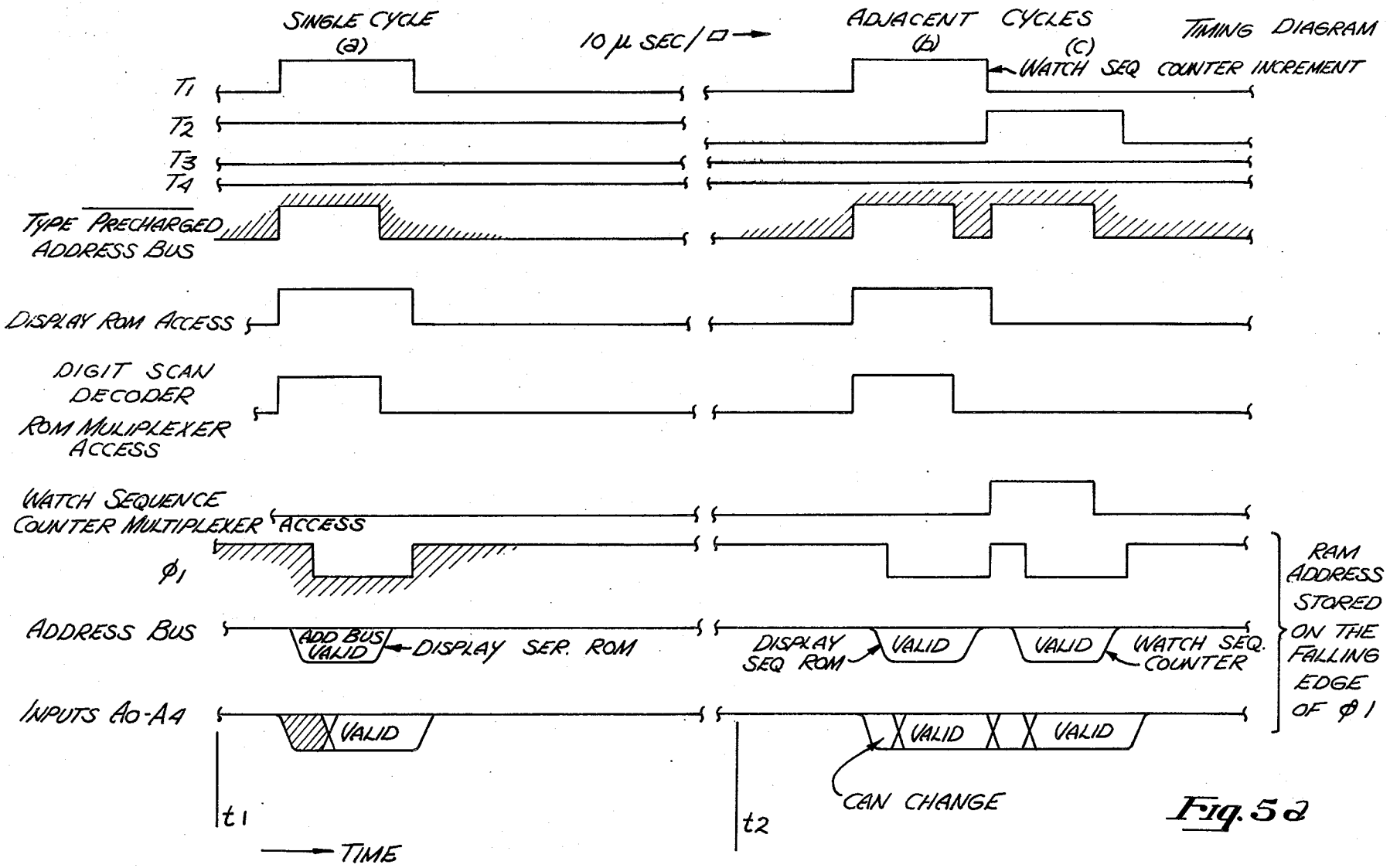
FIGS. 5*a*, and 5*b* are a timing diagram illustrating a timeset cycle, a display only cycle and a watch increment cycle.
Figure 5B:
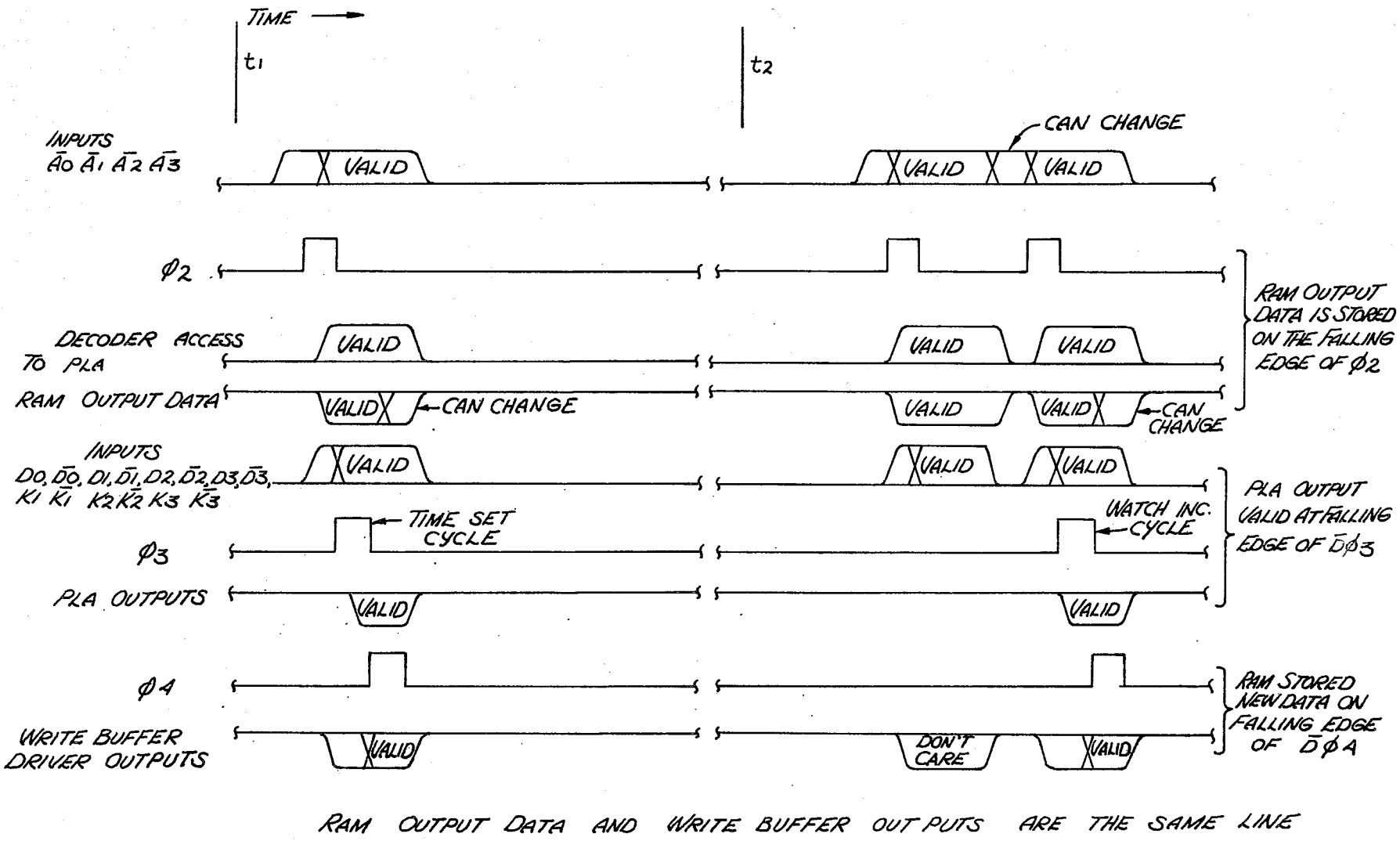

As will be shown in greater detail below, RAM 72 is accessed during clock pulse $\phi$2 when decoder 76 is enabled. Referring now to FIG. 10A, it may be seen that one of the sixteen RAM access lines is pulled high by decoder 76 at pulse clock $\phi$2 and the data in the RAM is read through multiplexer 78 onto RAM data bus 80. As illustrated in FIGS. 5A and 5B which are drawn to the same time scale, RAM address bus 64 goes valid before clock pulse, $\phi$2, remains valid through clock pulses, $\phi$3 and $\phi$4, and begins to go invalid during clock pulse, $\phi$1. At the same time as RAM decoder 76 is accessing RAM 72, the PLA nand inputs A0 – A3, are set in a valid state.

Each memory cell in the RAM is a CMOS latch comprised of a first and second inverter having a gated feedback loop. As shown in FIG. 10A the cell is gated to one column to the array of RAM 72 by a CMOS transmission gate coupled to the corresponding row of RAM 72. The stored bit in each memory cell will then be read out whenever the RAM access line at the corresponding location goes high, i.e., during $\phi$2. Therefore, it is possible that 3 RAM words may be simultaneously presented to multiplexer 78 (WATCH, CHRONOGRAPH COUNTER, CHRONOGRAPH STORAGE). Multiplexer 78 is illustrated in FIG. 10 by three separately controlled multiplexers, each consisting of four CMOS transmission gates. The appropriate RAM word is selectively coupled to the four line RAM data bus 80 by selective application of a multiplexer control signal, watch I/O, chron A or chron B. The selected RAM data word read onto data bus 80 is coupled through inverters 120 to CMOS transmission gates 122 where the data word is stored during clock pulse, $\phi$2, by means of dynamic storage of transmission gates 122.

The RAM data word is denoted collectively by the variables M0 – M3 at the PLA side of transmission gates 122 as shown in FIG. 11. The transmission gates, having been precharged by P-type devices 124 (FIG. 10B), during clock pulse $\phi$1, are then coupled through inverters 126 (FIG. 11) to a series of nor-gates 128. Nor gates 128 will serve to inhibit RAM data word, M0 – M3, whenever clock signal, $\phi$1, is high, and will invert and couple the RAM data word into PLA 94 whenever clock signal, $\phi$1 is low. Storage means 82 may be conceptualized as being comprised of inverters 120, transmission gate 122, precharged devices 124, inverters 126, and nor gates 128. Other configurations for storage means 82, well known to the art, may be employed without altering the scope of the present invention.

During clock pulse, $\phi$2, all the remaining PLA nand inputs also become valid and remain valid until the beginning of the next $\phi$1 clock pulse. Thus, during clock pulse $\phi$2, as illustrated in (FIG. 5A and 5B), the RAM address PLA inputs, A0 – A3 and their complements, the PLA inputs "$\overline{28}$", "$\overline{30/31}$", "$\overline{31}$", "$\overline{12}$", and "$\overline{24}$" become valid. Thus, the RAM data word, M0 – M3, is coupled to the PLA nand array during clock $\phi$2.

The full clock period, $\overline{D}\phi$3, is allowed for complete access through the PLA. This clock period allows the P-type nand gate to pull high if all of the inputs are low. The corresponding nor gates will pull low if they have any input connected to a high going nand gate. As shown in FIG. 5B, during clock pulses, $\phi$3, and $\phi$4, PLA flags K1 – K3 and their complements become valid. K1 – K3 and their complements are each generated from the output of the PLA nor array by means of inverters 130 and 132 and divide by two flip-flops 134 (FIG. 11). The output of flip-flops 134 are reinserted into the PLA nand array through P-type transmission gates clocked by clock signal $\phi$2. Thus, as illustrated in FIG. 5B, PLA inputs are valid during clock signals, $\phi$3 and $\phi$4.

During clock signal $\overline{D}\phi$4 the PLA output data, D0 – (FIG. 10B), may be written back into RAM 72 at the same position that was accessed for read out. The PLA output data is first gated through N-type transmission gates 138. N-type transmission gates 138 are controlled by the output from nor gate 140. Nor gate 140 has as its input, a STORE signal and $\overline{D}\phi$4 clock which are generated by timing the control circuit 44. Once gated through transmission gates 138, the PLA data outputs are transmitted along data feedback bus 84 which was precharged during clock signal, $\phi$1 by P-type precharging devices 142 (FIG. 10B). The PLA output data then serves as an input to CMOS inverters 144 which have a valid output during, $\overline{D}\phi$4. The appropriate multiplexers still remain valid and the PLA output data is written into the original cell in RAM 72 which is unlatched during $\overline{D}\phi$4 and becomes latched at the end of clock $\overline{D}\phi$4.

TABLE 2

| RAM DATA | RAM ADDRESS | 5830 C MAIN PLA MINTERMS (INPUTS ACTIVE L) $\overline{K1}$ | K1 | $\overline{K2}$ | K2 | $\overline{K3}$ | K3 | $\overline{28}$ | $\overline{30}/\overline{31}$ | $\overline{31}$ | $\overline{12}$ | $\overline{24}$ | RSC | $\overline{MR}$ | MR | DLYRST | COMMENTS | INC | D3 – D0 | K1 | K2(4) | K3 | K2(20) |
|---|---|---|---|---|---|---|---|---|---|---|---|---|---|---|---|---|---|---|---|---|---|---|---|
| 0 0 0 0 0 | AM/PM | | | | | | | | | | | | 1 | | 1 | | A | | 0 0 0 1 | | | | |
| 1 0 0 0 1 | HRT + AM/PM + MNT + DTU | | | | | | | | | | | | 1 | | 1 | | B | | 0 0 0 0 | | | | |
| 2 0 0 1 0 | HRU + HRT + MNU + DTT + MNT | | | | | | | | | | | | 1 | | 1 | | C | | 0 0 1 1 | | | | |
| 3 0 0 1 1 | HRU + DTT | | | | | | | | | | | | 1 | | 1 | | D | | 0 1 0 0 | | | | |
| 4 0 1 0 0 | HRT | | | | | | | | | | | | 1 | | 1 | | F | | 0 1 0 1 | | | | |
| 5 0 1 0 1 | SCET + MINT | | | | | | | | | | | | 1 | | 1 | | F | | 0 1 1 0 | | | | |
| 6 0 1 1 0 | | | | | | | | | | | | | 1 | | 1 | | G | | 0 1 1 1 | | | | |
| 7 0 1 1 1 | | | | | | | | | | | | | 1 | | 1 | | H | | 1 0 0 0 | | | | |
| 8 1 0 0 0 | DU | | | | | | | | | | | | 1 | | 1 | | I | | 1 0 0 1 | | | | |
| 9 1 0 0 1 | | | | | | | | | | | | | 1 | | 1 | | J | 1 | 0 0 0 0 | | | | |
| 5 0 1 0 1 | SECT | | | | | | | | | | | | 1 | | 1 | | K | 1 | 0 0 0 0 | | | | |
| 5 0 1 0 1 | MINT | | | | | | | | | | | | | | 1 | | L | 1 | 0 0 0 0 | | | | |
| 1 0 0 0 1 | HRU | | 1 | | | | | | | | 1 | | | | 1 | | WW + TERM B | 1 | 0 0 1 0 | | | | |
| 2 0 0 1 0 | HRU | | 1 | | | | | | | | 1 | | | | 1 | | VV | 1 | 0 0 0 1 | | | | |
| 2 0 0 1 0 | HRU | 1 | | | | | | | | | | | | | 1 | | N | | 0 0 1 1 | | | | |
| 2 0 0 1 0 | HRU | | 1 | | | | | | | | | 1 | | | 1 | | M | | 0 0 1 1 | | | | |
| 3 0 0 1 1 | HRU | 1 | | | | | | | | | 1 | | | | 1 | | O | | 0 1 0 0 | | | | |
| 3 0 0 1 1 | HRU | | 1 | | | | | | | | | 1 | | | 1 | | P | | 0 1 0 0 | | | | |
| 3 0 0 1 1 | HRU | 1 | | | | | | | | | | 1 | | | 1 | | Q | 1 | 0 0 0 0 | | | | |
| 0 0 0 0 0 | HRT | | | | | | | | | | 1 | | | | 1 | | R + TERM A | | 0 0 0 1 | S | | | |
| 1 0 0 0 1 | HRT | | | | | | | | | | 1 | | | | 1 | | XX | 1 | 0 1 0 0 | | | | |
| 4 0 1 0 0 | HRT | | | | | | | | | | | | | | 1 | | S | | 0 0 0 0 | R | | | |
| 1 0 0 0 1 | HRT | | | | | | | | | | | 1 | | | 1 | | T | | 0 0 1 0 | S | | | |
| 2 0 0 1 0 | HRT | | | | | | | | | | | | | | 1 | | U | 1 | 0 0 0 0 | R | | | |
| 0 0 0 0 0 | AM/PM | | | | | | | | | | 1 | | | | 1 | | V | | 0 0 0 1 | | | | |
| 0 0 0 0 0 | AM/PM | | | | | | | | | | | 1 | | | 1 | | W | 1 | 0 0 0 0 | | | | |
| 1 0 0 0 1 | AM/PM | | | | | | | | | | | | | | 1 | | X | 1 | 0 0 0 0 | | | | |
| 0 0 0 0 0 | MNT | | | | | | | | | | | | | | 1 | | Y + TERM A | | 0 0 0 1 | | | S | |
| 1 0 0 0 1 | MNT | | | | | | | | | | | | | | 1 | | Z | | 0 0 0 0 | | | R | |
| 2 0 0 1 0 | MNU | | | | | | 1 | | | | | | | | 1 | | AA | | 0 0 1 1 | | | | |
| 2 0 0 1 0 | MNU | | | | | 1 | | | | | | | | | 1 | | BB | 1 | 0 0 0 1 | | | | |
| 1 0 0 0 1 | DTT | | | | | | | | | | | | | | 1 | | CC + TERM B | | 0 0 1 0 | | | | S |
| 4 0 1 0 0 | DTU | | | | | | | | | | | | | | 1 | | DD + TERM E | | 0 1 0 | 1 | | S | |
| 0 0 0 0 0 | DTU | | | 1 | | | | | 1 | | | | | | 1 | | EE + + TERM A | 1 | 0 0 0 1 | | | | |
| 1 0 0 0 1 | DTU | | | | 1 | | | | | | | | | | 1 | | FF | | 0 0 1 0 | | | | |
| 1 0 0 0 1 | DTU | | | 1 | | | | | | | | | | | 1 | | GG | 1 | 0 0 0 1 | | | | |
| 8 1 0 0 0 | DTU | | | | 1 | | | | | | | | | | 1 | | HH | | 1 0 0 1 | | | | |
| 8 1 0 0 0 | DTU | | | 1 | | | 1 | | | | | | | | 1 | | II | 1 | 0 0 0 1 | | | | |
| 8 1 0 0 0 | DTU | | | 1 | | | | | | 1 | | | | | 1 | | JJ | | 1 0 0 1 | | | | |
| 2 0 0 1 0 | DTT | | | | | | | 1 | | | | | | | 1 | | KK | | 1 0 0 1 | | | | |
| 2 0 0 1 0 | DTT | | | | | | | | 1 | | | | | | 1 | | LL | 1 | 0 0 0 0 | | R | | |
| 2 0 0 1 0 | DTT | | | | | | | | | 1 | | | | | 1 | | SS | | 0 0 1 1 | | | | |
| 3 0 0 1 1 | DTT | | | | | | | | | | | | | | 1 | | TT | | 0 0 1 1 | | | | |
| | DELAY | | | | | | | | | | | | | | 1 | 1 | UU | 1 | 0 0 0 0 | | R | | |
| 1 1 1 1 | | | | | | | | | | | | | | | 1 | | MM | | 1 1 1 1 | | | | |
| | HRT | | | | | | | | | | 1 | | | 1 | | | NN | | 0 0 0 1 | | | | |
| | DTU | | | | | | | | | | | | | 1 | | | OO | | 0 1 0 0 | | | | |
| | MNU | | | | | | | | | | | | | 1 | | | PP | | 0 0 0 1 | | | | |
| | HRU | | | | | | | | | | 1 | | | 1 | | | QQ | | 0 0 0 1 | | | | |
| | MNTU | | | | | | | | | | | | | | | | RR | | 0 0 1 0 | | | | |
| | MNTT | | | | | | | | | | | | | | | | YY | | 0 0 0 0 | | | | |
| | | | | | | | | | | | | | | | | | ZZ | | 0 0 0 0 | | | | |

TABLE 3

| ÷ 10 | SECU | SECT | MINU | MINT | 12 HOUR HRU | HCT | MODE AM/PM | MNU | MNT |
|---|---|---|---|---|---|---|---|---|---|
| A | A | A | A | A | B | A | V | B | A |
| B | B | B | B | B | N | XX | X | AA | B |
| C | C | C | C | C | O | S | V | D | A |
| D | D | D | D | D | E | A | | E | |
| E | E | E | E | E | F | | | F | |
| F | F | K | F | L | G | | | G | |
| G | G | A | G | A | H | | | H | |
| H | H | | H | | I | | | J | |
| I | I | | J | | J | | | J | |
| J | J | | J | | A | | | A | |
| A | A | | A | | B&WW | | | B | |
| | | | | | VV | | | BB | |
| | | | | | B | | | B | |

| 28 DAY DTU | DTT | 30 DAY DTU | DTT | 31 DAY DTU | DTT |
|---|---|---|---|---|---|
| FF | A | FF | A | FF | A |
| C | B | C | B | C | B |
| D | LL | D | SS | D | TT |
| E | A | E | UU | E | UU |
| F | | F | A | F | A |
| G | | G | | G | |
| H | | H | | H | |
| HH | | HH | | HH | |
| J | | J | | J | |
| A | | A | | A | |
| FF | | FF | | FF | |
| C | | C | | C | |
| D | | D | | D | |
| E | | E | | E | |
| F | | F | | F | |
| G | | G | | G | |
| H | | H | | H | |
| HH | | HH | | HH | |
| J | | J | | J | |
| A | | A | | A | |
| FF | | FF | | FF | |
| C | | C | | C | |
| D | | D | | D | |
| E | | E | | E | |
| F | | F | | F | |
| G | | G | | G | |
| H | | H | | H | |
| II | | JJ | | KK | |
| FF | | J | | J | |
| | | A | | A | |
| | | FF | | GG | |
| | | | | FF | |

| 24 HOUR HRU | HRT | MODE AM/PM |
|---|---|---|
| A | A | |
| B | T | W |
| M | U | |
| P | A | |
| E | | |
| F | | |
| G | | |
| H | | |
| I | | |
| J | | |
| A | | |
| B | | |
| M | | |
| P | | |
| E | | |
| F | | |
| G | | |
| H | | |
| I | | |
| J | | |
| A | | |
| B | | |
| N | | |
| Q | | |
| A | | |

It is also possible, for example, during chronograph operation that the PLA input data, M0 – M3 may be read onto feedback data bus 84 through N-type transmission gates 146 (FIG. 11). Transmission gates 146 are controlled by the output from nor gate 148. Nor gate 148 has the output of nor gate 140 and clock pulse, $\overline{D\phi 4}$, as inputs. Therefore, nor gate 148 has a low output, and gates 146 are off, at all times except when $\overline{D\phi 4}$ is low and STORE is high.

The remaining PLA outputs are used to drive the flags K1 – K3 and their complements and, in the case of a carry, to generate the carry signal, INC, which is used in timing and control circuit 44.

Tables 2 and 3 may be read in conjunction to specify the configuration and arrangment of the PLA nand-nor array. For example, consider the watch function. As counts are stored in location "0" corresponding to the word, ÷ 10, the minterms A – J are generated in the cycle and sequence listed in Table 3. The nand gate of the PLA nand array, which outputs the minterm A, will have as its series gating devices corresponding to P-type devices 96 - 114 of FIG. 3 coupled to the RAM data word, M0 - M3, and RAM address 0000, so that the devices are conductive and minterm A is generated whenever the RAM data word is 0000 as shown in Table 2. Another series of similar P-type devices having a RAM address corresponding to the RAM location for AM/PM, i.e., 0101, will form a precharged nand gate similar to that illustrated in FIG. 3. This nand gate, not shown, acts as an inhibit gate which will have a true output during $\phi 2$. The output of the inhibit gate is coupled to an additional series P-type device which is included in each of those minterm nand gates controlled by an inhibit term shown in Table 2. During $\phi 1$ the inhibit and minterm nand gate will go false by virtue of device 94. During $\phi 2$, if the inhibit term is addressed, the inhibit gate goes true, turning its corresponding P-type device in the minterm nand gate off, leaving the minterm false. During $\overline{D}\phi 3$ the nodal capacitance of the inhibit gate keeps its output true so that the nand output remains false even if the corresponding nand gate were addressed by A0 - A3 or M0 - M3 or both. Multiple inhibit gates can be or-ed by coupling their outputs to a single P-type device in the nand gate.

Finally, the PLA nand may have a P-type device which is gated on by an internal control signal, e.g., resets seconds, RSC or the signal intialize sequence, MR, which serve to inhibit the nand gates during selected internal timing sequences as discussed below.

Consider for example the nand associated with minterm A which has an output coupled to a gate of a PLA nor gate having the PLA output D0. Minterm A is associated with the first number in any counting sequence, namely RAM data word 0000. None of the PLA nor gates having the PLA outputs, $\overline{D3}$ - $\overline{D1}$, will have minterm A controlling any of their parallel N-type gating devices 116. Therefore, as previously discussed in connection with FIG. 3, the output from the PLA nor gate corresponding to $\overline{D0}$ will be zero while the outputs from the PLA nor gates corresponding to $\overline{D3}$ - $\overline{D1}$ will remain true. The desired number, D3 - D0, is 0001 which is the next incremented binary number in the counting sequence.

The output of the PLA will be fed back through feedback data bus 84 and inverted by CMOS inverters 144 (FIG. 10B). The word, D3 - D0, will be read onto RAM data bus 80 and presented to multiplexers 78 to be rewritten into the appropriate RAM cells during $\overline{D}\phi 4$. On the next group of $\phi$ cycles, the RAM data word 0001 will then be read out of the same cell, as long as the same cell is addressed, and the PLA nand, having the RAM data word M3 - M0, corresponding to 0001 will be selected in combination with the various internal flags and inhibit terms to produce a PLA output corresponding to minterm B. The appropriate PLA nor gates will be activated to produce the binary number 0010 at data bus 80 which will be stored in the addressed cell. The sequence is repeated for each address location in RAM 72 through the minterms as illustrated in Table 3. When the minterm J is generated by the appropriate PLA nand-nor gates, a carry flag INC, will be generated and the RAM data word at bus 80 will be reset at 0000 as shown in Table 2. Referring to Table 3, the same sequence can be observed for a second unit, SECU, and minutes units, MINU.

The counting sequence for seconds ten, SECT, is identical to that of the seconds units, SECU, through minterm E. After minterm E is generated, the word 0101 will have been written into the RAM cell corresponding to the RAM address seconds tens. When the binary word, 0101, is again presented to the PLA nand, the RAM address corresponding to seconds tens will also be coupled into the PLA array through decoder 76. Thus, the PLA nand corresponding to minterm F will be inhibited by the presence of the RAM address seconds tens. The PLA nand-nor which will be activated by the RAM address seconds tens, will cause the output minterm K to be generated as shown in Table 2. The output of minterm K is accompanied by the generation of the carry flag, INC, and resetting the RAM word, D0 - D3 to 0000 as shown in Table 2. Similarly, the minutes units and tens, hours units and tens, and whether in the 12 or 24 hour mode, months units and tens, 28 day, 30 day, or 31 day, shown in tables 3 - 5 may similarly be analyzed.

K Flip FLops and Calendar Correction Circuit

The flags K1 - K3 are used to record the condition of various count states within PLA 74. The output of flip-flop 134 (FIG. 11) will be set to one whenever months tens is zero and will be reset to zero when months tens is one. Thus, K3 controls the months units. When months tens = 0, K3 = 1 so that month units go from 2 to 3, but when months tens = 1, K3 = 0 so that months units will go from 2 to 1 as months tens are reset, i.e., the months will go from 02 to 03 when K3 = 1 and from 12 to 01 when K3 = 0.

Similarly, the K1 flip-flop 134 will control the hours count. If the watch is optioned to run on a 12 hour base, K1 flip-flop will be set, K1 = 1, when hours tens goes to one and reset, K1 = 0, as hours tens is reset to zero. Thus, when K1 = 0 hours units goes from 2 to 3, but when K1 = 1, hours units will go from 2 to 1 as hours tens is reset. A watch optioned to count on a 24 hour base will cycle K1 in analogous manner.

The K2 flag is used to control date counts. The K2 flip-flop is comprised of a nor latch 131 and a nand latch 134 (FIG. 11). As date tens is incremented from 1 to 2 (minterm CC) latches 131 will be set (K2 = 1). The K2 latch is set on the date 24. Any date between 22 and 27 could have been selected to appropriately flag a 28, 30, or 31 day month and to permit months to be timeset to February while the date was held constant. The date 24 is chosen only as a matter of convenience to minimize the number of input bits in the PLA minterm. Latch 133 will not be set since its reset and set terminals are normally held true by the output of minterm DD. However, when date units go from 4 to 5, the output from minterm DD will go false and latch 133 will be set thereby resetting latch 131. If the watch is in a 28 day month, flag K2 will be reset when date units go from 8 to 1 and the date tens forced from 2 to 1. Flag K2 will be analogously reset for 30 and 31 day months, so that when date units go to one, date tens will go from 3 to 0.

Calendar correction circuit 135 generates the PLA inputs 28, 30, and 31 according to the appropriate number of days in a month as shown in FIG. 12, the inputs to circuit 135 are the PLA inputs M0 - M3 and the PLA outputs MNTHU and MNTHT. During clock $\overline{D}\phi 4$, MNTHU and MNTHT, which are true whenever the months units or months tens respectively are incremented, turn on transmission gates 137 and turn off transmission gates 139. The contents of the RAM words DOMU (M0 - M3) or DOMT (M0) are written into storage cells 141. Cells 141 store the data when DO4 goes false. Thus, storage cells 141 keep a running record of the number of the month which is current.

The stored values of M0 - M3 for DOMU and M0 for DOMT are coupled to a logic circuit which includes nand gate 143. The inputs to nand gate 143 are M0, M1, M2, and M3 for DOMU and M0 for DOMT. Since the months are coded beginning at 0 for January to 11 for December, nand gate 143 will be true at all times except when DOMU = 0001 and DOMT = 0, or during February. Therefore, the output of nand gate 143 is the PLA input 28 and its inverse is $\overline{30/31}$.

The remaining logic circuitry is a complex CMOS inverter which will go false when M3, M2, M1, M0 are in any of the states 0XX0, X11X, 1XX1 for DOMU, or XXX1 for DOMU and 1 for M0, DOMT, where X is a "don't care state". The inverter is true for all other states so that the output is $\overline{31}$. Clearly, activation of $\overline{30/31}$ without $\overline{31}$ indicates a 30 day month.

Prescale Divider Circuit

Figure 6:
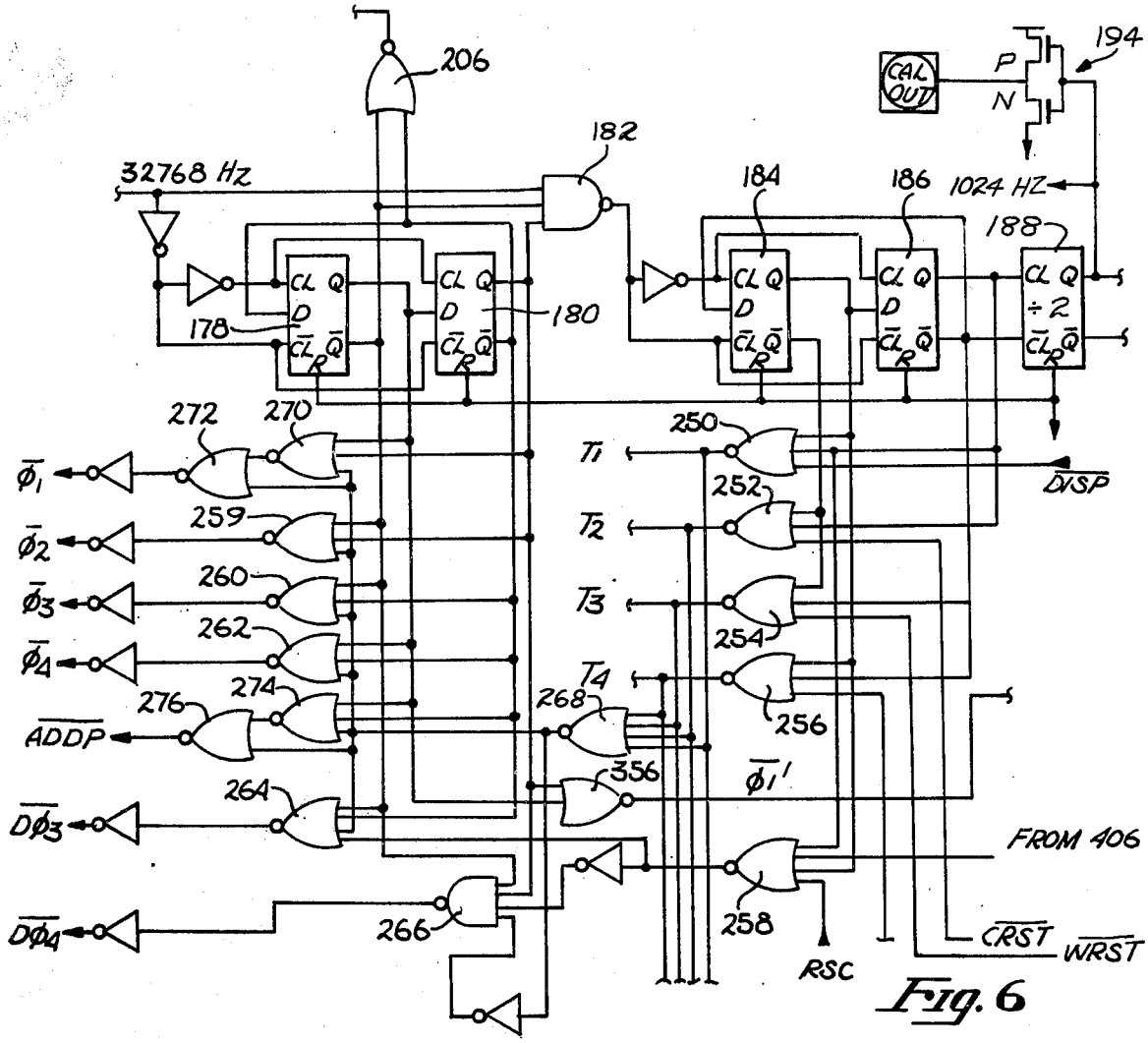
FIG. 6 is a schematic of the T and $\phi$ generator and the first five stages of the prescale divider.
Figure 7:
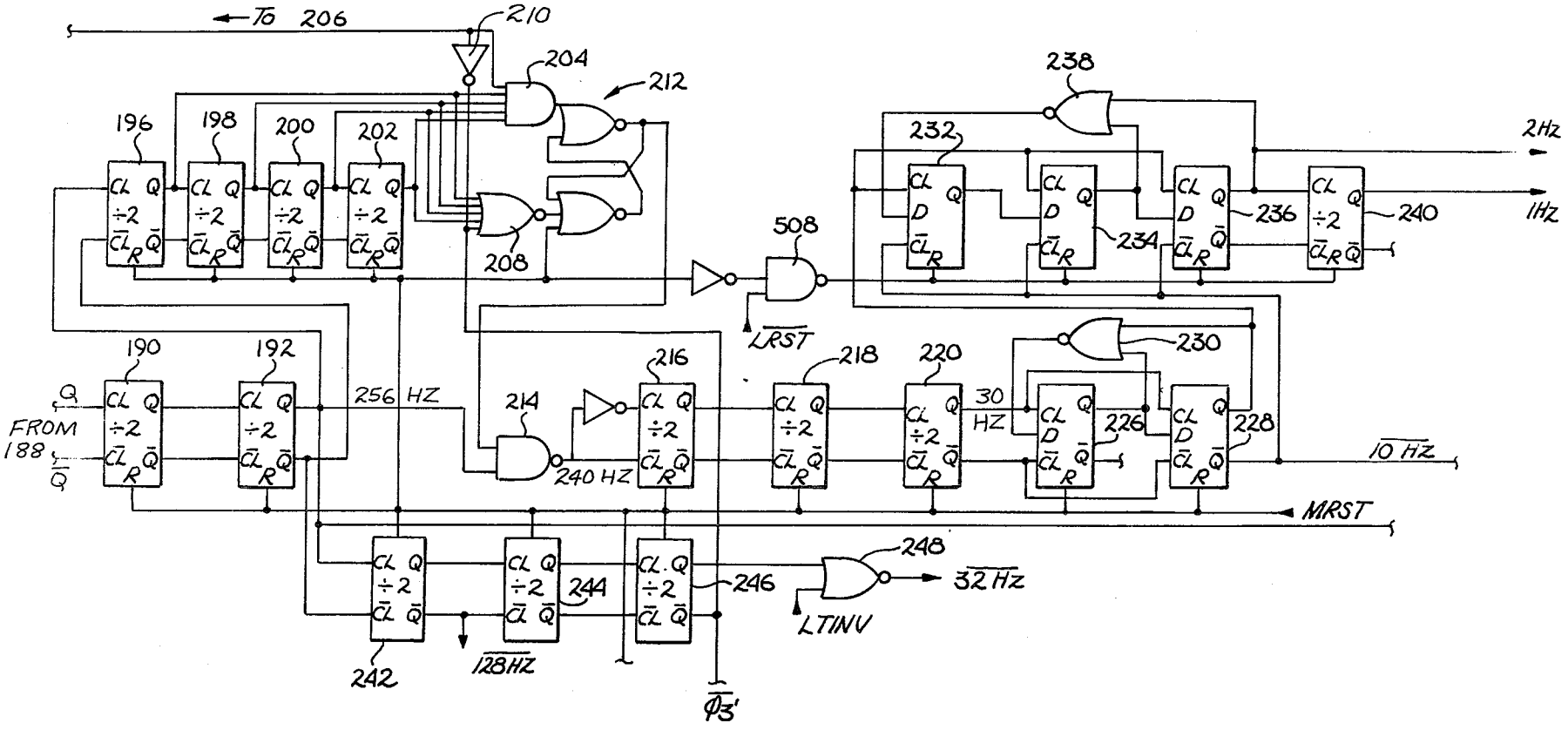
FIG. 7 is a schematic of the remaining portion of the prescale divider.

Prescale divider circuit 42 and a portion of timing and control circuit 44 is illustrated in FIGS. 6 - 7. Prescale divider circuit 42 generates a plurality of driving signals for the watch. Oscillator 40 generates the timing standard, 32768 Hz which drives prescale divider circuit 42. Four synchronous D type flip-flops, shown in FIG. 6, form the basis for a synchronous counter which drives the $\phi$ and T generators described below.

The master clock frequency 32.768 KHz simultaneously clocks the first two flip-flops 178 and 180. The Q output of flip-flop 178 is coupled to the D input of flip-flop 180. The $\overline{Q}$ of flip-flop 180 is fed back and coupled to the D input of flip-flop 178. Assuming that the initial state of the flip-flops can be represented by the binary number 00, flip-flops 178 and 180 cycle through the collective states 00, 10, 11, 01, and then 00 again with each pulse of the 32 KHz clock. The master clock pulse has gone through four complete cycles during the same time in which the outputs of flip-flops 178 and 180 have gone through one complete cycle. Therefore, the frequency at the outputs of flip-flop 178 and 180 is 8192 Hz.

Nand gate 182 has three inputs. The inputs to nand gate 182 are: the Q output of flip-flop 180; the $\overline{Q}$ output of flip-flop 178; and the master clock pulse. The output of nand gate 182 will always be true except when the Q output of flip-flop 180, the $\overline{Q}$ output of flip-flop 178 and the master clock pulse are simultaneously true. This coincidence occurs only once during four cycles of the master clock because the output of flip-flop 178 is shifted in time by one clock cycle, i.e., 30 microseconds from the output of flip-flop 180. Thus, the output of nand gate 182 will have a frequency equal to 8192 Hz and a pulse width equaled to the pulse of the master clock, i.e., approximately 15 microseconds.

D type flip-flops 184 and 186 are coupled with each other in the same manner as are flip-flops 178 and 180. Therefore, the outputs of flip-flops 186 are each one fourth of the corresponding clock frequency applied to these flip-flops, or 2048 Hz. Flip-flops 178 - 186 are synchronized so that transient false outputs may be eliminated from their outputs, which outputs are coupled to the $\phi$ and T generator described below.

Flip-flop 186 is followed by three asynchronous flip-flops 188 - 192 (FIGS. 6 and 7). Flip-flops 188 - 192 act as a three bit counter and will divide the frequency from 2048 Hz down to 256 Hz by binary steps. Thus, the output of flip-flop 188, which is coupled to CMOS gate 194 and which is used as a calibrating output, is 1024 Hz which, as will be shown, is also used as a driving signal for the debounce circuitry of FIG. 23. The output of flip-flop 190 is 512 Hz and the output of flip-flop 192 is 256 Hz (FIG. 7). As will be described below the 256 Hz output is used in the clock as an internal fast test signal for the integrated circuit chip.

A 10 Hz signal is used to initiate the time advances for the watch and stop watch which are resolved to within 0.1 seconds. The 10 Hz signal is derived from the 256 Hz signal by deleting every sixteenth pulse to produce a 240 Hz signal. The 240 Hz signal is divided again by three binary orders of magnitude to a 30 Hz signal which is finally divided by divide-by-three counter to produce the desired 10 Hz timekeeping signal.

A 256 Hz signal and its complement is taken from flip-flop 192 and provided as the clock inputs to the first of four asynchronous flip-flops 196 - 202. Thus, the output of flip-flop 196 is 128 Hz; the output of flip-flop 198 is 64 Hz; the output of flip-flop 200 is 32 Hz; and the output of flip-flop 202 is 16 Hz. The output of each of the flip-flops, 196 - 202, is provided as an input to and gate 204. And gate 204 also has as one of its inputs the output of nor gate 206. Nor gate 206 has as its inputs, the $\overline{Q}$ output of flip-flop 178 and the $\overline{Q}$ output of flip-flop 180 (FIG. 6). Thus, the output of nor gate 206 is always zero except when the $\overline{Q}$ outputs of flip-flops 178 and 180 are simultaneously false. Thus, nor gate 206 will have an output frequency of 8192 Hz and a pulse width defined by master clock 40, i.e., approximately 30 microseconds. Therefore, and gate 204 will generate groups of 64 pulses, each having a 30 microsecond width, with a 16 Hz group repetition rate. Nor gate 208 also has as its inputs the input from flip-flops 196 - 202 and the $\overline{8192}$ Hz from nor gate 206 through inverter 210. Nor gate 282 will therefore also generate groups 64 pulses, each with a 30 microsecond width with a 16 Hz group repetition rate, but displaced in time from the output of and gate 204.

The output of and gate 204 is coupled to the reset terminal of an RS nor latch 212. The output of nor gate 208 is coupled to the set terminal of latch 212. The outputs of nor gate 208 and and gate 204 are shifted in time such that there is never a coincidence between the two. The output of latch 212 is a negative 16 Hz signal with a pulse width of approximately 8 milliseconds ($\frac{1}{2}$ of a period of the 256 Hz signal).

The output of latch 212 is coupled, together with the output of flip-flop 192 to the inputs of nand gate 214. On every sixteenth cycle, the output of latch 212 will simultaneously be high with the output of flip-flop 192. Thus, the output of nand gate 214 will follow the output of flip-flop 192 on every pulse except on each sixteenth pulse, which will be deleted. Therefore, the input clock signal to asynchronous flip-flop 216 will be a signal with a frequency of 240 Hz. The 240 Hz signal will then be divided by one binary order of magnitude each by flip-flops 218 and 220. Thus, the output frequency from flip-flop 220 will be a 30 Hz signal.

Flip-flops 226 and 228 are D type flip-flops which form the basis of a divide-by-three counter. Flip-flops 226 and 228 are each clocked by the 30 Hz input signal from flip-flop 220. The Q output of flip-flop 226 is coupled to the D input of flip-flop 228. The Q output of flip-flop 228 is fed back through nor gate 230 to the D input of flip-flop 226. The other input of nor gate 230 is derived from the Q output of flip-flop 226. Therefore, the states of flip-flops 226 and 228 may be characterized by the binary numbers 00, 01, 10, and then again 00 on each clock pulse. Thus, the output of flip-flop 228 is a 10 Hz signal.

The Q output of flip-flop 228 is coupled to the clock terminals of flip-flops 232 - 236. Flip-flops 232 - 236 are D type flip-flops which form the basis of a divide-by-five counter to produce a 2 Hz output signal which is used as an option for timeset frequency and as frequency of digit flashing in the timeset mode. Flip-flops 232 - 236 are combined in substantially the same manner with respect to their D and Q terminals as the D type flip-flop counters previously described. The Q output of flip-flop 236 and the Q output of flip-flop 234 are coupled to the inputs of a nor gate 238. The output of nor gate 238 is coupled to the D input of flip-flop 232. Therefore, flip-flops 232 - 236 are sequenced through a five count pattern and the output of flip-flop 236 is one fifth the clock frequency, i.e., 2 Hz. The output of flip-flop 236 is in turn coupled to the clock inputs asynchronous flip-flop 240 which divides the 2 Hz frequency to a 1 Hz frequency. The 1 Hz signal is used for driving the colon in normal displays and is the frequency counted by the delay logic when generating a ten second delay, and as an option for timeset frequency and as frequency of digit flashing in timeset mode.

The output of flip-flop 192 is also coupled to three series asynchronous flip-flops 242 - 246. The output of flip-flop 246 is thus a 32 Hz signal which is coupled to the input of nor gate 248. Nor gate 248 has as its other input an internal control signal, LTINV, which is the lamp test initiate voltage. Whenever the signal, LTINV, is low, the 32 Hz signal is gated to the liquid crystal display (LCD) circuitry as will be described. Otherwise, the 32 Hz signal to the display is inhibited. It is necessary to strobe the LCD with a low frequency voltage in order to maintain stability and longevity of initial threshold values of the display.

T and $\phi$ Generators

The 10 Hz signal from the $\overline{Q}$ output of flip-flop 228 is coupled to control circuitry for the T and $\phi$ generators as shown in FIG. 6. Consider the generation of each signal, T1 - T4. The timing signal T1 is the output of nor gate 250. Nor gate 250 has as its inputs the Q output of flip-flop 184, the Q output of flip-flop 186 and internal control signal select display, $\overline{\text{DISP}}$, which can be used to inhibit the output from nor gate 250 but is not used in the present embodiment. The frequency of clock signal T1 has a frequency of 2048 Hz and, therefore, has a pulse width of approximately ½ millisecond. Clock interval T1 is principally used to multiplex data from RAM 72 to segment decoder 90 in order to keep the display data current.

The generation of clock signal T2 - T4, $\overline{D}\phi 3$ and $\overline{D}\phi 4$ involves four master-slave latch circuits. Each masterslave generates an inhibit signal to each one of the T2 - T4 generators, e.g., namely, WRST for clock T2, CRST for clock T3. The operation of the master-slave control circuits will be described below with respect to FIG. 8. Nor gates 250 - 258 generate the T1 - T4 clocks and initiate $\overline{D}\phi 3$ and $\overline{D}\phi 4$. Each nor gate is coupled to the outputs of flip-flops 184 and 186 and to an inhibit signal. For the purposes of description only assume that each inhibit signal is false so that the nor gates are controlled only by flip-flops 184 and 186. As previously described, the counting states of flip-flops 184 and 186 can be characterized as 00, 10, 11, 01, and then 00 again.

Nor gate 252 has its inputs coupled to the $\overline{Q}$ output of flip-flop 184 and the Q output of flip-flop 186. Thus, T2 is driven at a frequency of 2048 Hz. However, T2 is true only when the Q output of flip-flop 184 is true and the Q output of the flip-flop 186 is false, i.e., at 10. Therefore, clock signal T2 is generated in the pulse of the 8192 Hz clock immediately following the generation of timing signal T1 (i.e., at 00).

Similarly, nor gate 254 and 256 generate timing signals T3 and T4 respectively. The inputs to nor gate 254 are the Q output of flip-flop 184 and the Q output of flip-flop 186. Thus, clock signal T3 is only generated when the Q outputs of flip-flops 184 and 186 are simultaneously high, which is the clock pulse of the 8192 Hz clock following the generation of the timing signal T2 (i.e., 11).

Nor gate 256 has its inputs coupled to the Q output of flip-flop 184 and the $\overline{Q}$ output of flip-flop 186. Thus, nor gate 256 only has an output when the Q output of flip-flop 184 is false and the Q output of flip-flop 186 is true (i.e., 01). Thus, signal T4 is generated during the clock pulse of the 8192 Hz clock immediately following the generation of clock pulse T3 and immediately proceeding the generation of clock pulse T1.

Nor gate 258 is similarly coupled to the Q output of flip-flop 186 and 184, and to the internal control signal reset seconds, RSC. Normally, RSC is false so that nor gate 258 will have a false output during T2 - T4 or RSC. As shown below nor gate 258 is used in the generation of $\overline{D}\phi 3$, $\overline{D}\phi 4$.

The $\phi$ generator is similarly driven by flip-flops 178 and 180. The clock pulses $\phi 2$, $\phi 3$, $\phi 4$, and $D\phi 3$ are generated by nor gates 259, 260, 262, and 264 respectively. Nand gate 266 generates $D\phi 4$. Consider the clock pulse $\phi 2$ for example. Nor gate 259 has an input coupled to the Q output of flip-flop 178 and an input coupled to the Q output of flip-flop 180. A third input of nor gate 258 is coupled to nor gate 268 which has each of the clocks T1 - T4 as its inputs. Therefore, each of the $\phi$ clocks will be inhibited whenever all of the T clocks are inhibited. All of the $\phi$ clocks will be active when any T clock is active. In the same manner as previously described in regard to the T generator, the various inputs to the nor gates of the $\phi$ generator are shared among the possible combinations of the Q and Q outputs of flip-flops 178 and 180 such that three consecutive 30 microseconds pulses are generated in the order, $\phi 2$, $\phi 3$, and $\phi 4$.

Nor gate 270 has one input coupled to nor gate 268, one input coupled to the Q output of flip-flop 178 and one input coupled to the Q output of flip-flop 180. The output of nor gate 270 is substantially similar to the nor gates 259 - 262 in its operation and generates a 30 microsecond pulse which forms the first of a series of four identical pulses. The output of nor gate 270 is coupled to the input of nor gate 272, which also has as one of its inputs the output of nor gate 268. Thus, the output of nor gate 272 will be true whenever the T generator is inhibited. The $\phi 1$ clock may thus remain a precharging clock which is activated during the quiescent phase of the circuit operation.

Figure 13:
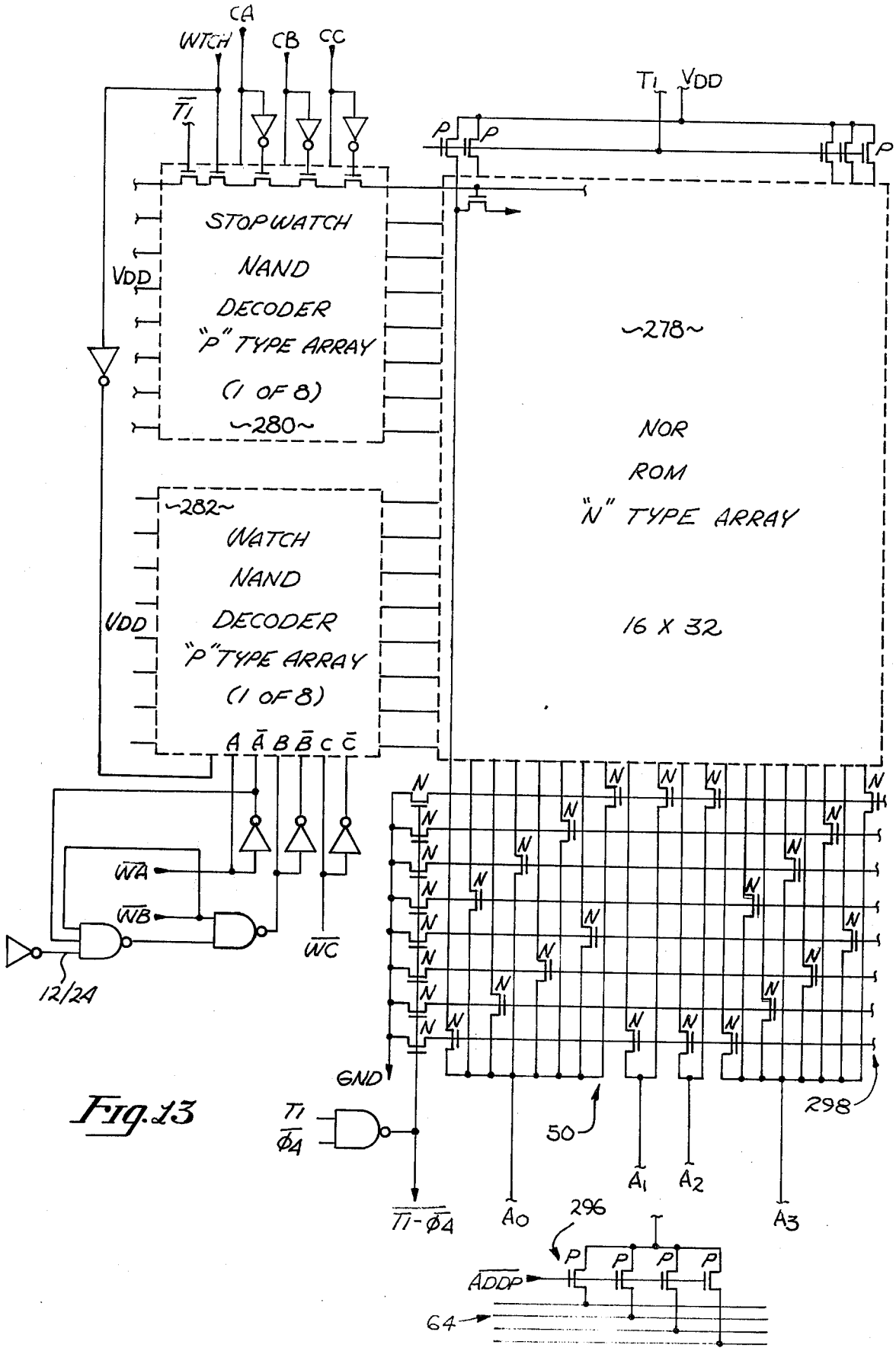
FIG. 13 is a simplified schematic of the display ROM, nand decoder and output multiplexer.

Nor gate 274 has the same inputs as nor gate 262. However, the output of nor gate 274 is coupled to nor gate 276 which serves the same function as nor gate 272 in the $\phi 1$ clock. The output of nor gate 276 is the address bus precharge signal, ADDP which is true during Tϕ4. As shown below, address bus 64 will have a precharge whenever ADDP = 0 (FIG. 13). The output of nor gate 258 serves as an additional inhibit input to nor gate 264. The other inputs to nor gate 264 are identical with nor gate 260 which generates the clock signal ϕ3. Therefore, $\overline{D}\phi 3$ is an identical clock signal to ϕ3 except, as will be shown, $\overline{D}\phi 3$ will be inhibited during a display only sequence. Nand gate 266 generates the output, $\overline{D}\phi 4$ and has inputs coupled to $\overline{Q}$ output of flip-flop 178, the Q output of flip-flop 180, the output of nor gate 258 and the inverted output of nor gate 268. Therefore, $\overline{D}\phi 4$ will always be false except during any Tϕ4 when it goes true, unless inhibited by nor gate 258. As will be shown, $\overline{D}\phi 4$ is also inhibited during a display only sequence.

RAM ADDRESS GENERATOR

Each of the four T clocks, T1 – T4, is accompanied by the four ϕ clocks, ϕ1 – ϕ4, nested within each T clock. As will be shown the T and $\overline{D}\phi$ clocks can be selectively inhibited. However, when active the clocks are used to drive the RAM address generator. The use of the ϕ clocks has previously been discussed in relation to RAM 72 and FIGS. 10A and 10B and 11. RAM address generator 46 has five primary purposes: (1) accessing the watch or chronograph for display: (2) accessing the watch for timeset displays; (3) accessing the watch for time increments; (4) accessing the chronograph for time increments; and (5) accessing available spare RAM words for time delays. These five functions are achieved in four time intervals defined by the T generator of timing in control circuit 44. Normally, the T generator is inhibited, as is the ϕ generator, and pulses are only generated when a specific action is required by timing and control circuit 44.

Figure 4:
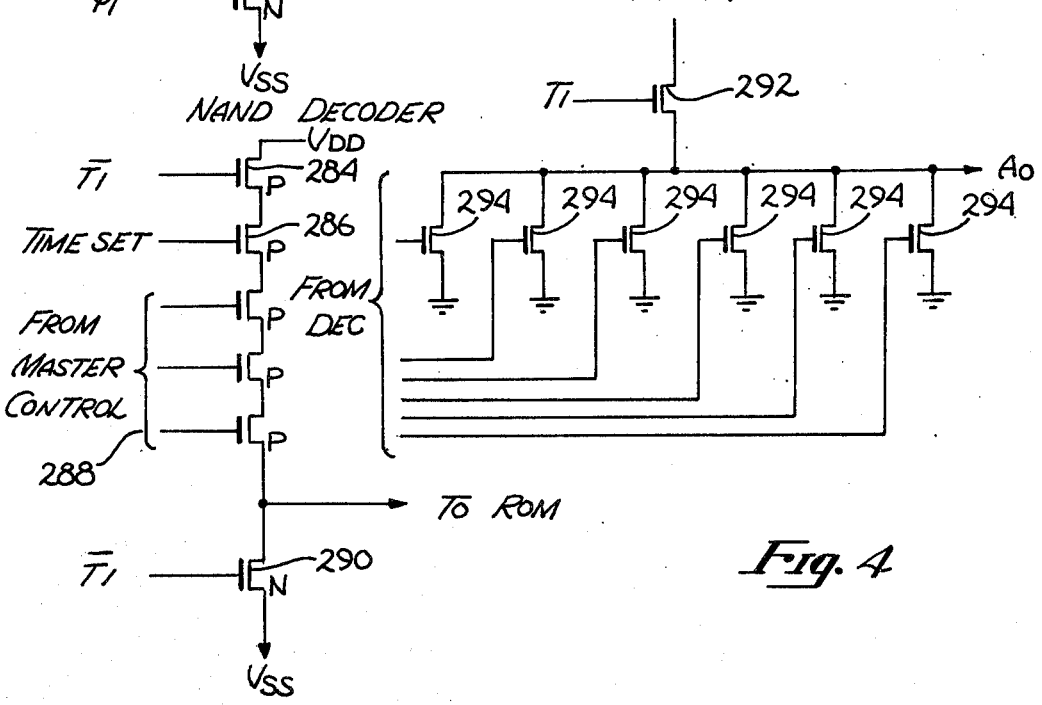
FIG. 4 is a schematic of a typical nand gate in the segment display decoder, and a nor gate in the segment display ROM.

During the first T clock, T1, RAM address generator 46 generates addresses used for accessing the watch or chronograph for normal display, or accessing the watch for timeset displays. The RAM addresses for each of the words to be displayed is stored in a read only memory 278 (hereinafter ROM) as illustrated in FIG. 13. In the presently preferred embodiment ROM 278 has the capacity to permit eight normal and eight timeset displays of eight digits each. In the actual display sequences described herein, only six digits are displayed. As was the case for PLA 74, ROM 278 is a nor type array of N-type, dynamic circuits combined with a nand array of P-type dynamic circuits which comprises decoders 280 and 282, which in turn comprise decoder 48 of FIG. 1. FIG. 4 illustrates a typical decoder nand and ROM nor. The decoder nand is a series of P type devices including: a precharge device 284; and timeset device 286, which will be the internal control signal WTCH or $\overline{WTCH}$ indicating whether the circuit is in watch or chronograph mode; and at least three inputs from timing and control circuit 44 which are collectively denoted by the reference character 288. The output of the decoder nand is also coupled to device 290 which is an n-type gate coupled to ground and controlled by clock T1. Similarly, the ROM nor has a precharged P-type device 292 coupled to the address output and controlled by clock T1. The ROM nor is a typical nor gate decoder having a plurality of n-type devices coupled in parallel between the output and ground, collectively denoted by the reference character 294. Each of the gates of n-type devices 294 are coupled to preselected decoder nands according to a selected coding scheme illustrated in Table 9.

TABLE 4

| | | | | DISPLAY SEQUENCE ROM | | | | | | | | | | | | | | | | | | | |
|---|---|---|---|---|---|---|---|---|---|---|---|---|---|---|---|---|---|---|---|---|---|---|---|
| | | | | DG1 | | | | DG2 | | | | DG3 | | | | DG4 | | | | DG5 | | | |
| WTCH | WA | WB | WC | A3 | AR | A1 | A0 | A3 | A2 | A1 | A0 | A3 | A2 | A1 | A0 | A3 | AR | A1 | A0 | A3 | AR | A1 | A0 |
| 1 | 0 | 0 | 0 | 0 | 0 | 0 | 1 | 0 | 0 | 1 | 0 | 0 | 0 | 1 | 1 | 0 | 1 | 0 | 0 | 0 | 1 | 0 | 1 |
| 1 | 0 | 1 | 0 | 1 | 0 | 0 | 0 | 1 | 0 | 0 | 1 | 0 | 0 | 1 | 1 | 0 | 1 | 0 | 0 | 0 | 1 | 0 | 1 |
| 1 | 1 | 0 | 0 | 0 | 1 | 1 | 1 | X | X | X | X | 0 | 0 | 1 | 1 | 0 | 1 | 0 | 0 | 0 | 1 | 0 | 1 |
| 1 | 1 | 1 | 0 | 1 | 1 | 0 | 0 | 1 | 1 | 0 | 0 | 0 | 0 | 1 | 1 | 0 | 1 | 0 | 0 | 0 | 1 | 0 | 1 |
| 1 | 1 | 1 | 1 | 0 | 0 | 0 | 1 | 0 | 0 | 1 | 0 | 0 | 0 | 1 | 1 | 0 | 1 | 0 | 0 | 0 | 1 | 0 | 1 |
| 1 | 0 | 1 | 1 | 1 | 0 | 0 | 0 | 1 | 0 | 0 | 1 | 1 | 0 | 1 | 0 | 1 | 0 | 1 | 1 | X | X | X | X |
| 1 | 0 | 0 | 1 | 1 | 0 | 0 | 0 | 1 | 0 | 0 | 1 | 1 | 0 | 1 | 0 | 1 | 0 | 1 | 1 | X | X | X | X |
| | CA | CB | CC | | | | | | | | | | | | | | | | | | | | |
| 0 | 1 | 0 | 0 | 1 | 0 | 0 | 1 | X | X | X | X | 0 | 0 | 0 | 1 | 0 | 0 | 1 | 0 | 0 | 0 | 1 | 1 |
| 0 | 1 | 1 | 0 | 1 | 0 | 1 | 0 | X | X | X | X | 0 | 0 | 0 | 1 | 0 | 0 | 1 | 0 | 0 | 0 | 1 | 1 |
| 0 | 0 | 1 | 0 | 1 | 0 | 1 | 1 | X | X | X | X | 0 | 0 | 0 | 1 | 0 | 0 | 1 | 0 | 0 | 0 | 1 | 1 |
| 0 | 0 | 0 | 0 | 1 | 0 | 0 | 0 | X | X | X | X | 0 | 0 | 0 | 1 | 0 | 0 | 1 | 0 | 0 | 0 | 1 | 1 |
| 0 | 1 | 0 | 1 | 0 | 0 | 0 | 0 | X | X | X | X | 0 | 0 | 0 | 1 | 0 | 0 | 1 | 0 | 0 | 0 | 1 | 1 |
| 0 | 1 | 1 | 1 | 0 | 0 | 0 | 0 | X | X | X | X | 0 | 0 | 0 | 1 | 0 | 0 | 1 | 0 | 0 | 0 | 1 | 1 |
| 0 | 0 | 1 | 1 | 0 | 0 | 0 | 0 | X | X | X | X | 0 | 0 | 0 | 1 | 0 | 0 | 1 | 0 | 0 | 0 | 1 | 1 |
| 0 | 0 | 0 | 1 | 0 | 0 | 0 | 0 | X | X | X | X | 0 | 0 | 0 | 1 | 0 | 0 | 1 | 0 | 0 | 0 | 1 | 1 |

| | | | | DG6 | | | | DG7 | | | | DG8 | | | | |
|---|---|---|---|---|---|---|---|---|---|---|---|---|---|---|---|---|
| WTCH | WA | WB | WC | A3 | A2 | A1 | A0 | A3 | A2 | A1 | A0 | A3 | A2 | A1 | A0 | DISPLAY |
| 1 | 0 | 0 | 0 | 0 | 1 | 1 | 0 | 1 | 1 | X | X | | | | | HR: MIN SEC |
| | | | | | | | | X | X | | | | | | | |
| 1 | 0 | 1 | 0 | 0 | 1 | 1 | 0 | X | X | X | X | | | | | HR: MIN DT |
| 1 | 1 | 0 | 0 | 0 | 1 | 1 | 0 | 0 | 1 | 1 | 1 | | | | | HR: MIN A/P |
| 1 | 1 | 1 | 0 | 0 | 1 | 1 | 0 | X | X | X | X | | | | | HR: MIN SEC |
| 1 | 1 | 1 | 1 | 0 | 1 | 1 | 0 | 0 | 0 | 0 | 0 | | | | | HR: MIN SEC |
| 1 | 0 | 1 | 1 | X | X | X | X | X | X | X | X | | | | | MN DT |
| 1 | 0 | 0 | 1 | X | X | X | X | X | X | X | X | | | | | MN DT |
| | CA | CB | CC | | | | | | | | | | | | | |
| 0 | 1 | 0 | 0 | 0 | 1 | 0 | 0 | X | X | X | X | | | | | MIN: SEC F |
| 0 | 1 | 1 | 0 | 0 | 1 | 0 | 0 | X | X | X | X | | | | | MIN: SEC L |
| 0 | 0 | 1 | 0 | 0 | 1 | 0 | 0 | X | X | X | X | | | | | MIN: SEC P |
| 0 | 0 | 0 | 0 | 0 | 1 | 0 | 0 | X | X | X | X | | | | | MIN: SEC C |
| 0 | 1 | 0 | 1 | 0 | 1 | 0 | 0 | X | X | X | X | | | | | MIN: SEC . 1/10 |
| 0 | 1 | 1 | 1 | 0 | 1 | 0 | 0 | X | X | X | X | | | | | MIN: SEC . 1/10 |
| 0 | 0 | 1 | 1 | 0 | 1 | 0 | 0 | X | X | X | X | | | | | MIN: SEC . 1/10 |
| 0 | 0 | 0 | 1 | 0 | 1 | 0 | 0 | X | X | X | X | | | | | MIN: SEC . 1/10 |

X = DON'T CARE

Address data bus 64, decoders 280, and 282, and ROM 278 are precharged at all times other than during T1ϕ1 - T1ϕ3. Address data bus 64 is precharged by a series of P-type precharging devices 296 which are controlled by address precharge signal $\overline{ADDP}$. Device 290 maintains the decoder nand in a low precharged state, while precharge P-type device 292 maintains the ROM nor in a high precharged state during all times other than T1. As a result, all nodes in ROM 278, decoders 280, 282, and address bus 64 are clamped when not being accessed. As will be shown below, input signals to nand decoders 280 and 282 are generated prior to clock interval T1 by timing and control circuit 44. The inputs to nand decoder 280 are active during chronograph operation and include: the internal signal, watch, WTCH; chronograph control lines, CA, CB, CD; watch control lines, WA, AB, WC; and the 12 or 24 hour option, 12/24.

Figure 14:
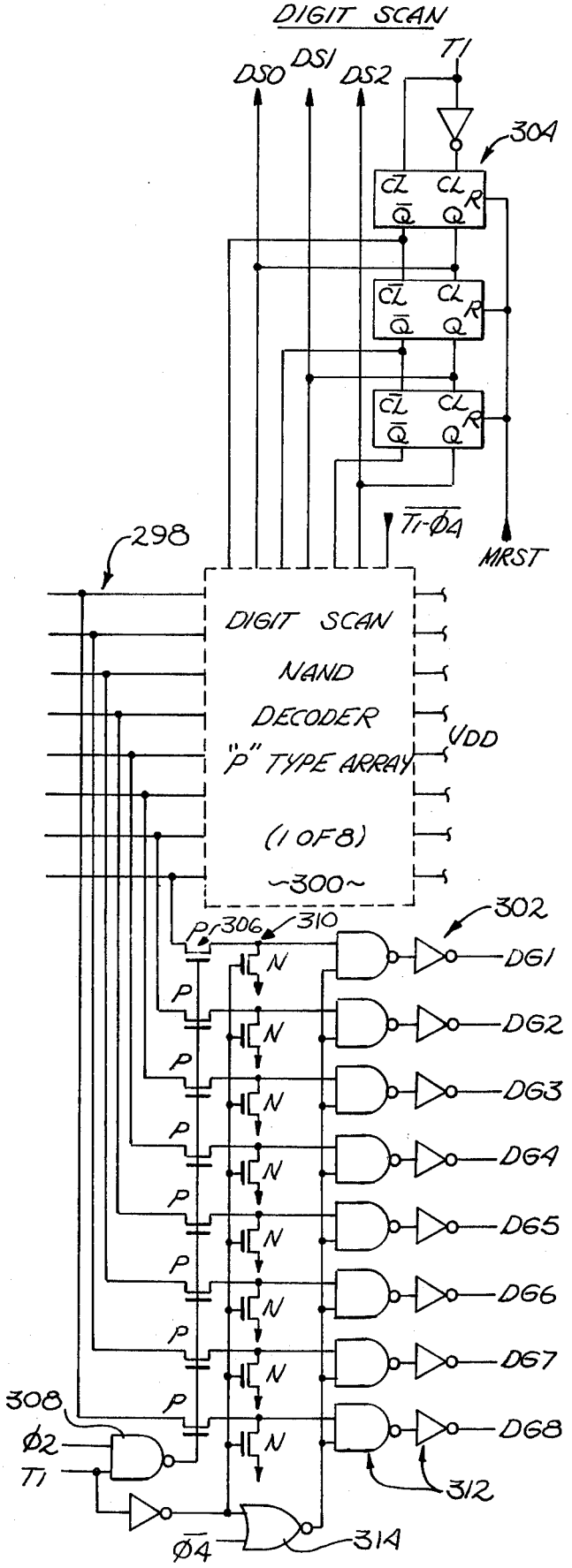
FIG. 14 is a simplified schematic of the digit scan counter, decoder, and segment decoder.

Referring again to FIGS. 5A and 5B, at the beginning of clock signal T1 the address bus, ROM and decoder precharge is removed and ROM 278 is accessed. Nand decoders 280 and 282 each have eight outputs coupled to ROM 278 which is a 16 by 32 nor gate array. Thus, when ROM 278 is accessed, a 32 bit word is presented to the inputs of multiplexer 50. The 32 bit word is grouped into four groups of eight. Each of the eight lines is coupled through an n-type transmission gate to a single output terminal corresponding to that group of eight. Thus, each group of eight has eight control lines corresponding to the eight control gates. The eight control lines are coupled to a corresponding transmission gate in each of the four groups of eight outputs from ROM 278. Control lines 298 are coupled to a P-type nand decoder 300 (FIG. 14). Nand decoder 300 is driven by six lines from digit scan 52 whose operation will be described in greater detail below.

As each of the control lines 298 is activated, a new address will be gated through multiplexer 50 onto address bus 64, A0–A4. Thus, during one access of ROM 278 any one of eight addresses may be selected by digit scan 52, thereby addressing any of the eight digits during successive T1 periods. The order of the display digit is identified by digit select circuit 302 which generates digit select signals, DG1 - DG8 (FIG. 14). The digit select signals are coupled from digit scan 52 to display drivers 56 as illustrated in FIG. 1.

Digits scan counter 52 is a three bit asynchronous counter comprised of three bistable elements generally denoted by the reference character 304. Each of the two outputs of bistable elements 304 also provide an internal control signal, digits scan counter output, DS0 - DS2. Each of bistable elements 304 is reset by the internal control signal, master reset, MRST.

Digit select circuit 302 is coupled to the outputs of decoder 300 through a P-type transmission gates, collectively denoted by the reference character 306. Transmission gates 306 are driven by nand gate 308 which in turn has the clock inputs, ϕ2 and T1. Thus, transmission gates 306 are nonconductive during all times, except clock interval T1ϕ2. The output of each of transmission gate 306 is grounded through a corresponding plurality of n-type gates collectively denoted by reference character 310. Gates 310 are driven by clock pulse $\overline{T1}$ so that each input of digit select circuit 302 is fixed to ground at $\overline{T1}$. Therefore, digit select circuit 302 is disenabled at all times other than clock pulse T1. Each input line in digit select circuit 302 is coupled to a series combination of a nand gate and inverter, collectively denoted by the reference character 312. Each nand gate has one input coupled to the corresponding output from transmission gates 310 and one input coupled to nor gate 314. Nor gate 314 has $\overline{T1}$ and $\overline{\phi 4}$ as its inputs. Therefore, the output of nor gate 314 is false at all times, except during the clock interval, T1ϕ4, at which time the nor gate output goes true. Thus, nand-inverter combinations 312 serve as transmission gates which read the dynamically stored output from transmission gates 306, stored during clock interval T1ϕ2, and coupled to digit select bus, DG1 - DG8 during clock interval T1ϕ4.

As will be shown, during a display cycle, the RAM data is read and the normal increment operation is suppressed. The RAM data word is coupled by means of decoder 90 and segment FONT ROM 92 to display drivers 56, described in greater detail in connection with FIGS. 27 - 30. Since incrementation must normally be suppressed during display periods, timeset for the watch is also achieved during clock period T1. During timeset, the RAM addresses are generated by ROM 278 as previously described. However, the information which is displayed is the RAM data which will be timeset. The timeset rate may arbitrarily be selected as 1 or 2 Hz as controlled and generated by timing and control circuit 44.

Clock period T2 permits generation of RAM addresses for accessing the watch for time increments, the normal operational phase of the watch. Clock period T3 permits the generation of addresses for accessing the chronograph for time increments. The operation in each case is essentially the same. Watch sequence counter 58 generates the RAM address of the data to be (FIG. 1) incremented. Similarly, a chronograph sequence counter 60 generates the RAM address of chronograph data to be incremented. Initially both counters are reset to the address of the lowest order location in the watch or chronograph portion of RAM 72. In the presently preferred embodiment, the counters are set to the divide-by-ten location of the watch, and to the 1/10th second location of the chronograph. As will be described below, when prescale divider 42 generates a 10 Hz pulse, clock T2 or T3 is appropriately generated as controlled by timing and control circuit 44 and the lowest order RAM word incremented by one. As previously discussed, a carry signal, INC, may be generated according to the code contained within PLA 74. When the carry signal, INC, is generated, watch or chronograph sequence counters 58 and 60 are also incremented to address the next higher order RAM location, i.e., seconds units in the watch or chronograph portion of RAM 72.

The next T2 or T3 will then allow the second units in the RAM to be addressed and incremented as previously described. The incrementation of the seconds units would continue as long as a carry signal, INC, is generated. However, if no carry signal, INC, is generated, each counter 58 or 60, is reset by activation of watch sequence counter reset, $\overline{WRST}$, or chronograph sequence counter reset, $\overline{CRST}$, to the lowest order location, i.e., divide-by-ten or 1/10th seconds in the watch and chronograph respectively. At the next 10 Hz pulse generated by prescale divider 42, the word of the lower order location within RAM 72 is incremented as previously described. The process is repeated for each of the words in the RAM with the carry signal, INC, stepping the address generator of watch sequence counter 58 from lowest order location through seconds, minutes, hours, AM and PM, day of the week, and month. Similarly, chronograph sequence counter 60 steps through the corresponding seconds, and minutes locations of the chronograph.

Watch sequence counter 58 may be comprised of four bistable elements, collectively denoted by reference character 322, coupled to form an asynchronous four bit counter. The Q output of each counter (FIG. 15) is gated to one of the address lines of address bus 64 through an n-type transmission gate collectively denoted by the reference character 316. Transmission gates 316 are controlled by nor gate 318. Nor gate 318 has its inputs coupled to $\overline{T2}$ and $\phi 4$. Thus, addresses are clocked out of watch sequence counter 58 during clock period T2$\phi$1 – T2$\phi$3. Similarly, the true outputs of each bistable element is coupled to nand gate 320 which generates the internal timing signal, watch sequence counter limit, $\overline{WCH}$.

Chronograph sequence counter 60 is similarly comprised of three bistable elements, collectively denoted by reference character 324 and driven by clock pulse $\overline{T3}$. The output of bistable elements 324 are gated through n-type transmission gates collectively denoted by the reference character 326. Transmission gates 326 are controlled by nor gate 328. Nor gate 328 has as its input, $\overline{T3}$ and $\phi 4$ so that the output of chronograph sequence counter 60 is coupled to address bus 64 only during the clock pulses T3$\phi$1 – T3$\phi$3. Chronograph sequence counter 60 has a nand gate 330 coupled to the output of the lowest and highest order bistable elements 324. The output of nand gate 330 is an internal timing signal, chronograph sequence counter limit, $\overline{SCH}$. The signal, $\overline{SCH}$, will be true at all times except when the lowest and highest order of bistable elements 324 both have true outputs. As soon as bistable elements 324 reach the binary number 101, flag signal $\overline{SCH}$ will go false. In the present preferred embodiment flag signal $\overline{WCH}$, and flag signal $\overline{SCH}$, signify the end of the watch and chronograph sequence.

During the clock interval T4, RAM address generator 46 accesses available spare RAM words for timed delays. Variable masks are used to permit spare RAM word addresses to be set as time dalay locations (see Table 1). Use of time delay words will be described in greater detail in relation to FIG. 2. Power supply Vdd is selectively coupled to address bus 64 through a series of P-type transmission gates, collectively denoted by reference character 332. Transmission gates 332 are in turn controlled by the output from inverted nor gate 334 which has as its inputs, clock signal $\overline{T4}$ and $\phi 4$. Thus, Vdd is coupled to address bus 64 only during T4$\phi$1 – T4$\phi$3. During this time the RAM address, 1111, is generated.

MASTER-SLAVE LATCHES AND TIMING REQUEST CIRCUITS

Clearly, the T and $\phi$ generators cannot be allowed to be free running, but must be activated in response to internal control signals at a timed rate. For example, a request for activation of the T2 generator every 0.1 second is the basis of timekeeping in the watch.

The master-slave latch circuit 336 (FIG. 8) is comprised of a master RS nor latch 342 having gated inputs from and gates 344 and 346. Similarly, slave latch 348 is a RS nor latch having gated inputs from and gates 350 and 352. The internal control signal, watch sequence counter reset, $\overline{WRST}$, is generated by the $\overline{Q}$ output of slave latch 348. In the normal condition, $\overline{WRST}$ is true thereby holding watch sequence counter 58 in the reset state and inhibiting the generation of clock signal T2 by virtue of being coupled to nor gate 252 (FIG. 6).

The 10 Hz signal is gated through a CMOS transmission gate 364 which is normally conductive. The initiation of an internal control signal, fast test watch, FTW, will turn CMOS transmission gate 364 off, and CMOS transmission gate 366 on, thereby substituting the 128 Hz signal for the 10 Hz signal to permit fast testing of the watch.

Normally, the 10 Hz signal is coupled to the reset terminal of a RS nor latch 368. The set terminal of RS latch 368 is coupled to timing signal T2. Therefore, the normal output of latch 368 is false. The output of latch 368 is coupled to the input of or gate 370. Additional inputs to or gate 370 are coupled to the 8192 Hz clock, $\overline{\phi 3}'$, synchronized to clock $\overline{\phi 3}$, and the 10 Hz clock. Normally, the output of or gate 370 is a 10 Hz signal superimposed over the 8192 Hz clock $\overline{\phi 3}'$. The output of or gate 370 is coupled to nand gate 372 which also has one of its inputs coupled to an internal control signal, initialized sequence, $\overline{MR}$. $\overline{MR}$ is normally true and as will be shown is used as an inhibit signal for the T2 requests. $\overline{MR}$ is used to reset the entire counting sequence to 12 midnight, January 1. The output of nand gate 372 will be groups of 8192 Hz signals with a group repetition rate of 10 Hz.

The 10 Hz signal will be synchronized by means of or gate 370 to the 8192 Hz clock, $\overline{\phi 3}'$. When the 10 Hz signal undergoes a negative transition, the T2 request signal, T2R, will become true at a time determined by the 8192 Hz clock, $\overline{\phi 3}'$. Each of the reset inputs to latch 342 are normally false. Nor gate 354 has two true inputs, except during T2$\phi$3, and, therefore, a false output. Thus, regardless of the state of carry signal, INC, and gate 344 will have a false output. The other reset input to latch 336 will also normally be false since the master reset signal, MRST, is normally false. Similarly, the output of and gate 346 will remain false. The set inputs to master latch 342 will be false and the latch will normally have false output, Qm. The slave latch 348 will synchronously couple the output of latch 342 at the time determined by clock $\overline{\phi 1}'$. Clock $\overline{\phi 1}'$ is generated by nor gate 356 (FIG. 6).

When T2 request signal, T2R, goes true, latch 342 changes state and is set. Qm goes true. At the clock signal, $\overline{\phi 1}'$ and gate 350 will have a true output and and gate 352 will have a false output. Thus, latch 348 will be set at Qs = 1. This will, therefore, initiate a T2 clock pulse since the inhibit signal, $\overline{WRST}$, which was true, now goes false. T2 is thus enabled within ½ millisecond.

T2 is fed back to latch 368 and will set the latch. As previously discussed, T2 will also initiate an increment in RAM 72. The output of or gate 370 will remain true, thereby fixing T2 request, T2R, in the false state (10 Hz signal is still true). However, master latch 342 will remain in the set position, Q = 1, even though T2R is false.

During the interval, T2$\phi$3, nor gate 354 will generate a true output. During the time interval, T2$\phi$3, PLA output carry signal, INC, is valid. If the carry signal, INC, is true, then a carry was produced by the incremented RAM word. If $\overline{INC}$, is true, then no carry was produced. If no carry was produced both inputs to and gate 344 will go high during T2$\phi$3. Similarly, the output of and gate 326 will go low during T2$\phi$3. Master latch 342 will then be reset with Qm = 0. On the next positive going $\overline{\phi 1}'$ pulse slave latch 348 will be reset to Qs = 0. Thus, the inhibit signal, watch reset, $\overline{WRST}$, will be generated and the T2 generator inhibited until the next T2 request signal, T2R. However, slave latch 348 is not reset until the following, $\overline{\phi 1}'$ pulse after master latch 342 is set. This delay is accomplished by means of and gates 350 and 352. The delay insures that the pulse T2$\phi$4 is generated as normal during this T2 period.

If, however, the carry signal $\overline{INC}$ was false during the interval T2$\phi$3, the output of and gate 344 will be false while the output of and gate 346 will be true. Thus, master latch 342 will remain set at Qm = 1. Similarly, slave latch 348 will also remain set at the next $\overline{\phi 1}'$ pulse Qs = 1. As a result, the T2 generator will remain enabled. T2 will be fed back and again will disenable the output of nand gate 372, setting T2R = 0. The watch sequence counter reset, $\overline{WRST}$, remains reset at zero and allows watch sequence counter 58 to increment the RAM address causing the new RAM word to be incremented by PLA 74. Slave latch 348 remains set and T2 remains enabled as long as PLA 74 continues to generate carry signals, INC. If the increment of the new RAM word does not create a new carry, watch sequence counter 58 and master-slave latch 336 are reset at the next T2 request for signal T2R.

A similar master-slave combination is used for chronograph control and the T3 generator, which employs inhibit signal chronograph sequence counter, reset, $\overline{CRST}$. A 10 Hz latch 358, or gate 360 and nand gate 362 are also combined with master-slave latch 364 to control the timing of the T3 generator. The gated inputs to master-slave latch 364 are also coupled to internal carry signal, $\overline{INC}$, and to nor gate 366 which has a true output during T3$\phi$3. The 10 Hz and 256 Hz signals are selectively coupled to latch 358 through a CMOS transmission gate 374 which is controlled by the internal control signal, fast test chronograph, FTC.

Similarly, master-slave latch 376 inhibits the operation of nor gate 256, the T4 generator. The reset inputs to the master latch 378 do not include, $\overline{INC}$, since the time interval T4 is employed only for accessing delay words unassociated with carries. The set terminal of the master latch 378 is driven by the output of nor gate 380 which in turn is driven by the latch 382. The 1 Hz signal drives latch 382 through nor gate 384. The reset terminal of the master latch 378 is coupled to nor gate 386 which has T4 and $\phi$3 as its inputs.

Figure 8:
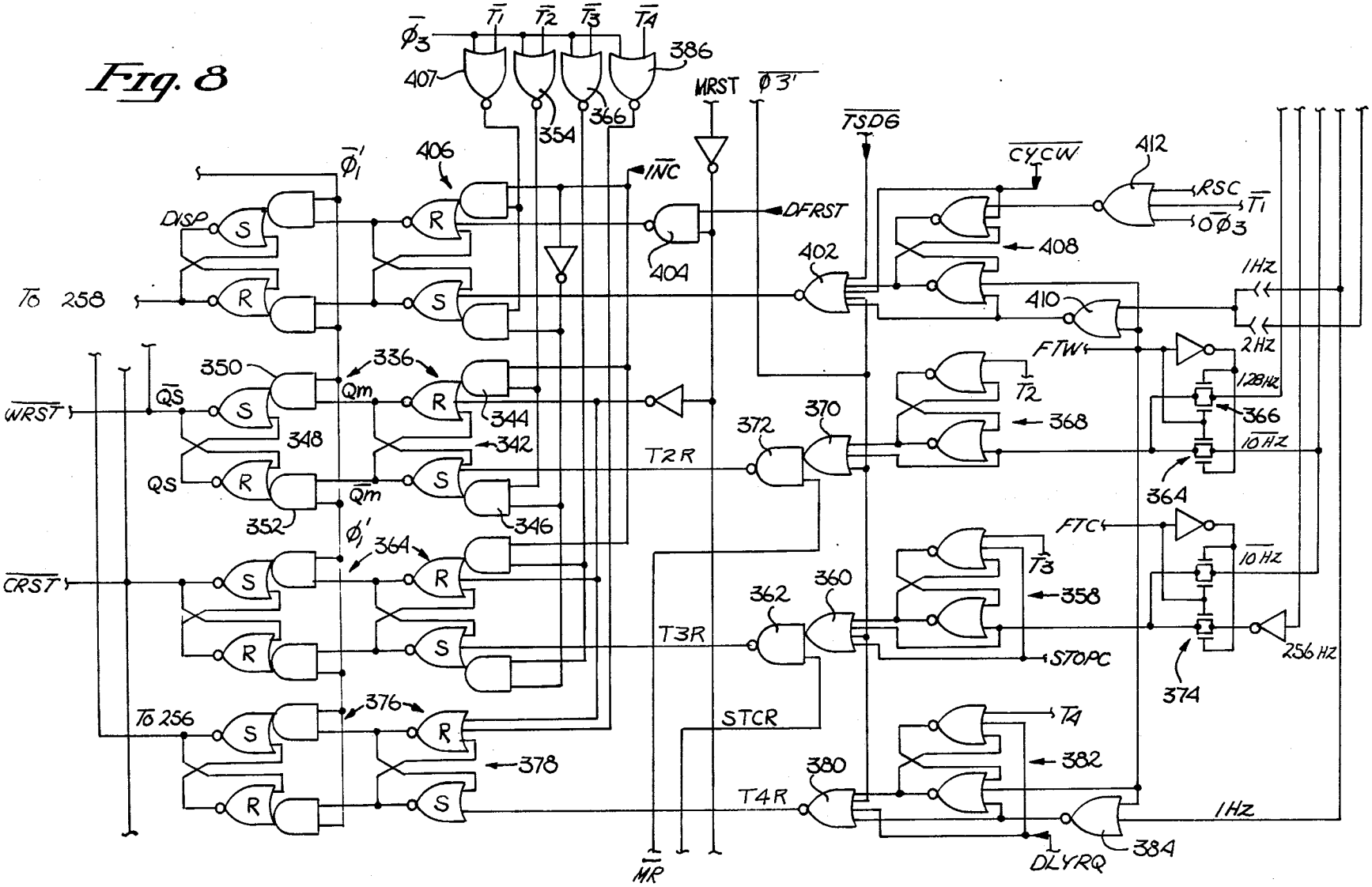
FIG. 8 is a schematic of the D$\phi$3, D$\phi$4, T2, T3, and T4 master-slave latches and timing request circuits.

Three signals are generated in timing and control circuit 44 to control the operation of the chronograph. These signals are the internal control signals: stop chronograph, STOPC; store chronograph sequence, STOREC; and reset chronograph, RESETC. As shown in FIG. 8, the signal STOPC is coupled to nor gate 360 and latch 358. When STOPC is true, latch 358 is set and the T3 requests are inhibited and master latch 342 held reset. This will disenable the T3 generator.

In order to store data during chronograph operation, five RAM words must be transferred from the RAM counter portion of the chronograph to the appropriate RAM store portion of the chronograph. This is achieved by application of the signal, STOREC, as follows. Signals STOREC and $\overline{CYCLEC}$ are simultaneously generated by activation of switch S1 as described in detail below. $\overline{CYCLEC}$ is the internal control signal generated by positive transitions of switch signals SW1 or SW3 corresponding to activation of switches S1 or S3 respectively. $\overline{CYCLEC}$ is a ½ millisecond negative pulse which is used to mask erroneous transistions which may occur during the generation of STOREC. The external control signal, store chronograph, STCR, is normally true. The signal STCR is generated by RS nand latch 388 (FIG. 9) and is coupled to nand gate 362 (FIG. 8). When STCR goes false it will cause continuous requests for clock t3 to be made independently of the 10 Hz signal.

Figure 9:
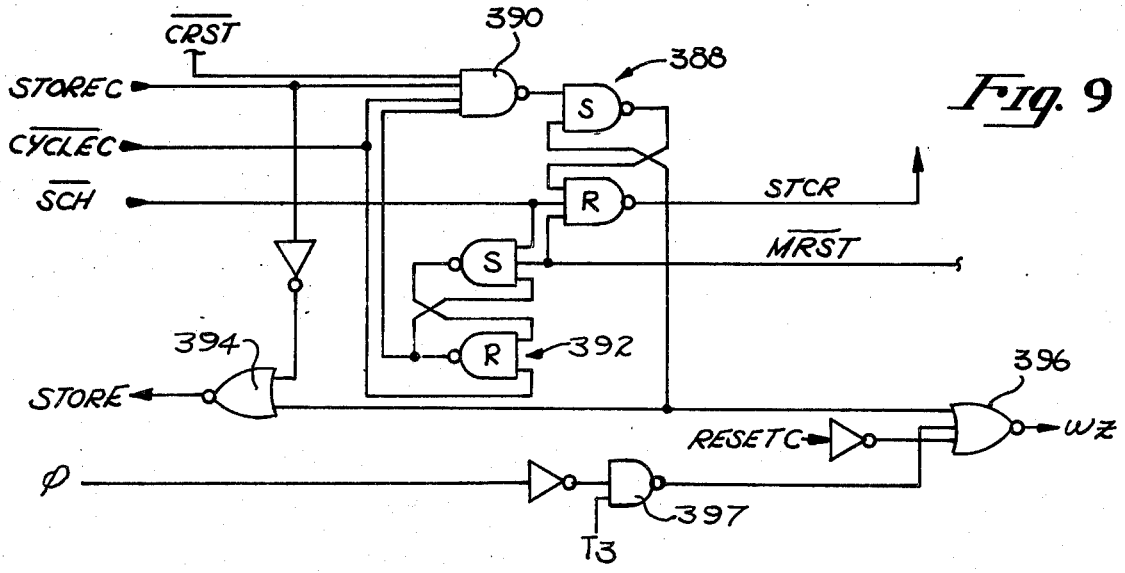
FIG. 9 is a schematic of a control circuit for chronograph sequencing.

The signal, STCR, will go false provided chronograph sequence counter reset, $\overline{CRST}$ is true (FIG. 9). If nand gate 390 has each of its inputs true, latch 388 will be reset since the output of nand gate 390 will go false since $\overline{SCH}$ is normally true. Nand gate 390 has STOREC, $\overline{CYCLEC}$, latch 392, and $\overline{CRST}$ as its inputs. That is, STCR goes false if the chronograph sequence counter is reset ($\overline{CRST}$ = 1) or not in a carry sequence, and if to STOREC is true. Should $\overline{CRST}$ go false, then STCR goes false as soon as the carry sequence is finished and $\overline{CRST}$ returns to true, while $\overline{SCH}$ goes false.

Normally, $\overline{SCH}$, $\overline{MRST}$, and CYCLEC are true. When $\overline{CYCLEC}$ goes false, latch 392 will be set and remain set even when $\overline{CYCLEC}$ goes true again. The output of latch 392 is then normally true. However, when $\overline{SCH}$ goes false, indicating the end of a chronograph counting sequence, latch 392 will be reset and nand gate 390 will be inhibited. Latch 388 will then be set. Nand gate 390 will remain inhibited until $\overline{CYCLEC}$ goes false when SCH is true, thereby setting latch 392 again. Even through CRST or STOREC remain true, latch 388 will thus remain set until $\overline{CYCLEC}$ again goes false.

When continuously T3 clocks are being generated and STCR is true, STOREC and STCR are true and are coupled to nor gate 394 which generates the internal control signal, STORE. STORE is applied to the PLA and RAM to cause RAM data to be written back into the RAM through transmission gates 146 (FIG. 11) directly from the PLA input without passing through the PLA. As discussed below, STORE also selectively generates internal control signals chron A or chron B. During the clock interval T3$\phi$1 – T3$\phi$3, the counter portion of the RAM chronograph is accessed for readout. During the interval T3$\phi$4 the store portion of the RAM chronograph is accessed and data is written in. The chronograph sequence counter continues transferring data from the counter portion of the chronograph RAM to the store portion until the internal control signal chronograph sequence counter limit, SCH goes true. The output of nand gate 330 (FIG. 15), the signal $\overline{SCH}$, will go false when chronograph sequence counter 60 reaches the address 101 to indicate the end of a store sequence.

The internal control signal, reset chronograph, RESETC, STOREC and T3 are used to generate the internal control signal, write zero, WZ, by means of nor gate 396 and nand gate 397 (FIG. 9). Signal WZ is coupled to the chronograph counter portion of RAM 72 through a n-type transmission gate 398 (FIG. 10A). Therefore, during the interval T3$\phi$4 the chronograph counter portion of RAM 72 may be reset to zero.

Internal control signals, watch I/O, which selects the watch data from the RAM storage, and a chron A and chron B which select the counter and storage from the RAM, are generated according to the following logic equations and are implemented by logic circuit 400 of FIG. 21 which is fabricated by means well known to the art.

$$\text{WATCH I/O} = (\text{WTCH})\ \text{T1} + \text{T2} + \text{T4}$$

$$\text{CHRON A} = (\overline{\text{WTCH}})\ (\text{T1})\ (\overline{\text{CC}}) + \text{T3}\ (\overline{\text{STORE}}) + \text{T3}\ (\text{STORE})\ \overline{\phi 4}$$

$$\text{CHRON B} = (\overline{\text{WTCH}})\,(\text{T1})\,(\text{CC}) + \text{T3}\,(\text{STORE})\,\phi 4$$

Inspection of the equations illustrates when various portions of the RAM are read out onto data bus 80.

Timing and control circuit 44 provides three additional signals which control the timing generation and timesetting of the watch. These signals are: timeset digit, TSDG; display reset, DFRST; and cycle watch, CYCW.

The signal, $\overline{\text{TSDG}}$, is used to identify the digit of the display which is to be timeset. A timeset PLA, described in detail below, generates $\overline{\text{TSDG}}$ which is then coupled to nor gate 402 (FIG. 8) in order to enable request for timing signals, D$\phi$3 and D$\phi$4.

Signal DFRST is used to identify the digit being timeset as well as any digits that must respond to carries generated by any digit. DFRST is coupled to nand gate 404 to reset master-slave latch 406 (FIG. 8). Signal $\overline{\text{CYCW}}$ is generated when switch S1 is closed during timeset. Signal $\overline{\text{CYCW}}$, will reset latch 408 and permits D$\phi$3 requests to be made every one half or one second. The various T and $\phi$ clocks are not free running but have been shown to be selectively activated by internal control signals STOPC, STOREC, DFRST, TSDG, RSC, and CYCW. These and other internal control signals previously discussed are generated by the master control circuitry of FIGS. 16 – 26.

MASTER CONTROL

The function of the master control is to provide control pulses for the operational blocks previously described. The primary data input pulses into control circuit 44 are the three switches signals SW1, SW2, and SW3 corresponding to switches S1 – S3 respectively. The details of control circuit 44 will be determined in part by the switching functions chosen by the designer. Therefore, the logic design may vary slightly according to the application. The switching functions described are only one embodiment of a multiplicity of embodiments which are contemplated for the present invention and are illustrated only to show the details of a presently preferred embodiment of the invention.

Figure 2:
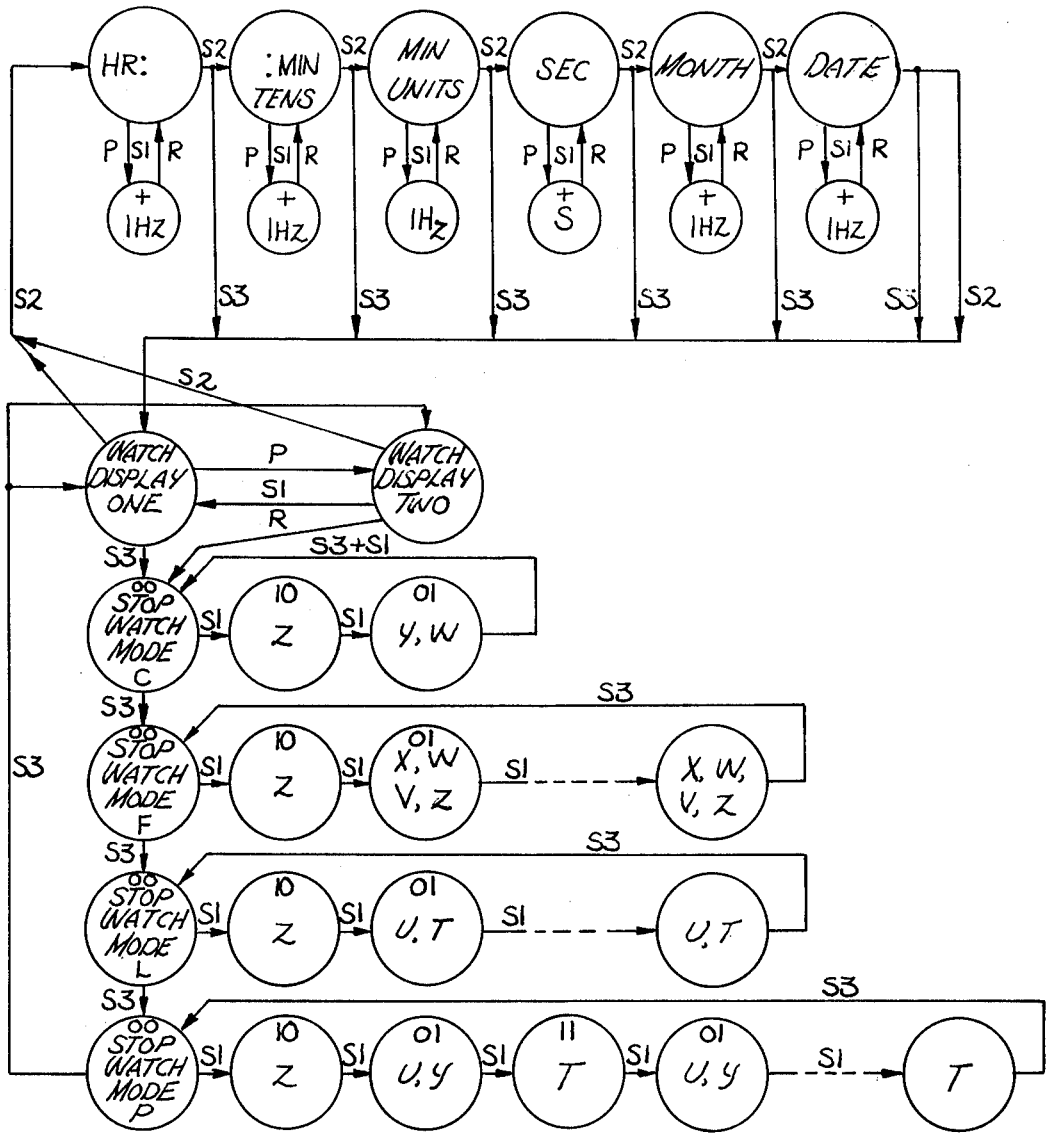
FIG. 2 is a flow chart illustrating an operational sequence of one embodiment having two watch display modes, four chronograph modes and a timeset mode.

FIG. 2 is a flow chart which illustrates the control logic of the present embodiment. Each of the switches are spring loaded push switches which are normally open. The watch may have two watch display modes and four stop watch display modes. Normally the watch is in watch display mode 1 which may be hours/minutes/date. When switch 1 is pushed or activated watch display mode 2, which may be hours/minutes/seconds will be displayed. When switch 1 is again pushed, the watch reverts to watch display mode 1. As shown in FIG. 2, when switch S2 is pushed the watch will be put in the timeset mode in which each of the stored words in the watch may be arbitrarily fixed.

During timeset sequencing after switch S2 has been activated, the hours digit will flash at a 1 Hz rate indicating that the hours digit is the digit to be timeset. When switch S1 is again pushed, the hours digit will stop flashing and the hours digit will be incremented at a 2 Hz rate. When switch S1 is released the incrementation will cease and the digit will continue flashing until S2 is again pushed cycling to the next digit to be set. During timeset the watch count is unaffected. However, whenever the minutes unit digit is cycled, the seconds digit will automatically be set to zero. Therefore, the S1 closure for minutes units and seconds is the same. After the date of the month digit has been cycled, activation of switch S2 will again return the watch to the last used watch display mode and the watch will continue counting. During any cycle of the timeset mode switch S3 may be activated to return watch to the watch display mode. The watch also has an automatic return feature whereby 10 seconds after the hours timeset digit is entered or 10 seconds after correction, whichever is later, the watch will automatically return to the watch display mode.

Activation of switch S3 from the watch display mode 1 or 2 will put the watch in the first chronograph mode or the standard stop watch. Serial activation of switch S3 will step the watch to each of the other chronograph modes and finally return it to watch display mode 1 or 2. If the watch is in the standard stop watch mode, activation of switch S1 begins the stop watch count. Another activation of switch S1 will stop the count and display the elapsed time. During each of the chronograph modes the minutes and seconds are displayed during counting. An alphabetical symbol will also be displayed, C, F, L, or P to indicate which stopwatch mode is being used. An alphabetical symbol, A or P, may also be displayed during normal watch displays if the 12/24 mask is chosen. At the end of the chronograph sequence, the identifier will be removed and tenths of seconds displayed. A third activation of switch S1 will return the chronograph to the beginning of the standard stopwatch sequence and display a zero count together with the chronograph mode identifier. The same affect may be achieved by activating switch S3. Switch S3 may be activated at any time during the standard chronograph mode, except at the first S1 closure, and will return the chronograph to the initial point of the sequence.

The second chronograph mode is a flyback stopwatch. The first activation of switch S1 starts the count. The second activation of switch S1 stops the count, stores the elapsed count, displays the elapsed count, and then it resets the count to zero and begins to count again. Additional activations of switch S1 repeat the sequence, each time writing the new elapsed count into storage over the prior stored count. Activation of switch S3 at any time resets the count to zero, freezes the count, and displays zero with the appropriate identifier thereby returning the sequence to the intial state.

The third chronograph mode is a relay or lap-accumulate stopwatch. The first activation switch S1 begins the count. The next activation of switch S1 stores and displays the count while internal counting continues. Each subsequent activation of switch S1 repeats the above steps not including the initial activation. Again, activation of switch S3 at any time freezes the count, sets the count to zero and displays zero with the appropriate identifier.

Finally, the fourth chronograph mode is an event pause or pause-accumulate stopwatch. The first activation of switch S1 begins the count. The next activation of switch S1 stops, stores, and displays the count. The next activation of switch S1 begins the count from the indicated time at which it was stopped. Subsequent activations of switch S1 repeat the steps not including initial activation. Again, activation of switch S3 at anytime stops the count, resets the count to zero and displays zero with the appropriate identifier.

Figure 16:
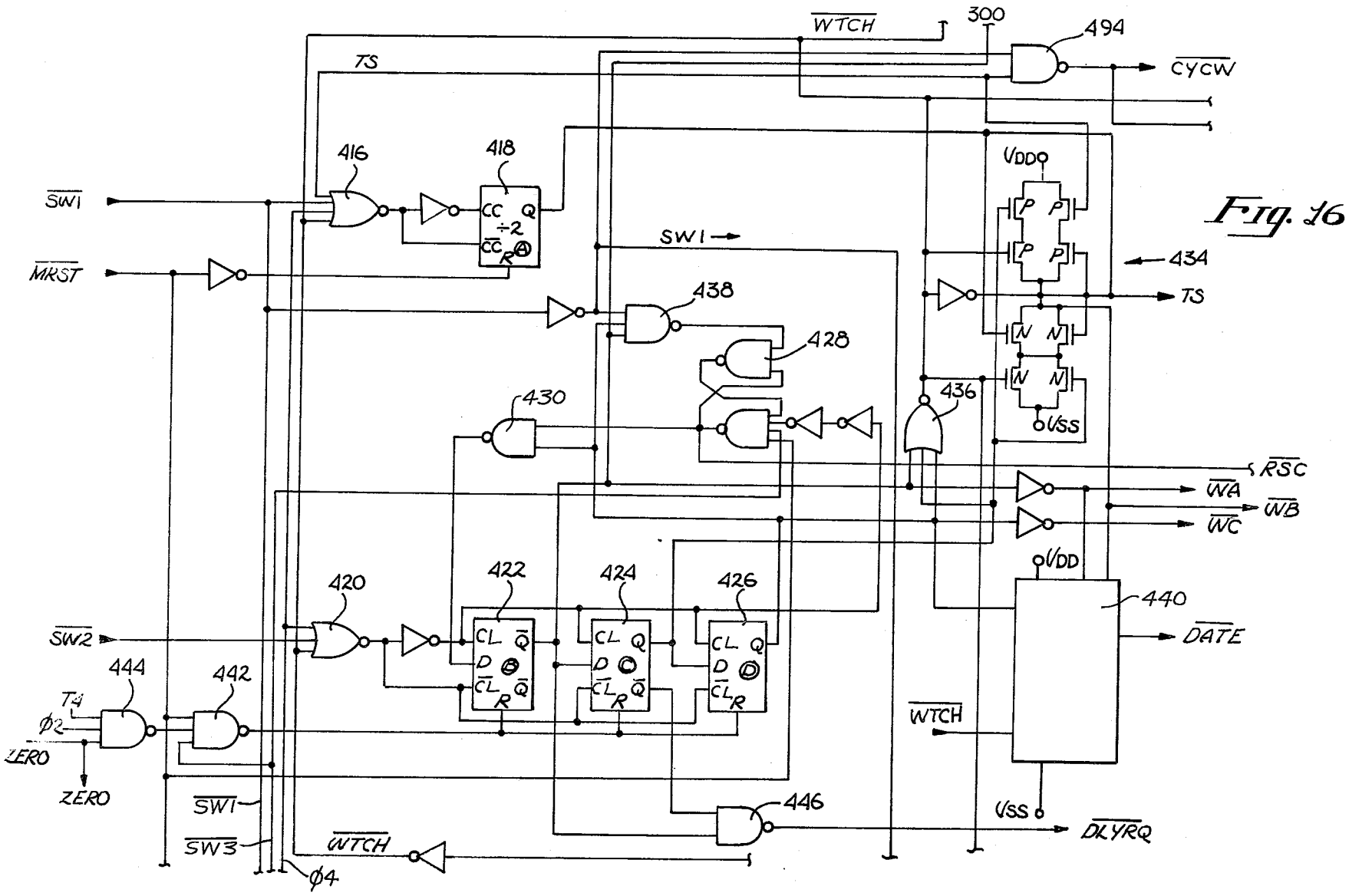
FIG. 16 is a schematic of the master control circuitry associated with switches S1 and S2, i.e., the watch state counter.

The logic circuitry of control circuit 44 may now be understood in light of the various display modes just described. During the watch display signal, SW1, must initiate normal display and during the timeset mode generate a continuous incrementation cycle. Signal, $\overline{SW1}$, is coupled to nor gate 416 which also has as its inputs the internal control signals timeset, TS, clock $\phi 4$, and $\overline{WTCH}$ (FIG. 16). Normally, the output of nor gate 416 is false since at least SW1 is true. When the Q output of flip-flop 418 is false, the watch display is set in watch display mode 2 where the display is hours, minutes, and seconds. When the Q output of flip-flop 418 is true, the watch display is set in display mode 1 where the display is hours, minutes, and date. Flip-flop 418 may only be toggled when the internal control signals WTCH, and $\overline{TS}$ are true. The output of flip-flop 418 is coupled through logic circuit 434 whose operation is described below.

Consider the timeset mode. Activation of switch S2 and signal SW2 as shown in FIG. 16 will cause the watch to go from the normal display mode to the hours time-set mode. Signal $\overline{SW2}$ is one of the inputs to nor gate 420 which also has as its input the internal control signal $\overline{WTCH}$. Therefore, nor gate 420 will have a true output only when switch S2 is pushed, when the internal control signal, WTCH, is true. The output of nor gate 420 is a six state Johnson counter based upon the operation of D type flip-flops 422, 424, and 426. The sixth state of the three flop-flop counter is provided by RS nand latch 428.

The Q output of flip-flop 422 is coupled to the D input of flip-flop 424, while the Q output of flip-flop 424 is coupled to the D input of flip-flop 426. The Q output of flip-flop 426 is coupled to the input of nand gate 430 and each of flip-flops 422 – 426 are synchronously clocked by the inverted output of nor gate 420. Latch 428 also has as one of its reset inputs coupled to the clock signal of flip-flops 422 – 426. Another reset input of latch 428 is coupled to the Q output of flip-flop 424. The output of latch 428 is normally true thereby inverting the Q output of flip-flop 426 and coupling it to the D input flip-flop 422.

The Q outputs of the Johnson counter generate internal control signals, watch control lines, WA, WB, and WC. Signal WB is also modified during the clock, $\overline{TS}$, by the Q output of flip-flop 418 as described below. Signal, $\overline{WA}$, is the inverted signal from the Q output of flip-flop 422. Signal, $\overline{WB}$, is normally the inverted Q output from flip-flop 424 after being cycled through a logic gate described below. The signal, $\overline{WC}$, is the inverted output of flip-flop 426. Johnson counter 422 – 426 cycles through the states as shown in Table 6. Signals WA – WC provide a coded sequence which ultimately will result in six different states during the timeset mode as shown in FIG. 2. The three bit code for WA – WC is used both by the timeset control PLA 432 and the display sequence ROM 278.

Signal WB is derived from logic circuit 434. Logic circuit 434 has as its inputs the output of nor gate 436, the Q output of flip-flop 424 and the Q output of flip-flop 418. Nor gate 436 is coupled to the Q outputs of flip-flops 424 – 426. Normally, during the timeset sequence, the output of flip-flop 418 and nor gate 436 will be zero. Logic circuit 434 is in the form of an "H" and is comprised of two series P-type devices in parallel with two identical P-type devices. The series pairs of P-type devices are in series with two pairs of N-type devices. Each pair of N-type devices forms a two parallel legs analogous to the P-type devices. The output of the nor gate 436, $\overline{TS}$, is coupled to the gates of one P-type device and one N-type device. In the same legs, flip-flop 418 has its Q output coupled to one N-type device and flip-flop 424 has its Q output coupled to one P-type device. Similarly, the inverted signal from nor gate 436 is coupled to a P-type and N-type device in the remaining legs. One P-type device has its gate coupled to the Q output of flip-flop 418 while the remaining N-type device has its gate coupled to the Q output of flip-flop 424. Therefore, when in the normal counting sequence $\overline{TS}$ and the Q output of 418 is false, logic circuit 434 will act as a CMOS inverter coupled to the Q output of flip-flop 424 in the same manner as the circuit couplings to WA and WC. However, when the time state counter reaches the initial counting sequence 000, the output of the nor gate 436 will be true. Logic circuit 434 will now operate as a CMOS inverter with respect to the Q output of flip-flop 418. If the output of flip-flop 418 is false, as assumed, $\overline{WB}$ will be true and the output of the timeset counter stage will appear as 010. However, if the output of flip-flop 418 is true, then $\overline{TS}$ is true, and the WA – WC would appear to assume the timeset counter state 000.

Seconds are reset and held during the timeset mode by means of latch 428. If switch S1 is closed, i.e., SW1 true, the input from SW1 to nand gate 438 would be true. Nand gate 438 also has as its inputs, the Q output of flip-flop 426 and the Q output of flip-flop 422. When the timeset state counter reaches, the state 111, and switch S1 is closed, nand gate 438 will have a false output. During the next activation of switch S2, the clock pulse of the timeset state counter, latch 428 will be set and the Q output of flip-flop 426 will be fed back through nand gate 430, uninverted, to the D input of flip-flop 422. The result is that the timeset state counter will be again set in the counting stage 111. The timeset state counter will remain in this counting state regardless of how many times S2 is activated, until SW1 goes false thereby allowing latch 428 to be reset by $\overline{SW2}$.

Logic circuit 440 has its inputs drawn from $\overline{WTCH}$, $\overline{WA}$, $\overline{WB}$, and WC. The output of logic circuit 440 is used to decode WA – WC and generate a date signal which is given by the following logic equation.

$$\overline{DATE} = \overline{WTCH\,(\overline{WA})\,(WB + WC)}.$$

The signal, DATE, is used to determine whether or not the date identifier should be on.

Finally, it should be noted that the signal, $\overline{SW3}$, is coupled to nand gate 442, which also has as its inputs the master reset signal, $\overline{MRST}$, and the output of nand gate 444. Nand gate 442 has its output coupled to the reset terminal of the timeset state counter. Thus, the timeset state counter will be reset whenever switch S3 is activated and $\overline{SW3}$ goes false. The watch control signal WA – WC will be reset in the initial sequence and control will return to the watch display mode as determined by flip-flop 418.

Consider now the automatic return feature of the present embodiment. When the watch is set at hours timeset and switch S1 is not closed, a time delay of ten seconds is required to return the watch to normal operation should the period elapse without a S1 closure. Hours time-set (the timeset state 100) is detected by nand gate 446 which generates the internal control signal, delay request, $\overline{DLYRQ}$. As shown in FIG. 8, $\overline{DLYRQ}$ is coupled to latch 382 and nor gate 380 so that it normally inhibits the generation of T4 request, T4R. However, when $\overline{DLYRQ}$ goes false in hours timeset, T4 pulses are generated with a 1 Hz group periodicity.

As previously discussed, during T4, the RAM is accessed at the address 1111 by means of nor gate 334 (FIG. 15). Logic circuit 400 will also generate the internal control signal, WATCH I/O, during clock interval T4 (FIG. 21). The RAM word will then be processed according to the state of an internal control delay reset, DLYRST. The signal DLYRST is generated by nor gate 448 in FIG. 17. Nor gate 448 has a signal SW1 as one input, and the $\overline{Q}$ output of flip-flop 450 as the other input. Flip-flop 450 in turn is clocked by clock signal T4. The D input of flip-flop 450 is coupled to the power supply Vdd. Thus, its output $\overline{Q}$ is set at zero during all clock pulses. As long as switch S1 remains open, SW1 will be zero and the output of nor gate 448 will be true. The signal, DLYRST, is one of the external PLA input terms which form part of the PLA nand gates. Thus, by means of the internal PLA code shown in Table 2, if $\overline{\text{DLYRST}}$ is true, then the contents of RAM word 1111 are incremented and rewritten in the address 1111. If $\overline{\text{DLYRST}}$ is false, the delay word is rewritten into the RAM without incrementation.

The output of nor gate 448 will be false for the first T4 pulse of any delay request, DLYRQ, since $\overline{Q}$ of flip-flop 450 is true until the first T4 pulse. In addition, $\overline{\text{DLYRST}}$ will be false if the switch S1 is closed. In hours timeset, as long as switch S1 remains open, the delay word will be incremented during each T4 pulse until the contents of the delay word reach 0000. When the delay word 0000 appears on the data bus 80 nor gates 452, FIG. 10B, will generate a true output, internal control signal, ZERO, which will be coupled to nand gate 444 (FIG. 16). During the interval T4$\phi$2, nand gate 444 will trigger nand gate 442 which in turn will reset the time state counter. Nand gate 446 will then set DLYRQ true, thereby inhibiting the generation of any further T4 pulses.

TABLE 5

CONTROL CODES & DATA LOCATIONS (FIG. 14)

| WA | WB | NC | TIMESET LOOP CONTROL CODE |
|---|---|---|---|
| 0 | 0 | 0 | HR: MIN SEC |
| 1 | 0 | 0 | * HR: MIN A/P |
| 1 | 1 | 0 | HR: MIN |
| 1 | 1 | 1 | HR: MIN SEC |
| 0 | 1 | 1 | MN DT |
| 0 | 0 | 1 | MN DT |
| 0 | 1 | 0 | HR: MIN DT |

* In 24 Hour Mode This Display Is Changed To HR:MIN

| CA | CB | CC | WATCH/STOP WATCH MODE CONTROL CODE |
|---|---|---|---|
| 0 | 0 | 0 | WATCH |
| 1 | 0 | 0 | STANDARD |
| 1 | 1 | 0 | FLY BACK |
| 0 | 1 | 1 | LAP ACCUM. |
| 0 | 0 | 1 | PAUSE |

| CD | CC | CHRONOGRAPH OPERATION CODES |
|---|---|---|
| 0 | 0 | RESET (DISPLAY SHOWS C, F, L, or P) |
| 1 | 0 | COUNT (DISPLAY SHOWS C, F, L, or P) |
| 0 | 1 | STOP/STORE/PAUSE |
| 1 | 1 | RESET/STORE/COUNT |
| 0 | 1 | RESET/STORE/PAUSE |

Figure 17:
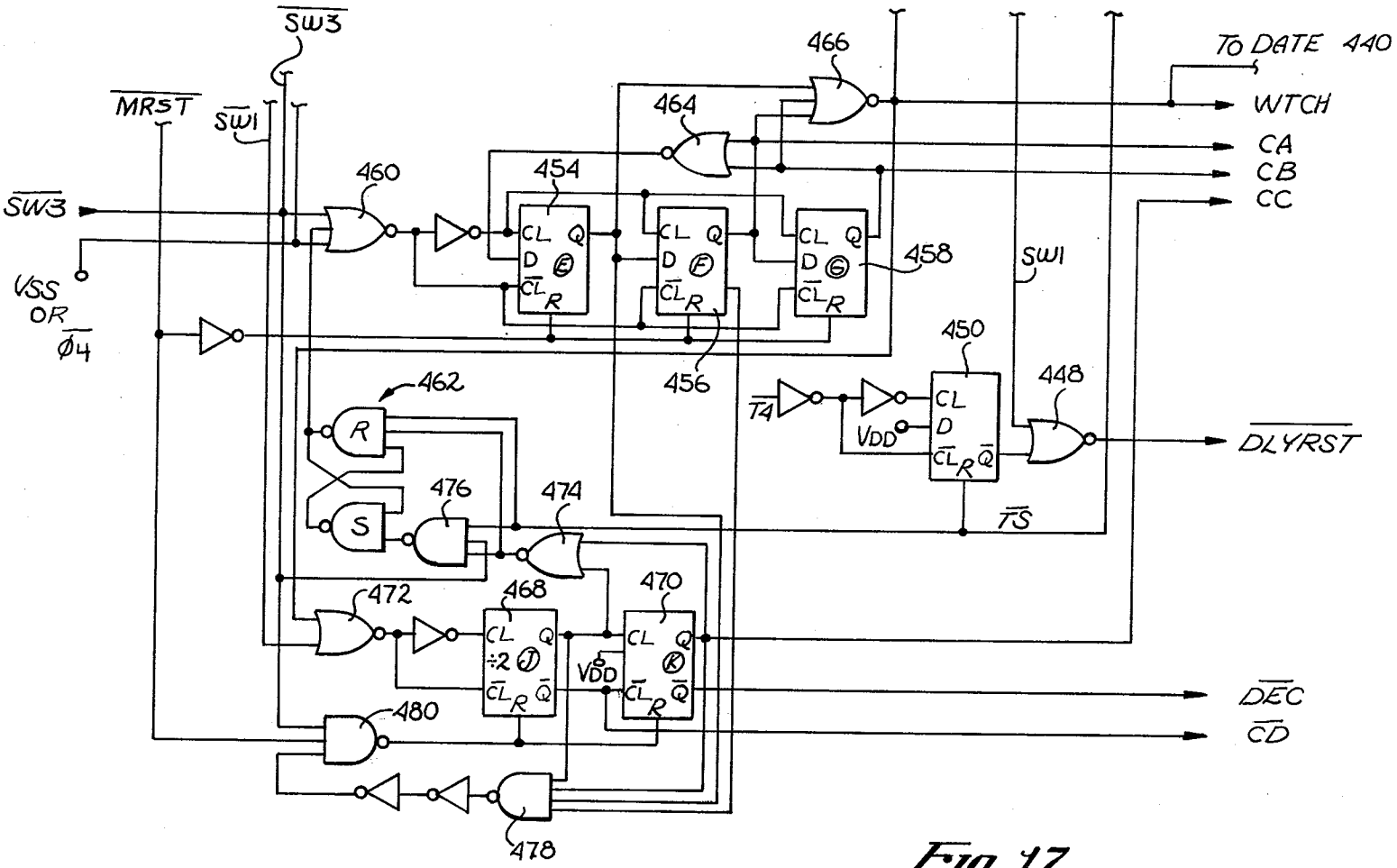
FIG. 17 is a schematic of the master control circuitry associated with switch S3, i.e., the chronograph state counter.

Consider now the operation of the various chronograph modes in relation to switches S1 – S3. Similar to the timeset state counter, the chronograph state counter shown in FIG. 17 is a five state Johnson counter based upon D type flip-flops 454, 456, and 458. This counter controls the mode selection of the four modes of the chronograph. Signal $\overline{\text{SW3}}$, corresponding to switch S3, is coupled to nor gate 460. Nor gate 460 in addition has an input from RS latch 462 and clock signal $\phi$4. The inverted output from nor gate 460 serves as the clock pulse for each of the flip-flops 454 – 458. The Q output of flip-flop 454 is coupled to the D input of flip-flop 456, and likewise in regard to flip-flop 456 with respect to flip-flop 458. The Q output of flip-flops 456 and 458 are coupled to nor gate 464. The output of nor gate 464 is coupled to the D input of flip-flop 454. The five state counting sequence of the counter is shown in Table 6 for the chronograph control signals CA, CB, and CC. As before the Q output of flip-flop 456 generates CA; the Q outputs of flip-flop 458 generates CB; and CC is generated from the Q output of flip-flop 454 through the logic circuit described in detail below.

The internal control signal WTCH is generated by nor gate 466 which has an output coupled to each of the Q outputs of flip-flops 454 – 458. Thus, WTCH is generated from the state 000 of the counter and represents normal watch operation.

Figure 19:
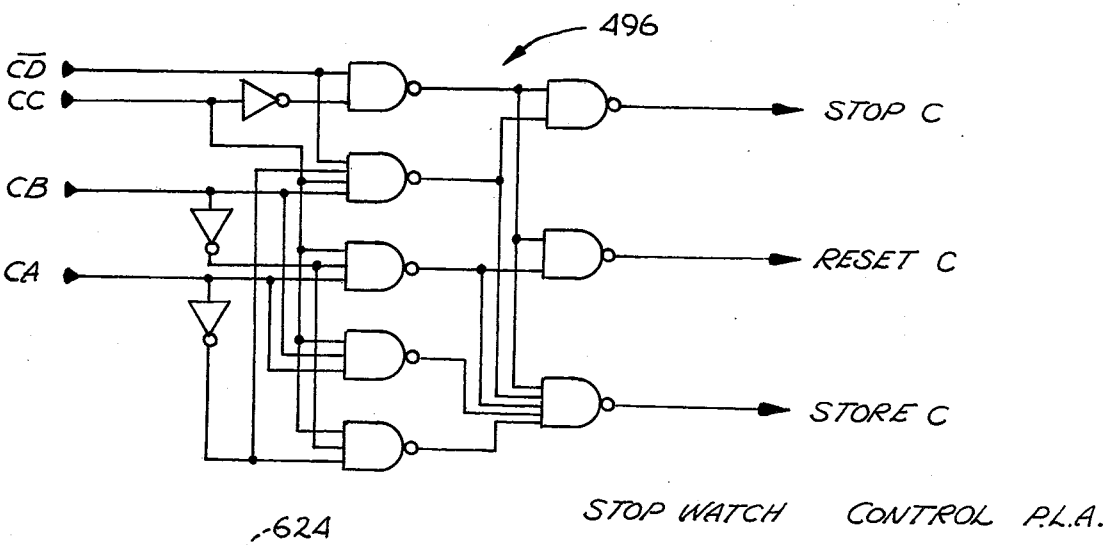
FIG. 19 is a logic equivalent schematic for the chronograph PLA.

Chronograph control signal CC is coupled to the Q output of flip-flop 470 and chronograph control signal $\overline{\text{CD}}$ is coupled to the $\overline{Q}$ output of flip-flop 468. Signals CA – CC are used as inputs to nand decoder 280 (FIG. 13) in conjunction with ROM 278 for generating preselected address formats. Signals CA – CD are used in the chronograph PLA to generate internal control signals STOREC, STOPC, and RESETC as shown in FIG. 19. Signal CC is also used as one of the control signals to select a desired display font, alpha, or numeric A as illustrated in FIG. 20. Finally, $\overline{\text{CC}}$ or equivalently $\overline{\text{DEC}}$, from the $\overline{Q}$ output of flip-flop 470 is used to drive the decimal point in the chronograph display.

The clock input to flip-flop 468 is provided by the output of nor gate 472. Nor gate 472 has as its inputs $\overline{\text{SW1}}$ and WTCH. Therefore, nor gate 472 will have a true output only during a chronograph sequence when switch S1 is closed. The Q output of flip-flop 468 drives the clock input of flip-flop 470. The D input of flip-flop 470 is coupled to the power supply Vdd. Therefore, on the first clock pulse from flip-flop 468, the Q output of flip-flop 470 will go true and remain true until flip-flop 470 is reset.

Flip-flop 470 goes true as soon as there is a S1 closure during a chronograph sequence. The preset zero at flip-flop 468 will be set true thereby clocking the Q output of flipflop 470 true. Since the Q output of flip-flops 468 and 470 are provided as inputs to nor gate 474, the output of nor gate 474 will change from true to false on a S1 closure during a chronograph mode.

The output of nor gate 474 is one of the inputs to nand gate 476. Nand gate 476 has as additional inputs, $\overline{\text{SW3}}$ and $\overline{\text{TS}}$. Normally, during a chronograph sequence, $\overline{\text{TS}}$, and $\overline{\text{SW3}}$ will both be true. The output of nand gate 476 is coupled to the set terminal of RS nand latch 462. Normally, the output of nor gate 474 will be true and nand gate 476 false during a chronograph sequence. Therefore, latch 464 is reset before an S1 closure. When latch 462 is in a reset state, its Q output, coupled to nor gate 460, will permit switch S3 closures to sequence the chronograph state counter.

However, during a chronograph sequence and a S1 closure, the output of nor gate 474 will go false, the output of nand gate 476 will go true, and latch 462 will be set. The output of latch 462, coupled to nor gate 460, will disenable the effect of any switch S3 closures during a chronograph sequence after the first S1 closure. Similarly, the effect of a switch S3 closure during a timeset cycle is disenabled since signal $\overline{TS}$ is one of the inputs to nand gate 476. When $\overline{TS}$ is zero, the output of nand gate 476 will always be true. Thus, latch 476 will be set and the chronograph state counter will be decoupled from switch S3. After the chronography sequence is completed and flip-flops 468 and 470 reset, $\overline{TS}$ will reset latch 462.

For example, internal control signals TSDG and RSC are valid during the entire T1 interval. The signal DFRST is stored in memory latch 482 during all time intervals, except T1$\phi$3 when nor gate 484 open circuits the CMOS transmission gates in the input and feedback loops of memory latch 482. Thus, DFRST is valid from the end of one T1$\phi$3 interval to the beginning of the next T1$\phi$3 interval.

TABLE 6

(FIG. 15)
TIMESET & LEADING ZERO SUPPRESSION
P.L.A.

| AND | | | | | | OR | | | | | |
|---|---|---|---|---|---|---|---|---|---|---|---|
| DISPLAY CODE | | | DIGIT SCPN | | | | | | | | |
| NP | WB | WC | DS2 | DS1 | DS0 | TS | DFRST | TSDG | SEC. RST | BLANK | COMMENTS |
| 1 | 0 | 0 | 0 | 1 | 1 | 1 | 1 | 1 | | | HR Units DG4 |
| 1 | 0 | 0 | 1 | 0 | 0 | 1 | 1 | | | | HR Tens DG5 |
| 1 | 0 | 0 | 1 | 0 | 1 | 1 | 1 | | | | AM/PM DG6 |
| 1 | 1 | 0 | 0 | 1 | 0 | 1 | 1 | 1 | | | MIN Tens DG3 |
| 1 | 1 | 1 | 0 | 0 | 1 | 1 | 1 | 1 | | | MIN Units DG2 |
| 1 | 1 | 1 | 1 | 1 | 0 | 1 | | | 1 | | ÷ 10 DG7 |
| 1 | 1 | 1 | 0 | 0 | 0 | 1 | | | 1 | | SEC Units DG1 |
| 1 | 1 | 1 | 0 | 0 | 1 | 1 | | | 1 | | SEC Tens DG2 |
| 0 | 1 | 1 | 0 | 0 | 1 | 1 | 1 | 1 | | | MN Units DG2 |
| 0 | 1 | 1 | 0 | 1 | 0 | 1 | 1 | | | | MN Tens DG3 |
| 0 | 0 | 1 | 1 | 1 | 1 | 1 | 1 | 1 | | | DT Units DG8 |
| 0 | 0 | 1 | 0 | 0 | 0 | 1 | 1 | | | | DT Tens DG1 |
| | | | 1 | 0 | 1 | | | | | | DG6 |
| 0 | 1 | 1 | 0 | 1 | 1 | | | | | 1 | MN Tens DG4 |
| 0 | 0 | 1 | 0 | 1 | 1 | | | | | 1 | MN Tens DG4 |
| 0 | 1 | 1 | 0 | 0 | 1 | | | | | 1 | DT Tens DG2 |
| 0 | 0 | 1 | 0 | 0 | 1 | | | | | 1 | DT Tens DG2 |
| 0 | 1 | 0 | 0 | 0 | 1 | | | | | 1 | DT Tens DG2 |

During a chronograph sequence $\overline{SW3}$ is normally true so that nor gate 472 will merely invert $\overline{SW1}$. The clock pulse to flip-flop 468 is again inverted and is $\overline{SW1}$. Therefore, the clock of flip-flop 468 goes negative on an S1 closure. Flip-flop 468 and 470 are clocked on negative edges so that they are sequenced through the states 00, 10, 01, 10, 01 . . . as shown in Table 6, thereby providing the four distinguishable states necessary for control during chronograph sequencing.

Flip-flops 468 and 470 and reset by means of nand gates 478 and 480. Nand gate 478 has its inputs coupled to the Q output of flip-flop 468, the Q output of flip-flop 470, the Q output of flip-flop 454, and the $\overline{Q}$ output of flip-flop 456. Thus, nand gate 478 will always have a true output except when signals CC and CD are true, and the chronograph state counter is in the state 100. This chronograph state will be the second state generated on the second closure of switch S1. On the third activation of switch S1, CD will go true thereby generating a false output from nand gate 478 and triggering nand gate 480 to reset flip-flops 468 and 470. Alternatively, if switch S3 is closed nand gate 480 will also be triggered and flip-flops 468 and 470 reset.

Figure 18:
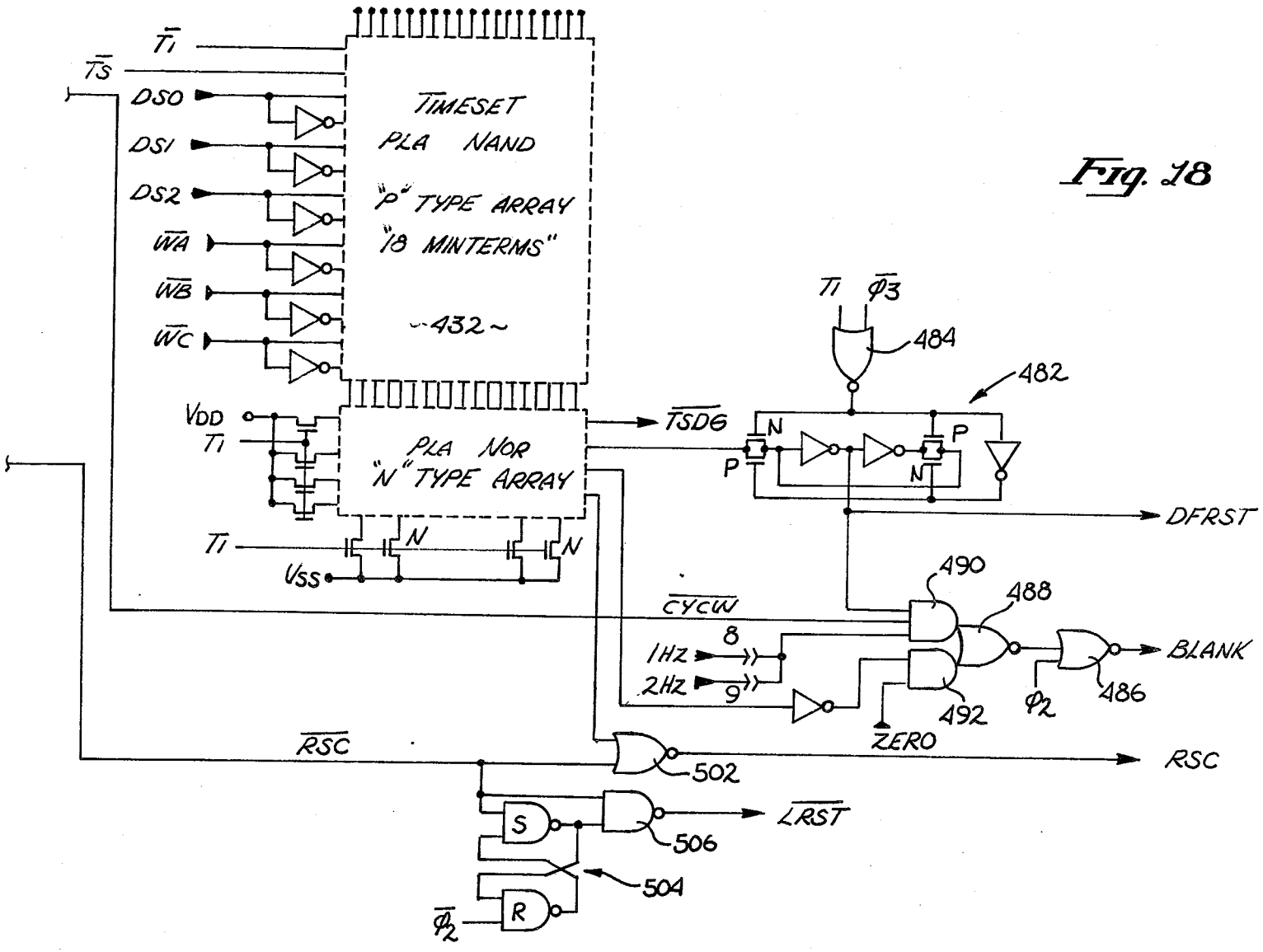
FIG. 18 is a simplified schematic of the time-set PLA and associated circuitry.

Timing and control circuit 44 also contains two small PLA's. Timeset PLA 432 is substantially similar to the main PLA 72 and has its minterms illustrated in Table 10. The function of the timeset PLA 432 is to identify the digit to be timeset, identify the timeset digits that must respond to carries in order to prevent unwanted rollover, identify the digits which have leading zero suppression, and to synchronize the second reset. As shown in FIG. 18, the inputs to timeset PLA 432 are the digits scan counts DSO - DS2 and the watch control signals $\overline{WA}$ - $\overline{WC}$. PLA 432 is accessed during interval T1 and generates: timeset digit $\overline{TSTG}$; delay flag reset, DFRST; a blanking signal, BLANK; and reset seconds, RSC, as determined by various $\phi$ clocks.

Signal BLANK will be valid from one T$\phi$2 rise until $\phi$2 falls. Signal BLANK is generated by nor gate 48 and thus will be true only when the pulse $\overline{\phi 2}$ and the output of nor gate 488 are both false. The output of nor gate 488 will be false as long as at least one of its inputs, AND gates 490 and 492, are true. AND gate 492 will be true whenever the BLAND signal is generated by PLA 432 and signal ZERO is true, which occurs whenever all zeros appear on data bus 80. The output of and gate 492 is used for leading zeros suppression as decoded by PLA 432 (FIG. 18). And gate 490 will be true if signal DFRST is true and $\overline{CYCW}$ is true. In addition, AND gate 490 is driven by a 1 or 2 Hz signal, as optioned, so that a flashing BLANK signal may be generated during timeset. Signal $\overline{CYCW}$ is generated by nand gate 494 (FIG. 16). Nand gate 494 has as its inputs signals SW1 and TS. Thus, $\overline{CYCW}$ will have a true output at all times, except during a switch S1 closure and timeset. Thus, when DFRST is true and switch S1 is closed, a flashing BLANK signal will be generated in order to identify the digit being timeset. The digit will cease flashing during a switch S1 closure and will flash at all other times during DFRST. TSDG is one of the inputs to NOR gate 402 in FIG. 8, and is normally true thereby inhibiting D$\phi$3 and D$\phi$4 requests from the masterslave 406. During a timeset mode, TSDG, goes true thereby identifying the digit to be timeset by selectively enabling transmission of clock pulses through nor gate 402. When TSDG goes true, will be stored in storage cell 482 at T1$\phi$3. Normally, DFRST is true. During timeset when TSDG goes true, at T1$\phi$3 DFRST will go false. The output of nand 404 (FIG. 8), which is normally false, goes true, thereby holding master-slave 406 reset. Thus, master-slave 406 will function as if no carry ever occurs regardless of the actual state of INC.

TABLE 7

STOPWATCH CONTROL P.L.A.

| CONTROL CODES | | | | | | | |
|---|---|---|---|---|---|---|---|
| CA | CB | CC | CD | STOREC | STOPC | RESETC | COMMENTS |
| | | 0 | 0 | 1 | 1 | 1 | RESET (C,F,L or P nodes) |
| 0 | 0 | 1 | X | 1 | | | STORE in C Mode |
| 1 | 0 | 1 | X | 1 | | 1 | STORE/RESET in F Mode |
| 1 | 1 | 1 | X | 1 | | | STORE in L Mode |
| 0 | 1 | 1 | 0 | 1 | 1 | | STORE/PAUSE in P Mode |

X = Don't Care States

The internal control signal STOPC, RESETC, and STOREC are generated by PLA 496. PLA 496 is illustrated in FIG. 19 in terms of symbolic logic since only five minterms are required. PLA 496 may either be constructed similarly to PLA 432 or may assume the circuit configuration illustrated in FIG. 19. The operation of PLA 496 may be readily deduced from Table 7. As illustrated in FIG. 8, STOPC is used to inhibit latch 358 thereby stopping the chronograph sequence by inhibiting T3 request, T3R. STOREC, as previously described, is used to generate internal control signal STCR to inhibit T3 request, T3R (FIG. 9). RESETC is used in FIG. 9 as one input to NOR gate 396 which generates signal WZ which will write ZEROS into the chronograph counter and RAM.

Although the present invention has capacity for at least three display fonts in the present embodiment only two fonts are used, namely alpha and numeric A. The characters zero through nine, and the letters A, C, F, L, and P, stored in RAM 72, as shown in Table 1, are displayed. Logic circuit 498 as illustrated in FIG. 20 generates, by means well known to the art, signals alpha and numeric A during clock pulse $\phi 3$ according to the following logic equations:

$$\text{Alpha} = DG1(DLYRQ + \overline{WTCH(\overline{CC})})\phi 3$$

$$\text{Numeric A} = \overline{DG1(DLYRQ + \overline{WTCH(\overline{CC})})\phi 3}.$$

By inspection of the logic equation or logic circuit 498, well known to the art, it may be seen that alphanumeric displays are generated only for digit DG1 during clock pulse $\phi 3$ either in hours timeset (DLYRQ = 1) or during the chronograph counting mode (CC = 1 and WCTH = 1) (FIG. 20).

The alphanumeric identifiers, A, C, F, L, P, are stored within RAM 52 at uniquely assigned addresses. Wa - WC and CA - CD are coded such that A and P, for watches incorporating the AM/PM option, is displayed only during hours timeset, and C, F, L, or P is displayed only during a selected chronograph sequence. The alphanumeric symbols are permanently stored in the RAM by modifying a standard memory cell to read only, i.e., by omitting the first CMOS inverter, and the associated CMOS transmission gate and by coupling the input of the second CMOS inverter either to Vdd or Vss as determined by the selected code.

Logic circuit 500 is a circuit for the generation of internal control signal L which is directly coupled to the segment driver for the colon. In the present embodiment as illustrated in FIG. 22 logic circuit 500 is fabricated by means well known to the art and has a 1 and 2 Hz input and 3 mask options. Three options will give a pulsed L signal with a 25%, 50%, or 75% duty cycle. The logic equation for signal L is as follows:

$$\overline{L} = \overline{WA + \overline{WTCH} + \overline{TS}\,[(1Hz)(2Hz) + 1Hz + \overline{(1Hz + 2Hz)}]}$$

Only one of the or-ed terms within the brackets is selected by appropriate masking and each term represents 25%, 50% and 75% duty cycles from left to right respectively.

As previously discussed, during a timeset mode, when minutes units are cycled then seconds tens and seconds units are reset to zero. Internal control signal, reset seconds, RSC provides this function and is generated by NOR gate 502 (FIG. 18). NOR gate 502 has one input to PLA 432 and one input to the Q terminal of latch 428 of the timeset state counter FIG. 16. As previously described, latch 428 will trigger NOR gate 502 to reset the second units and tens when minutes units are being timeset. However, when switch S2 is again closed to restart the watch, the flashing of the colon is resynchronized with the new seconds count. This is accomplished by means of RS NAND latch 504 in conjunction with NAND gate 506. The set terminal of latch 504 is coupled to the $\overline{Q}$ output of latch 428.

As previously described on an S2 closure, after minutes units, the $\overline{Q}$ output of latch 428 is set true (FIG. 16). Latch 504 is normally in the reset condition. The reset terminal of latch 504 is coupled to clock $\phi 2$. Therefore, during the clock interval $\phi 2$ the reset terminal of latch 504 will be false and the set terminal of latch 504 will go true. The Q output of latch 504 then switches from false to true. The inputs of NAND gate 506 are the $\overline{Q}$ output of latch 504 and the $\overline{Q}$ output of latch 428. Both inputs are now simultaneously true generating a false output for $\overline{LRST}$. When $\overline{LRST}$ goes low, the output of NAND gate 508 illustrated in FIG. 7 will reset the 1 and 2 Hz timing generators, flip-flops 232–240. This will have the effect of resynchronizing the colon flashing, timeset cycling, and timeset flashing with the seconds count.

Debounce and Associated Circuits

Figure 23:
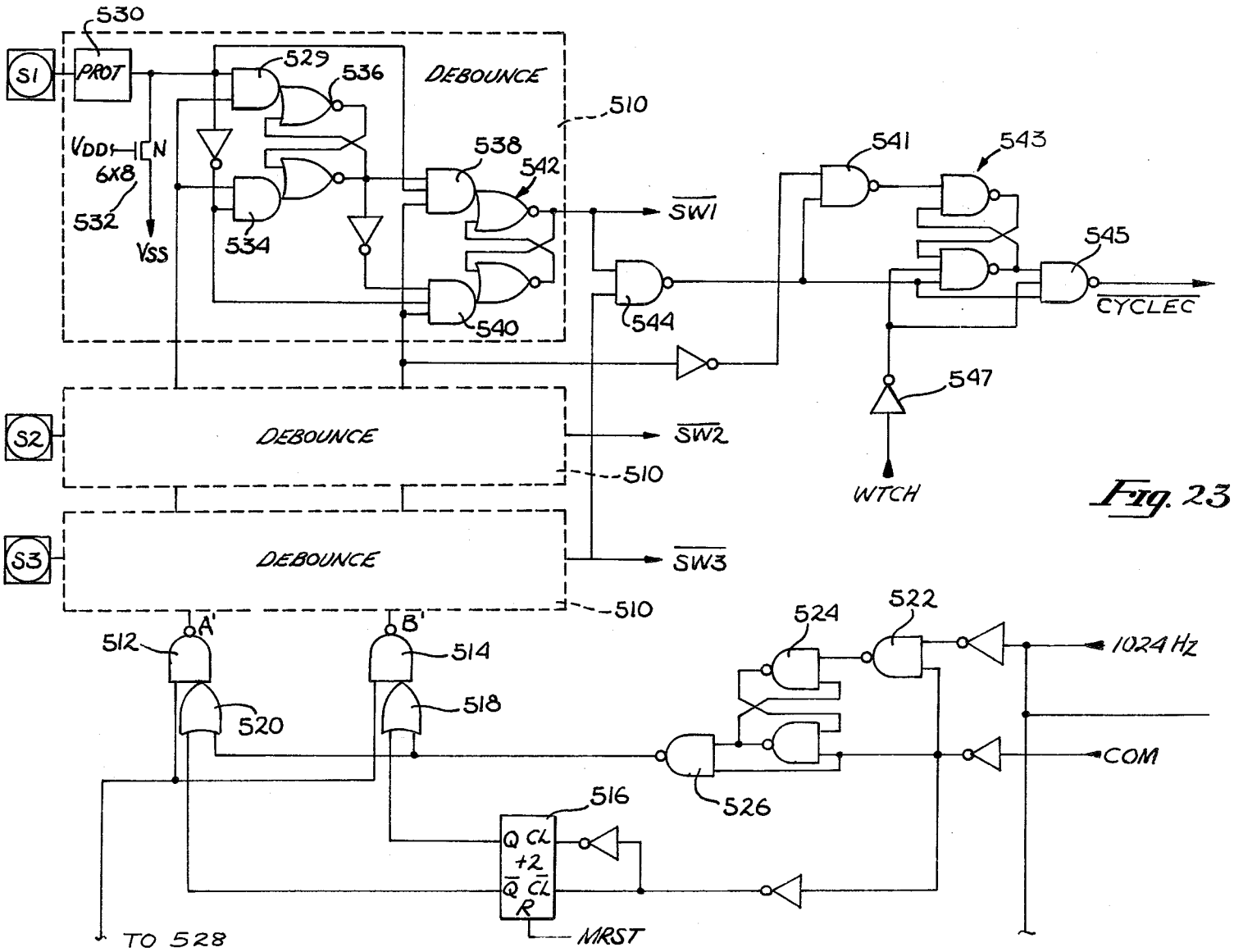
FIG. 23 is a schematic for the debounce generator, debounce circuits and CYCLEC generator.

FIG. 23 illustrates the generator of switching signals SW1 - SW3 from the switch closures of switches S1 - S3 through a debounce circuit 510. Each switch is coupled directly to debounce circuit 510 which requires that the input change be valid for at least 31 milliseconds before such change is acknowledged as valid. Debounce circuit 510 is driven by a generator which produces ½ millisecond wide pulses every 30 milliseconds alternately from NOR gates 512 and 514. The 30 millisecond generator is driven by the 32 Hz segment voltage, COM, described below, and by the 1024 Hz voltage from the prescale divider.

The signal, COM, provides the clock voltage for flip-flop 516. The Q and $\overline{Q}$ outputs of flip-flop 516 are 16 Hz signals coupled to the inputs of NOR gates 518 and 520 respectively. When COM is false the output of nand gate 522 must be true. The output of nand gate 522 is coupled to the set terminal of RS nand latch 524. Therefore, the Q output of latch 524 will be true and the output of nand gate 526 will be true. Normally the output of nor gate 528 is true so that the outputs of nand gates 512 and 514 will both be false when COM is false. COM and the 1 KHz signal are synchronized. Therefore, when COM is true, the first pulse of the 1 KHz signal will be inverted and will be false at the inputs of nand gate 522. The output of nand gate 522 will remain true. Therefore, during the first 1 KHz pulse, the set and reset terminals of nand latch 524 will simultaneously be true, making the inputs to nand gate 526 simultaneously true. A false output from nand gate 526 will then set the output of either nand gate 512 or 514 true as determined by flip-flop 516. Half a millisecond later, when the 1 KHz signal begins to go true, latch 524 will be reset and stay reset thereby setting the outputs of nand gates 512 and 514 false.

The output of nand gate 512 is coupled to the input of and gate 529. The other input of nand gate 528 is coupled to a CMOS gate input protection circuit 530, well known to the art, which protects and gate 529 from accumulation of any static charges. The output of protection circuit 530 is true on a S1 closure. Normally, pull-down device 532 holds the S1 input of and gate 529 low, but is overridden on an S1 closure. Therefore, normally the inputs of and gate 529 are both false while and gate 534 has a false and true input. If S1 closes, and the output of nand gate 512 goes true, the output of and gate 529 will go true. This will set the Q output of RS nor latch 536 true.

Protection circuit 530, the Q terminal of latch 536, and the output of nand gate 514 are inputs to and gate 538. Latch 536 will be reset on the next pulse from nand gate 512 if switch S1 is open. If switch S1 remains closed until and gate 514 goes true and if latch 536 remains set, and gate 538 will have a true output, and and gate 540 will be false. The output of and gate 538 is coupled to the reset terminal of RS nor latch 542. The signal SW1 will then be set false indicating that switch S1 has remained closed for at least 30 milliseconds. Latch 542 will be set on the next pulse from nand gate 514.

An identical debounce circuit is associated with switches S2 and S3 so that any transient signals not valid for at least 33 milliseconds are ignored.

The signals SW1 and SW3 are coupled to the inputs of nand gate 544 to generate internal control signal CYCLEC CYCLEC. CYCLEC is a half millisecond negative pulse which occurs for each negative transition of either $\overline{SW1}$ or $\overline{SW3}$ when the clock is in the chronograph mode. CYCLEC is used as one of the input signals to generate signal STCR as illustrated in FIG. 9. Whenever signals SW1 or SW3 have a positive transition indicating a switch S1, or switch S3 closure during a chronograph cycle (WTCH = 0) a ½ millisecond negative pulse will be generated.

Normally, $\overline{SW1}$ and $\overline{SW3}$ are true so that the output of nand gate 544 is false. The output of nand gate 514 is also normally false so that nand gate 541 has a true output. Thus, nand latch 543 is reset and the output of nand gate 545 is normally true. As either $\overline{SW1}$ or $\overline{SW3}$ go false, the output of nand gate 544 will go true and nand 514 will go true. The inputs to nand gate 514 will both invert leaving the output true. Latch 543 will remain in the reset state but all the inputs to nand gate 545 are now true so that $\overline{CYCLEC}$ goes false. Thirty milliseconds later, nand gate 514 will again go false. The inputs to nand gate 541 are now both true, setting the output of nand gate 541 false. Latch 543 will be set and $\overline{CYCLEC}$ will return true since latch 543 will remain set until $\overline{SW1}$ and $\overline{SW3}$ are both again true.

Figure 24:
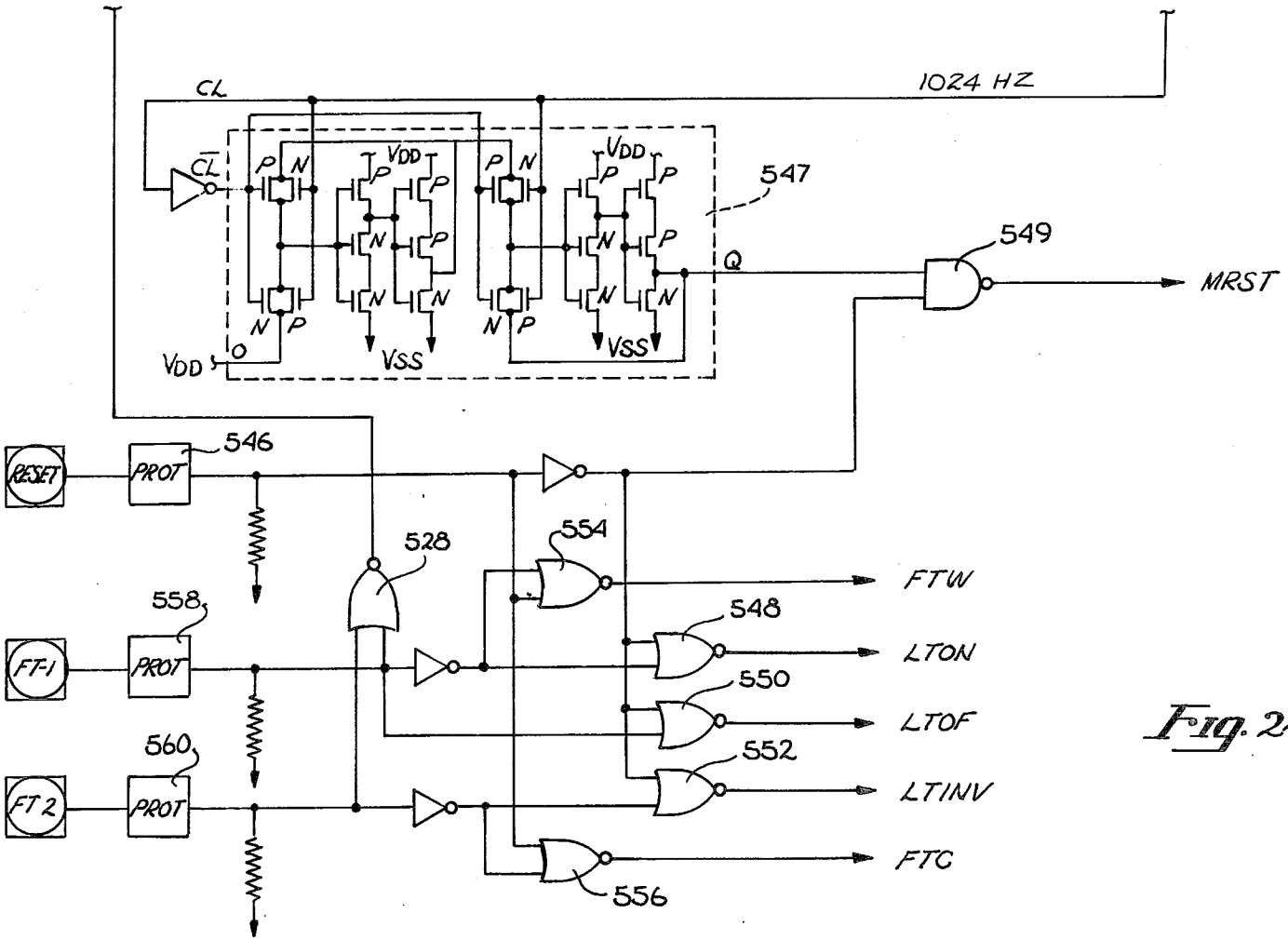
FIG. 24 is a schematic for the master reset generator and the fast test generators.

As shown in FIG. 24, whenever RESET is true, protection circuit 546 will have a high output which is inverted and coupled to nand gate 549 thereby setting the master reset signal, MRST, true. MRST is used to reset all D-type flip-flops, counters, latches, and memories. Every counter within the prescale divider circuit is reset from the frequency 512 Hz and lower. Thus, during master reset, master oscillator 40 will drive the first five flip-flops in the prescale divider and will generate the 1 KHz clock. The 1 KHz clock is used to drive D type flip-flop 547. Flip-flop 547 is biased so that when the battery is inserted into the watch the Q output will always be set false. Thus, MRST will always be set true when the chip is first connected to the power supply. The 1024 Hz clock is used to set the Q output of flip-flop 547 true after a maximum of 3 1 Khz clock edges.

Fast Test Circuitry

If RESET is true, nor gates 548, 550, and 552 will each have a false input, and nor gates 554 and 556 will have a true input. The terminal fast test one, FT1, coupled to nor gates 548 and 550 through protection circuit 558, will control the internal control signals, LTON and LTOF, which will turn the entire display off or on as described below.

The fast test terminal, FT2, coupled through protection circuit 560 to nor gate 552 will generate the internal control circuit, LTINV, which will disenable the 32 Hz clock thereby causing a DC signal to be set in the segment display. Thus, the segment display may be cycled through all the DC states possible by appropriate inputs at FT1 and FT2.

Figure 26:
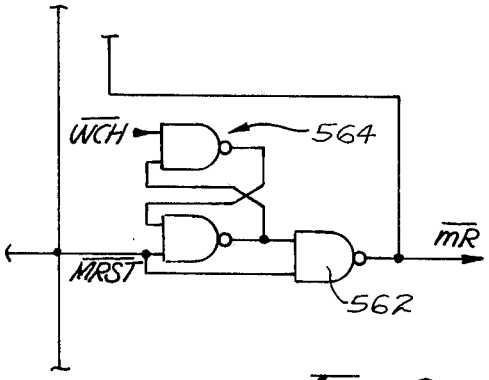
FIG. 26 is a schematic for the initialize reset generator.

When RESET returns from true to false, the output of nand gate 459, MRST, will be fixed true. The output of nand gate 562 in FIG. 26, is initialize sequence, $\overline{MR}$. When $\overline{MR}$ goes true, a series of sixteen T2 pulses are generated causing the RAM to access each state of the watch sequence counter. At the 16th pulse, as illustrated in FIG. 15, $\overline{WCH}$ goes to zero activating latch 564 so that the output of nand 562 goes true and therefore inhibits the T2R request (FIG. 8). The initialize sequence, MR, is also one of the PLA inputs as illustrated in FIGS. 2 and 11. MR deactivates all normal PLA minterms, and activates the power-up initialize minterms. As shown in FIG. 11, MR will also reset flags K1 – K3 and as shown in FIG. 25 will initialize the start up of voltage converter 566 which is disclosed in a copending application, Ser. No. 552,439, filed on Feb. 24, 1975 and designed to the same assignee of the present invention.

When RESET is low, FT1 and FT2 will generate internal control signals FTW and FTC from nor gates 554 and 556 (FIG. 24). As previously described, these signals will speed up the generation of latches 358 and 368 to 10 Hz (FIG. 8). Finally, when either FT1 or FT2 are true the output of nor gate 528 (FIG. 24) will disenable the outputs of nand gates 512 and 514 (FIG. 23) so that the debounce circuits remain imperative. Therefore, signals SW1 – SW3 will respond without delay to any changes in the switch inputs and will allow accelerated testing.

Segment Display Circuits.

The entire watch circuit, excluding output, has now been described and the desired information is provided as data bus 80. The remaining circuitry will decode and display the information at the selected digit positions.

The digit scan outputs, DG1 – DG8, and the RAM data outputs coupled through decoder 90 and segment font 92 are combined and displayed in decimal output by display drivers 56 (FIG. 1). During clock $\phi 2$, RAM data, D0 – D3, is presented to the inputs of four CMOS latches collectively denoted in FIG. 27 by reference character 568. Each CMOS latch 568 is comprised of a nor gate 570 coupled to an inverter 572 which has a feedback loop to nor gate 570 through a CMOS transmission gate 574. RAM data inputs DO – D3 are also gated into the CMOS latch 568 through a CMOS transmission gate 576. CMOS transmission gates 574 and 576 are driven by a nor gate-inverter combination 578. Nor gate-inverter combination 578 is in turn controlled by clock signal $\overline{\phi 2}$ and $\overline{T1}$. Thus, CMOS latches 568 are in the latched mode at all times except during the clock interval T1 $\phi 2$. CMOS latches 568 serve to buffer and isolate the entire display circuitry for the remainder of the integrated circuit chip and to allow selected digits and multiplexing rates to be applied to the segment drivers should the chip be adapted to a LED output. In the present embodiment, a LCD output is described, although the present invention may be used with either LCD or LED outputs.

Figure 28:
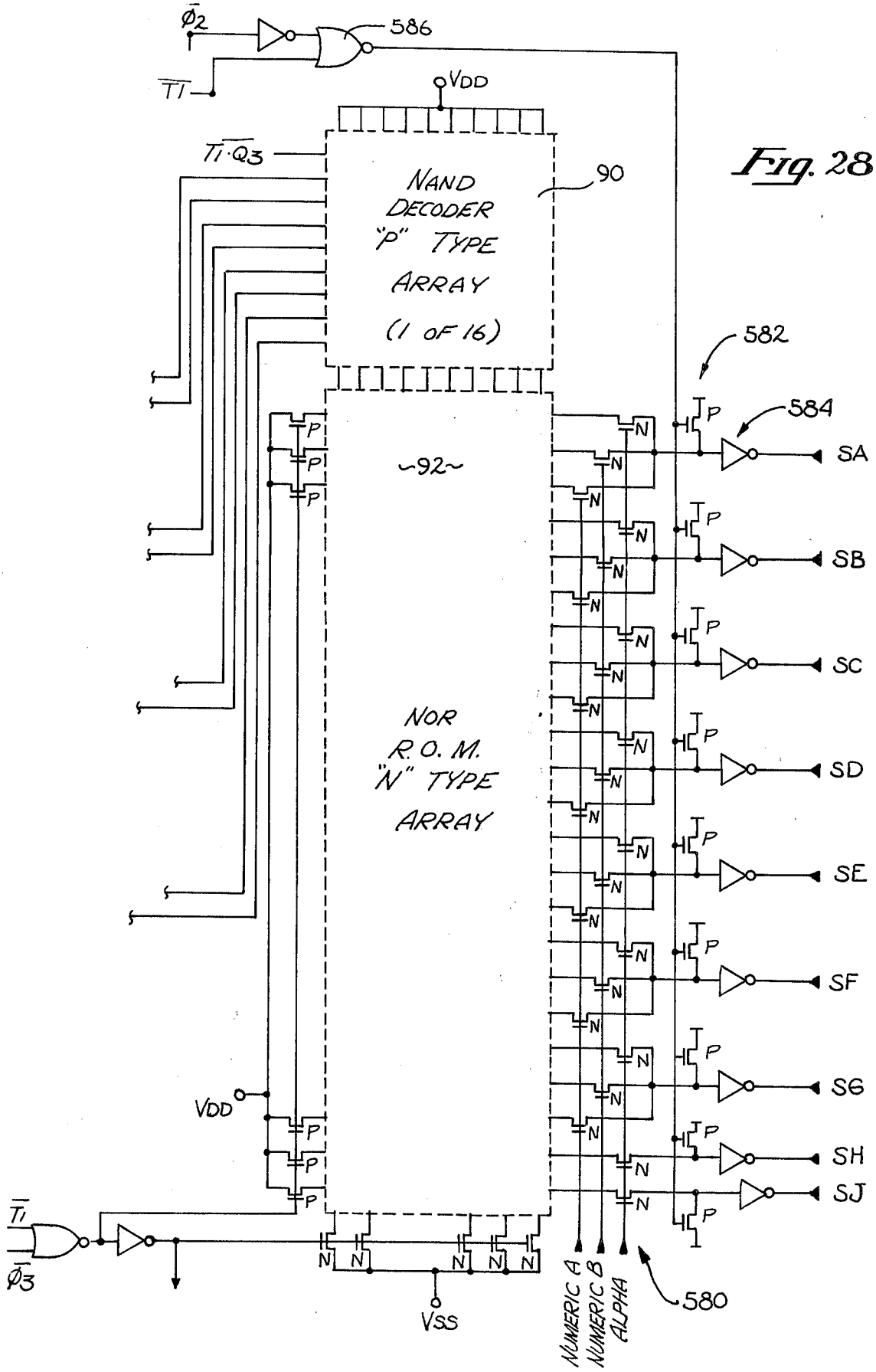
FIG. 28 is a schematic for the nand decoder, nor ROM and multiplexer for the segment drivers.
Figure 29:
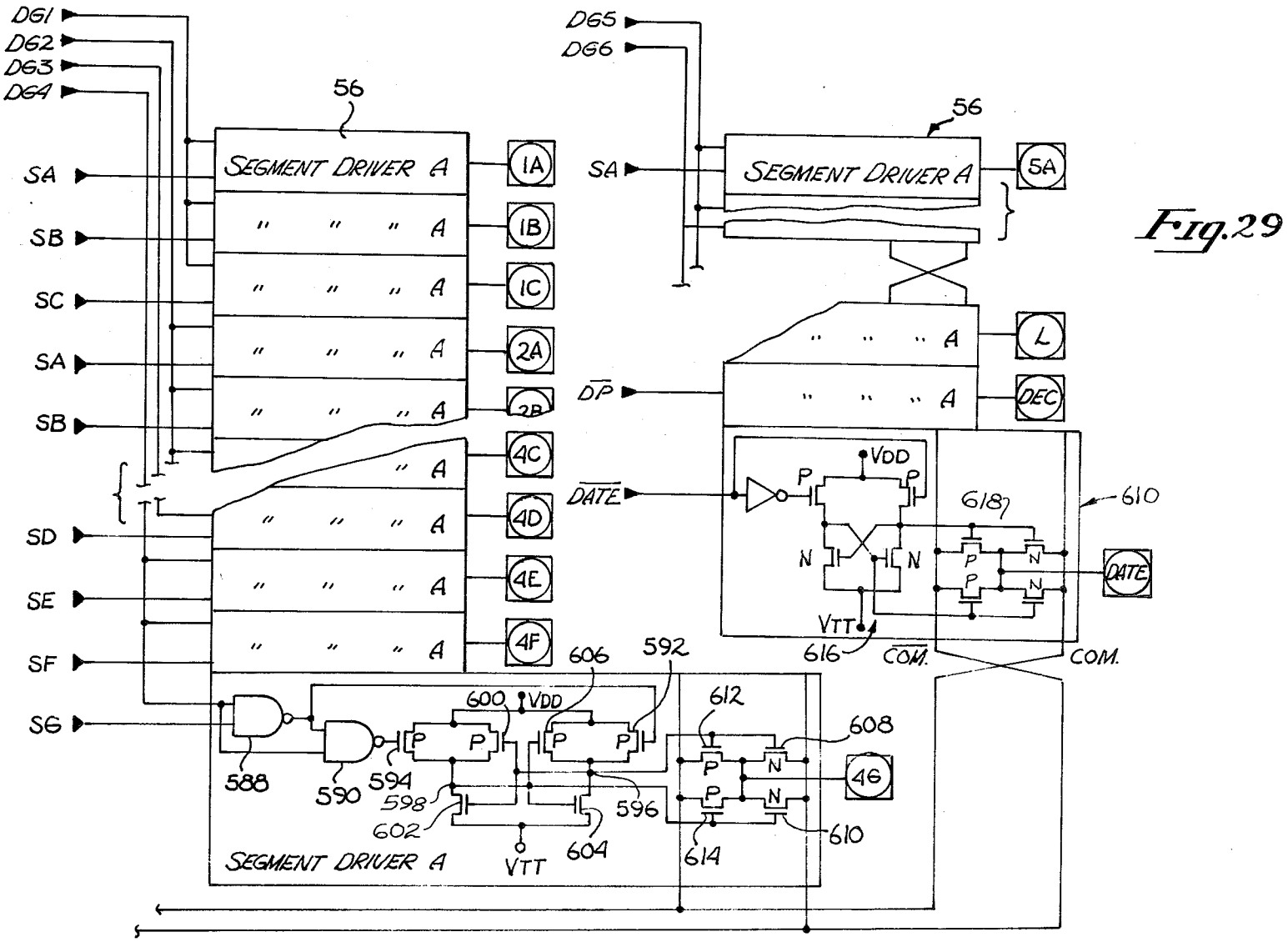
FIG. 29 is a schematic of a typical segment driver, a typical D.C. latch and illustrates the inputs and outputs to the segment drivers.

Decoder 90 and segment FONT ROM 92 in FIG. 28 form a nand P-type decoder array in combination with an N-type nor ROM array in the same manner as PLA 74 and display sequence ROM 54 and decoder 48. Decoder 90 and ROM 92 translate from the BCD code used throughout the chip to a 7 or 9 segment decimal display font.

Decoder 90 and ROM 92 are accessed during clock intervals T1 $\phi 3$ and T1 $\phi 4$. In the presently preferred embodiment decoder 90 and ROM 92 are programmed and coded as shown in Table 8. Two seven segment and one nine segment display font may be generated, namely numeric A, numeric B, and alpha although the present embodiment uses alpha and numeric A only.

N-type transmission gates 580 form a multiplexer which appropriately selects one of the fonts and couples the selected display signals, SA – SJ onto the segment bus. Zeros are written onto each of the lines of the segment bus during the time interval T1 $\phi 1$, and T1 $\phi 3$ – T1 $\phi 4$ by means of a disenabling signal coupled to P-type pull-up devices, collectively denoted by the reference numeral 582, which devices are combined with inverters, collectively denoted by the reference numeral 584. Pull-up devices 582 are driven by nor gate 586 which has $\overline{T1}$ and $\phi 2$ as its inputs.

After the font format has been selected by appropriately activating selected transmission gates 580, the digits of the display are strobed by the digit scan by means of serial activation of digit select signals, DG1 – DG6. The segment driver for segment 4G is illustrated in detail as an example in FIG. 29. In the segment driver corresponding to indicia member 4G, the corresponding inputs are the digit select signal, DG4 and the segment select signal SG. Both signals are inputs to nand gate 588. If both input signals are true, nand gate 588 will have a false output, otherwise the output is true. Digit select signal DG4 and the output of nand gate 588 are the inputs to nand gate 590. When digit DG4 is strobed but segment SG is selected, nand gate 590 will have a zero and one input, and will, therefore, have a true output.

Nand gates 588 and 590 drive a level shifter circuit coupled between Vdd and Vtt (Vtt > Vss) so that an appropriately high voltage may be applied between the segments and common plane. The output of nand gate 588 is also coupled to the gate of P-type device 592 while the output of nand gate 590 is coupled to the gate of P-type device 594. If the gate of device 594 is true, it will be nonconductive. However, if the gate of 592 is false, it will be conductive thereby causing node 596 to go true. Node 596 is coupled to the gates of latching devices 600 and 602. The binary one at node 596 will hold latching device 600 off while latching device 602 becomes conductive thereby pulling node 598 to a binary zero. Node 598 is coupled to the gates of latching devices 604 and 606. A binary zero at node 598 causes latching device 604 to be nonconductive and latching device 606 to be conductive thereby reinforcing the binary one at node 596. It may be appreciated that once latching devices 602 and 606 are conductive, the inputs to P-type devices 592 and 594 are immaterial and the circuit is latched into the state defined by NAND gates 588 and 590.

In the example illustrated, a binary one at node 596 and a binary zero at node 598 causes transmission devices 608 and 610 to become conductive. Thus, segment 4G becomes coupled to potential on the common line, $\overline{COM}$. Thus, the data is retained within the segment driver until the next strobe pulse.

Had digit select signal, DG4, been false, the output of nand gate 588 would have been true and the output of nand gate 590 false. Device 592 would have become nonconductive. Device 594, however, would also have become conductive pulling node 598 to a binary one. The binary one on node 598 would have caused latching device 604 to become conductive pulling node 596 to a binary zero. Latching device 600 would have become conductive, latching the level shifter circuit in the opposite state so that transmission devices 612 and 614 would become conductive while transmission devices 608 and 610 have become non-conductive. In such a case segment 4G becomes coupled to the common line, COM. There being no phase difference between the activated segment and the common plane, segment 4G would remain unilluminated in a LCD output.

The same result occurs if digit select signal DG4 is high while segment signal 4G is low. In the case when both digit select signal DG4 and segment signal SG are low, the output of nand gate 588 is high. The output of nand gate 590 is also high. In such case, whatever information was previously stored in the latch circuit remains stored there and the output does not change. Therefore, the display for each segment remains constant until the next digit select pulse, DG4, at which time the state of the latch is changed to reflect the state of the segment data bus SG.

The colon, segment L, the decimal point, DEC, and the data identifier, DATE, are DC signals generated by the master timing and control circuit 44, as previously described, and are presented to a latch circuit 610, which is similar to that of the segment drivers. Level shifter 616 drives a CMOS transmission pair 618 similar to devices 608 – 614.

Figure 30:
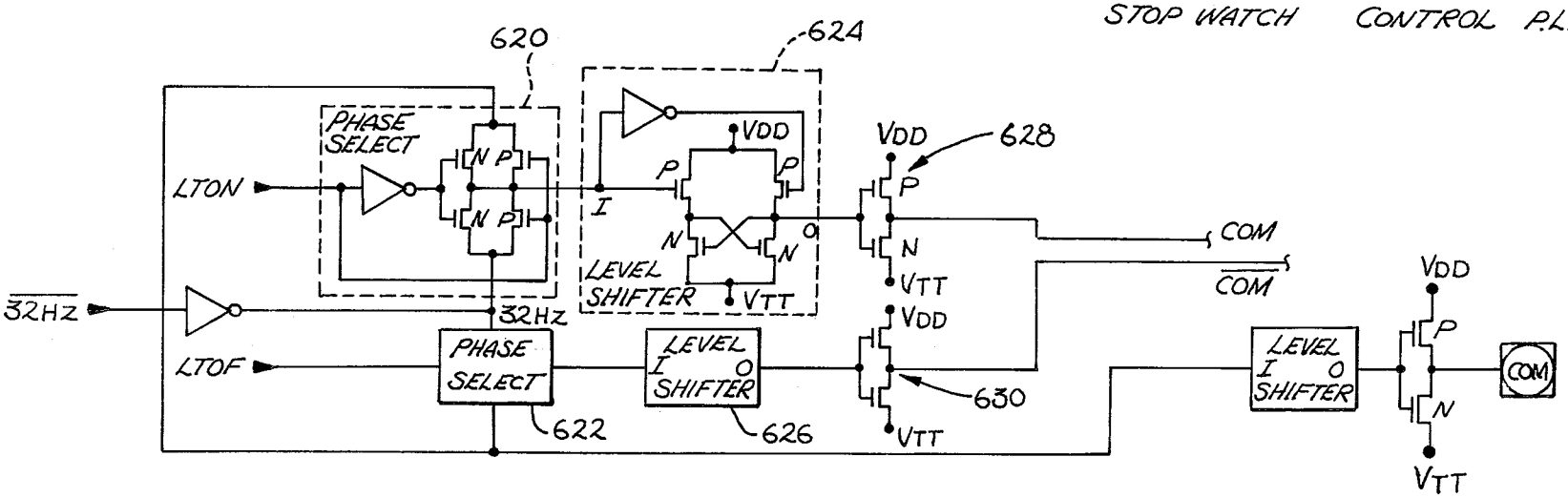
FIG. 30 is a schematic of the segment voltage generator.

The segment drive, COM, and its complement are generated from the 32 Hz clock derived from and control circuit 44. Driving the liquid crystal display at 32 Hz increases its stability and longevity. The 32 Hz signal and its complement serve as the power supply for phase select circuits 620 and 622 which are clocked by the internal control signals lamp test on, LTON, and lamp test off, LTOF respectively (FIG. 30). The output of phase select circuits 620 and 622 are coupled to the input of level shifter circuits 624 and 626 respectively. The output of phase select 620 will be the 32 Hz signal when internal control signal LTON is high, otherwise it will be $\overline{32\ Hz}$. Level shifter circuit 624 and 626 are bistable CMOS flip-flops which serve to transform the voltage levels from those compatible for integrated circuit chip to that necessary to drive the LCD output.

The output of each level shifter circuit 624 and 626 is coupled to a CMOS inverter 628 and 630 respectively. The output from CMOS inverter 630 is 180 degrees out of phase from the output from CMOS inverter 628 provided LTOF and LTON are both in the same state. By causing internal control circuit LTON to change state, the output of inverter 628 may be shifted 180 degrees such that COM is changed to its complement and all LCD segments are displayed regardless of the data stored in the latch of the segment driver. Similarly, each segment may be turned off, regardless of data input by selectively activating internal control signal LTOF.

Figure 27:
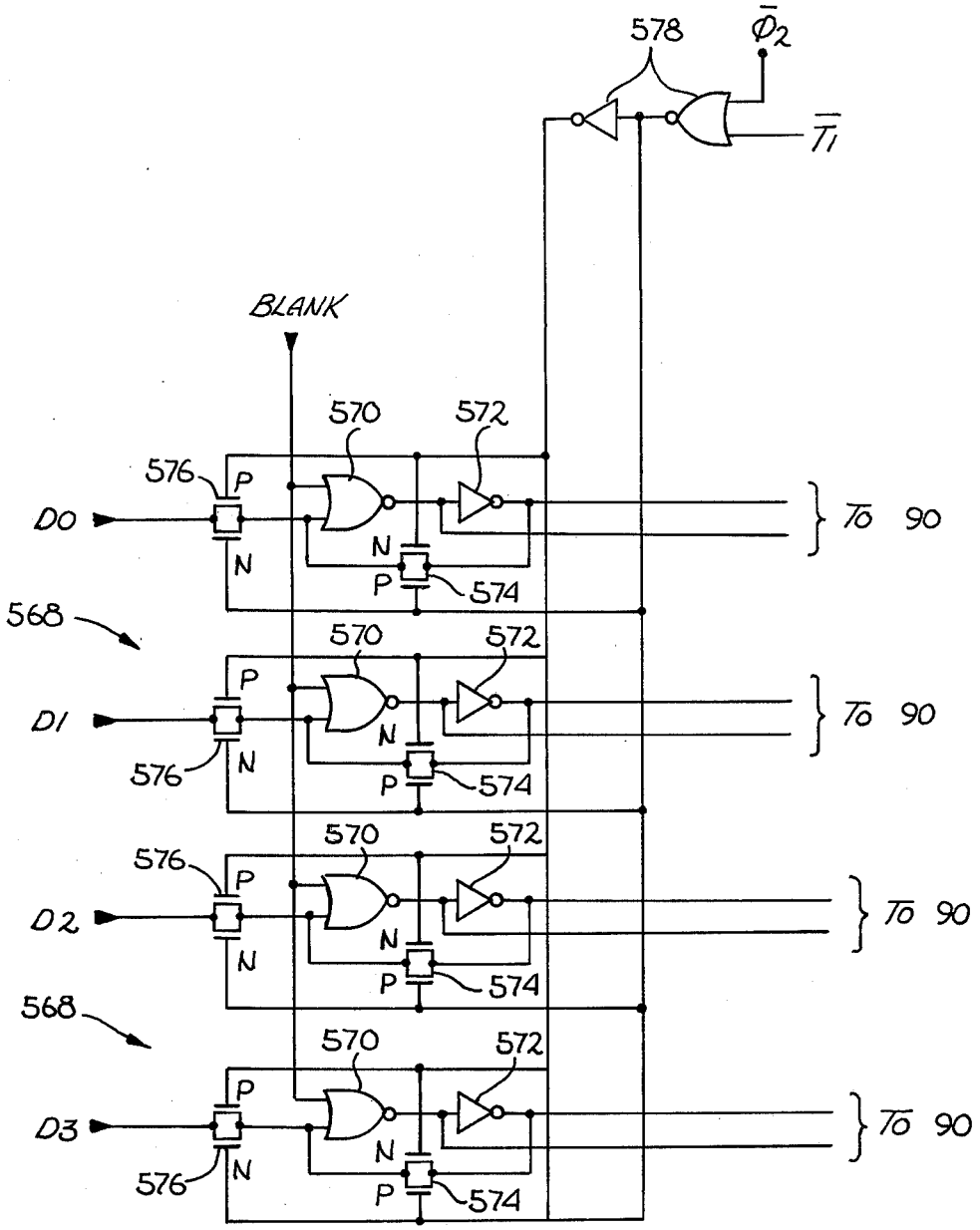
FIG. 27 is a schematic for the segment driver latches.

Finally, to turn all digits off and to provide control of leading zero suppression, individual digit blanking, and flashing, internal control signal, BLANK, may be generated by timing control circuit 44. As shown in FIG. 27, internal control signal, BLANK, is an input to each nor gate 570. When the internal control signal, BLANK , goes true, the output of each nor gate 570 must go low. Thus, the output of latches 568 each go true representing the number 1111. There is no valid numeral corresponding to the binary number 1111 (15) in BSD coding so this number is decoded by decoder 90 and ROM 92 by placing each of the LCD segment signals, SA – SJ in a low state. Thus, the LCD output is blank.

The present invention has been described in relation to a specific embodiment. It is intended that other embodiments may be provided by changing the various PLA, decoder, and ROM codes or RAM organization. Such embodiments may include an alarm clock having multiple and variable alarm settings. For example, the alarm setting could include:

TABLE 8

| ALARM | SETTINGS |
|---|---|
| single | month, date, hour, minute |
| double | (month, date), (month, date) 2 |
| double | (month, date), (hour, minute) |
| double | (hour minute), (hour minute) 2 |
| double | (month, date, hour, minute) (month, date) 2 |
| double | (month, date, hour, minute) (hour, minute) |

Other embodiments could include a double watch capable of simultaneously keeping two independent time records, e.g., corresponding to separate time zones. Still further embodiments could include a chronograph counter. For example, the present embodiment could be modified to include two stopwatch modes and an incrementor and decrementor to be used for counting. The watch could also be modified to include three stopwatch modes to record elapsed times for three consecutive events, such as, win, place, and show, and a counter. Other alternations and modifications in circuitry may also be made by those having ordinary skill in the art without departing from the spirit and scope of the present invention.

I claim:

1. A timekeeping circuit is an integrated circuit watch, said watch having a master oscillator for generation of a timekeeping signal and having output means for generating an output signal, comprising:

a control means for selectively generating an address and control signal, said control means being coupled to said master oscillator and responsive at least in part to said timekeeping signal;

address decoder means for decoding at least part of said address and control signal, said address decoder means being coupled to said control means;

a RAM being coupled to said address decoder means, said RAM being responsive to said address and control signal to provide a selected binary word;

PLA being coupled to said address decoder means, said PLA generating an output binary word in response to said address and control signal and to said selected binary word; and memory control means being coupled to said RAM, said PLA, and said output means, for selectively coupling said selected binary word said RAM, said PLA and said output means.

2. The timekeeping circuit of claim 1 wherein said PLA is arranged and configured to selectively increment said selected binary work, to compare said selected binary word to a limit value, to generate a carry signal if appropriate, and to generate said output binary word.

3. The timekeeping circuit of claim 2 wherein said memory control means includes a plurality of multiplexers coupled to said RAM, each of said multiplexers for coupling a selected portion of said RAM to said PLA.

4. The timekeeping circuit of claim 3 wherein said memory control means further includes means for selectively coupling said selected binary word from said random access memory to said output means.

5. The timekeeping circuit of claim 4 wherein said memory control means further includes a plurality of bistable circuit elements for generating a corresponding plurality of internal flag signals.

6. The timekeeping circuit of claim 5 wherein said memory control means further includes storage means for temporarily storing said selected binary word before said selected binary is coupled to said PLA.

7. The timekeeping circuit of claim 6 wherein said RAM is a static memory, and said PLA is a dynamic array.

8. The timekeeping circuit of claim 7 wherein said RAM and PLA are comprised of CMOS devices, and said PLA is arranged and configured as a nand-nor array.

9. A method for keeping time in an integrated circuit having control means for selective generating an address and control signal, having a master oscillator for generation of a timekeeping signal coupled to said control means, and having output means for generating an output signal, comprising the steps of:

decoding in response to at least in part to said timekeeping signal a first address and decoding a control signal;

selectively accessing at least one cell within a RAM coupled to an address decoder means in response to said decoded first address and control signal;

coupling the selected binary word stored in said accessed cell in said RAM to a memory means in response to a first control signal from said control means; and selectively coupling said selected binary word in said memory to at least one of said RAM, said output means, and a PLA.

10. The method of claim 9 wherein said memory means couples said selected binary word to said PLA, and further comprising the steps of:

generating an output binary words from said PLA, said output binary word being a logical zero if said selected binary word equals a selected predetermined limit value fixed within said PLA, said output binary word being equal to said selected binary word plus one if said selected binary word is less than said selected predetermined limit value fixed within said PLA; and generating a second address and control signal if said output binary word generated by said PLA is a logical zero.

11. An integrated circuit watch comprising:

input means for generating at least one input signal;

a master oscillator for generating a frequency standard signal;

timing and control means coupled to said master oscillator and to said input means, said timing and control means generating at least one timing and control signal in response to said input signal and said frequency standard signal;

address generation means coupled to said timing and control means, said address generation means generating an address signal in response to said timing and control signal;

address decoder means coupled to said address generation means and to said timing and control means, said address decoder means decoding said address signal in response to said timing and control signal;

a RAM coupled to said address decoder means and to said timing and control means, a selected binary word being read from said RAM in response to said timing and control signal;

a PLA coupled to said address decoder means and to said timing and control means, said PLA generating an output binary word in response to said address signal and to said timing and control signal;

memory means coupled to said RAM and PLA for selectively coupling said selected binary word from said RAM to said PLA; and output means coupled to said timing and control means, to said memory means, and to said address generation means, said memory means selectively coupling said selected binary word from said RAM to said output means, said output means selectively generating an output signal in response to said output binary word, in response to said selected binary word and in response to said timing and control signal.

12. The integrated circuit watch of claim 11 wherein said PLA includes a first and second logic array, and, is arranged and configured to selectively increment said selected binary word, to compare said selected binary word to a limit value, to generate a carry signal if appropriate and to generate said output binary word.

13. The integrated circuit watch of claim 12 wherein said memory means includes:

a plurality of multiplexers coupled to said RAM, each of said multiplexers for coupling a selected portion of said RAM to said PLA;

bus means for selectively coupling said selected binary word from said RAM to said output means said bus means being coupled to said RAM, PLA, and output means; and a plurality of bistable circuit elements for generating a corresponding plurality of internal flag signals, at least one of said bistable circuit elements being coupled between said first and second logic array of said PLA.

14. The integrated circuit watch of claim 13 wherein said memory means further includes calendar correction means coupled to said PLA and said bus means, said calendar correction means generating an internal control signal coupled to said PLA and being selectively responsive to said selected binary word read from said RAM.

15. The integrated circuit watch of claim 13 wherein said first logic array of said PLA is a nor array of dynamic devices, said second logic array of said PLA is a nand array of dynamic devices and said RAM is an array of static memory cells.

16. The integrated circuit watch of claim 11 wherein said address generation means includes:

watch sequence counter and digit scan counter means for selectively generating a first ordered plurality of address signals corresponding to selected locations within said RAM and for selectively generating an ordered series of digit identification signals, said address signals being coupled to said RAM and said digit identification signals being coupled to said output means, said watch sequence counter and digit scan means being coupled to said timing and control means and being responsive to said timing and control signal;

address display decoder means for decoding said timing and control signal from said timing and control means, said address display decoder means being coupled to said timing and control means and being responsive to said timing and control signal; and a ROM being coupled to said watch sequence counter and digit scan counter means to selectively generate a second ordered plurality of address signals corresponding to selected locations within said RAM in response to said timing and control signal, said ROM having an output coupled to said RAM.

17. The integrated circuit watch of claim 16 wherein said address generation means further includes:

chronograph sequence counter means for selectively generating a third ordered plurality of address signals corresponding to selected locations within said RAM, said chronograph sequence counter means being coupled to said timing and control means and having an output coupled to said RAM.

18. The integrated circuit watch of claim 16 wherein said address generation means further includes:

time delay counter means for selectively generating at least one address signal corresponding to a selected location within said RAM, said time delay counter means being coupled to said timing and control means and having an output coupled to said RAM.

19. The integrated circuit watch of claim 11 wherein said output means includes:

display decoder means for selectively decoding said selected binary word from said RAM and said output binary word from said PLA, said display decoder means being coupled to said memory control means;

a ROM being coupled to said display decoder means and timing and control means to selectively generate a display signal in response to said timing and control signal, said selected binary word and output binary word; and output display means being coupled to said ROM, and to said address generation means, said output display means for generating said output signal.

20. The integrated circuit watch of claim 19 wherein:

said display decoder means includes a plurality of latch circuits, each of said latch circuits being coupled to one output of said memory control means and having an output coupled to a nand decoder array;

said output display means is coupled to said timing and control means, said output display means generating a visual output signal; and said ROM is a dynamic nor array.

21. The integrated circuit watch of claim 11 wherein said timing and control means includes:

prescale divider means for generating a plurality of timing signals, said prescale divider means being coupled to said master oscillator;

master control means for generating a plurality of control signals, said master control means being coupled to said input means and said prescale divider means; and a plurality of clocking means for selectively generating a corresponding plurality of clock signals, said clocking means being coupled to said prescale divider means and master control means.

22. The integrated circuit watch of claim 21 wherein at least one of said clocking means includes:

clock latch means being coupled to said prescale divider means, said clock latch means generating decoder inhibit signal in response to the first occurrence of said corresponding clock signal;

clock request decoder means coupled to said clock latch means, said clock request decoder means for selectively generating a clock request signal in response to said decoder inhibit signal and at least one of said timing signals from said prescale divider means;

master-slave latch means for selectively generating a clock inhibit signal in response to said clock request signal, in response to at least one of said timing signals, in response to at least one of said clock signals, and in response to at least part of said output binary word from said PLA, said master-slave latch means coupled to said clock request decoder means, said prescale divider means, and said PLA; and clock generator means coupled to said master-slave latch means and prescale divider means, said clock generator means generating said clock signals in response to at least one of said timing signals, and in response to said clock inhibiting signal.

23. The integrated circuit watch of claim 22 wherein at least one of said master-slave latch means, said clock generator means, said clock decoder request means and said clock latch means is coupled to said master control means and is responsive to at least one of said control signals.

24. The integrated circuit watch of claim 21 wherein said master control means includes at least one state counter means for generating at least one of said control signals, said state counter means being coupled to said input means and being responsive to said input signals, and having an output coupled to said address generation means.

25. The integrated circuit watch of claim 24 wherein at least one of said state counter means includes:

timeset state counter means for generating watch and timeset control signals, said timeset state counter means being responsive to said input signals and being coupled to said input means and address generation means; and a timeset PLA being coupled to said timeset state counter means and address generation means, and selectively generating a plurality of timeset display signals in response to said watch and timeset control signals, said address signal, and said timing signals, said timeset display signals causing selected binary words stored in said RAM to be selectively incremented and displayed in order to set the time within said integrated circuit watch.

26. The integrated circuit watch of claim 24 wherein at least one of said state counter means includes:

chronograph state counter means for generating chronograph control signals, said chronograph state counter means being responsive to said input signals and being coupled to said input means and address generation means; and a chronograph PLA being coupled to at least said chronograph state counter means and selectively generating a plurality of chronograph display signals in response to at least said chronograph control signals, said chronograph display signals causing selected binary words stored in said RAM to be selectively incremented and displayed in order to operate in at least one stopwatch mode.

27. The integrated circuit watch of claim 25 wherein said master control means includes debounce means coupled to said input means and said prescale divider, said debounce means generating said input control signal provided said input signal is valid for a preselected time interval.

28. The integrated circuit watch of claim 24 wherein said master control means includes fast test means for selectively coupling said clocking means to said prescale divider means, so that each possible state of said output means may be initiated at a rate greater than normally initiated by said master control means.

29. The integrated circuit watch of claim 20 wherein said output display means includes:

segment voltage means for generating a first and second segment voltage, said first segment voltage being approximately 180 degrees out of phase from said second segment voltage, said segment voltage means being coupled to said timing and control means; and a plurality of segment driver circuits, each segment driver circuit including a decoder circuit coupled to a bistable level shifter means for generating a first and second gating signal, said bistable level shifter means coupled to a transmission circuit means, said transmission circuit means selectively coupling said first and second segment voltages to an indicia member of an LCD device in response to said first and second gating signals respectively, said bistable level shifter being responsive to the output of said decoder circuit, said decoder circuit being coupled to said ROM and said address generation means.

30. The integrated circuit watch of claim 29 wherein said timing and control means includes fast test means for selectively coupling said first and second segment voltages to said indicia members of said LCD device to cycle said LCD device through a plurality of selected output states.

31. An integrated circuit watch comprising:

input means for generating at least one input signal;

a master oscillator for generating a frequency standard signal;

timing and control means coupled to said master oscillator and to said input means, said timing and control means for generating a plurality of timing signals and a plurality of control signals in response to said input signal and said frequency standard signal, said timing and control means including at least one PLA to selectively generate a plurality of control signals;

address generation means coupled to said timing and control means, said address generation means for generating a plurality of address signals in response to said timing and control signal, said address generation means including a decoder - ROM circuit to selectively generate said plurality of address signals.

address decoder means coupled to said address generation means and to said timing and control means, said address decoder means decoding said address signal in response to said timing and control signal;

a RAM coupled to said address decoder means and to said timing and control means, a selected binary word being read from said RAM in response to said timing and control signal;

a PLA coupled to said address decoder means and to said timing and control means, said PLA generating an output binary word in response to said address signal and to said timing and control signal;

memory means coupled to said RAM and PLA for selectively coupling said selected binary word from said RAM to said PLA and from said PLA to said RAM, and output means coupled to said timing and control means, to said memory means, and to said address generation means, said memory means selectively coupling said selected binary word from said RAM to said output means and selectively coupling said output binary word from said PLA to said output means, said output means selectively generating a plurality of output signals in response to said output binary word, in response to said selected binary word and in response to said timing and control signal, said output means including a decoder - ROM circuit to selectively generate said plurality of address signals.

* * * * *

UNITED STATES PATENT OFFICE

CERTIFICATE OF CORRECTION

PATENT NO. : 4,063,409

DATED : December 20, 1977

INVENTOR(S) : John A. Bayliss

It is certified that error appears in the above-identified patent and that said Letters Patent are hereby corrected as shown below:

In Claim 1, column 42, line 1,
delete "is" and insert --in--.

In Claim 1, column 42, line 21,
between "binary word" and "said RAM" insert --to--.

In Claim 9, column 42, line 59,
after "response" and before "at least", please delete --to--.

In Claim 10, column 43, line 7,
please delete "words" and insert --word--.

In Claim 31, column 47, line 25,
after "signals" please delete "." and insert --;--.

In Claim 31, column 48, line 14
after "RAM", please delete "," and insert --;--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*